US007825591B2

(12) United States Patent
Kimiya et al.

(10) Patent No.: US 7,825,591 B2
(45) Date of Patent: Nov. 2, 2010

(54) MESH STRUCTURE AND FIELD-EMISSION ELECTRON SOURCE APPARATUS USING THE SAME

(75) Inventors: Junichi Kimiya, Fujisawa (JP); Keisuke Koga, Souraku-gun (JP); Makoto Yamamoto, Takarazuka (JP)

(73) Assignee: Panasonic Corporation, Osaka (JP)

( * ) Notice: Subject to any disclaimer, the term of this patent is extended or adjusted under 35 U.S.C. 154(b) by 790 days.

(21) Appl. No.: 11/706,939

(22) Filed: Feb. 13, 2007

(65) Prior Publication Data

US 2007/0188091 A1 Aug. 16, 2007

(30) Foreign Application Priority Data

Feb. 15, 2006 (JP) ..... 2006-038474

(51) Int. Cl.
*H05H 7/00* (2006.01)

(52) U.S. Cl. ..... 313/506; 313/310; 313/495; 315/169.3

(58) Field of Classification Search ..... 313/309–311, 313/495–497, 506; 250/208.1, 214.1; 315/169.3, 315/326
See application file for complete search history.

(56) References Cited

U.S. PATENT DOCUMENTS 5,495,146 A 2/1996 Saito et al.
5,773,933 A * 6/1998 Yoder ..... 315/3
5,990,605 A * 11/1999 Yoshikawa et al. ..... 313/310
6,075,315 A 6/2000 Seko et al.
6,249,080 B1 * 6/2001 Komoda et al. ..... 313/310
6,445,124 B1 9/2002 Asai et al.
6,498,426 B1 * 12/2002 Watabe et al. ..... 313/310
6,583,578 B1 * 6/2003 Ichihara et al. ..... 315/169.3
6,791,248 B2 * 9/2004 Komoda et al. ..... 313/310
7,009,344 B2 3/2006 Lee et al.
7,233,301 B2 6/2007 Yotani et al.
2001/0043172 A1 11/2001 McGrath et al.
2003/0132695 A1 7/2003 Yamauchi et al.
2003/0197457 A1 * 10/2003 Komoda et al. ..... 313/310
2004/0251811 A1 12/2004 Nakamura et al.
2005/0184220 A1 * 8/2005 Okuda et al. ..... 250/208.1
2005/0231090 A1 10/2005 Chen et al.
2006/0290291 A1 12/2006 Aizawa (Continued)

FOREIGN PATENT DOCUMENTS

JP 3-226949 10/1991

(Continued)

*Primary Examiner*—Douglas W Owens
*Assistant Examiner*—Tung X Le
(74) *Attorney, Agent, or Firm*—Hamre, Schumann, Mueller & Larson, P.C.

(57) ABSTRACT

An electron beam emitted from a field-emission electron source array passes through a plurality of through holes formed in a mesh structure and reaches a target. Each of the plurality of through holes in the mesh structure has an opening on a side of the field-emission electron source array and an electron beam passageway that continues from the opening. The mesh structure is formed of a silicon-containing material doped with a N-type or P-type material. In this way, it is possible to suppress a decrease in the amount of the electron beam reaching the target while securing a mechanical strength of an electrode provided with a large number of through holes, and suppress expansion of the electron beam on the target.

15 Claims, 22 Drawing Sheets

U.S. PATENT DOCUMENTS

| | | | |
|---|---|---|---|
| 2007/0188090 | A1 | 8/2007 | Kimiya et al. |

FOREIGN PATENT DOCUMENTS

| | | |
|---|---|---|
| JP | 6-111735 | 4/1994 |
| JP | 6-208837 | 7/1994 |
| JP | 9-69347 | 3/1997 |
| JP | 9-270229 | 10/1997 |
| JP | 2000-48743 | 2/2000 |
| JP | 2000-173512 | 6/2000 |
| JP | 2000-251808 | 9/2000 |
| JP | 2002-512737 | 4/2002 |
| JP | 2002-313263 | 10/2002 |
| JP | 2004-227822 | 8/2004 |
| JP | 2005-93125 | 4/2005 |
| JP | 2006-4643 | 1/2006 |
| WO | 98/50604 | 11/1998 |

* cited by examiner

MESH STRUCTURE AND FIELD-EMISSION ELECTRON SOURCE APPARATUS USING THE SAME

BACKGROUND OF THE INVENTION

1. Field of the Invention

The present invention relates to a mesh structure and a field-emission electron source apparatus using the same.

2. Description of Related Art

In recent years, with the development of fine processing technology for semiconductors, attention has been directed to a vacuum microelectronics technology of integrating a large number of minute cold cathode structures on the order of micrometers on a semiconductor substrate or the like. Field-emission electron source arrays including the minute cold cathode structures obtained by such a technology achieve flat-type electron emission characteristics and a high electric current density, and do not require a heat source such as a heater, unlike hot cathodes, thus offering potential as electron sources for a low-power-consumption next-generation flat display, sensors and electron sources for a flat-type imaging apparatus.

As vacuum apparatuses using the field-emission electron source arrays described above, field-emission electron source display apparatuses shown in JP 9(1997)-270229 A, JP 9(1997)-69347 A, JP 6(1994)-111735 A and JP 2000-251808 A, field-emission electron source imaging apparatuses shown in JP 2000-48743 A, etc. and a light-emitting device shown in JP 2002-313263 A have been known.

In general, as shown in FIG. 26, such a field-emission electron source apparatus using a field-emission electron source array includes a front panel 101, a back panel 105 and a wall part 104, which are fixed firmly by a sealing material 109 such as frit glass or indium. An inner space of the field-emission electron source apparatus is maintained under vacuum.

An inner surface of the front panel 101 is provided with an anode electrode 102 transmitting incident light from outside, for example, and a surface of the anode electrode 102 is provided with a target 103. In general, the target 103 is a phosphor layer in which phosphors emitting three colors of light are arranged regularly when used as a field-emission electron source display apparatus and a photoelectric conversion film for converting incident light into a signal charge when used as a field-emission electron source imaging apparatus.

An inner surface of the back panel 105 is provided with a semiconductor substrate 106 on which a field-emission electron source array is formed. A plurality of cold cathode elements (emitters) 107 and peripheral elements 108 including an insulating layer formed so as to surround the individual cold cathode elements 107 and gate electrodes for applying a voltage for drawing electrons from the cold cathode elements 107 are integrated in the field-emission electron source array. Electron beams emitted from the cold cathode elements 107 are made to land on the target 103, whereby the phosphor can be caused to emit light so as to display an image in the field-emission electron source display apparatus and an image formed on the photoelectric conversion film by incident light can be read in the field-emission electron source imaging apparatus.

A representative example of the field-emission electron source generally can be a Spindt-type field-emission electron source in which cold cathode elements with a sharpened tip are formed on a semiconductor substrate, an insulating layer is formed around the cold cathode elements, gate electrodes are formed on the insulating layer, and a voltage is applied between the cold cathode elements and the gate electrodes, thereby emitting electrons from the tips of the cold cathode elements. Besides the above, examples thereof include field-emission electron sources of an MIM (metal insulator metal) type in which an insulating layer is formed between cathode electrodes and gate electrodes, and a voltage is applied to the insulating layer, thereby emitting electrons by a tunnel effect; those of an SCE (surface conduction electron source) type in which a minute gap is provided between cathode electrodes and emitter electrodes, and a voltage is applied between these electrodes, thereby emitting electrons from the minute gap; and those using a carbonaceous material such as DLC (diamond like carbon) or CNT (carbon nanotube) for an electron source.

In these field-emission electron sources including a cold cathode, the amount of electrons emitted from individual cold cathode elements is minute. Therefore, in the case where they are used as a field-emission electron source display apparatus or as a field-emission electron source imaging apparatus, unit cells each including a plurality of the field-emission electron sources (electron source cells) are formed, thus securing an amount of electric current necessary for performing a predetermined operation.

These cells are arranged on a flat surface, for example, in a matrix. More specifically, a plurality of emitter lines extending along a longitudinal direction are arranged at regular intervals in a transverse direction, a plurality of gate lines extending along the transverse direction are arranged at regular intervals in the longitudinal direction, and the cell is provided at each intersection of these plurality of emitter lines and gate lines. When driving the field-emission electron source apparatus, the emitter lines and the gate lines are selected sequentially, whereby an electron beam is emitted sequentially from the cell at the intersection of the emitter line and the gate line that are selected. In the instant specification, the cell that emits an electron beam as described above will be referred to as a "selected cell" in the following. In this manner, an image can be displayed in the field-emission electron source display apparatus, and a formed image can be read in the field-emission electron source imaging apparatus.

Since the field-emission electron source performs the field emission of electrons by a strong electric field formed between the cold cathode elements and the gate electrodes, the electrons are emitted from the individual cold cathode elements while having a predetermined divergence (the angle of this divergence is called a "divergence angle" and, for example, is about 30° in the case of the Spindt-type field-emission electron source).

Generally, in the vacuum apparatuses using the field-emission electron source described above, as shown in FIG. 26, the field-emission electron source array is placed on the back panel 105 of a vacuum container, and the target 103 on which an electron beam from the field-emission electron source array is landed for performing a predetermined operation is formed on the front panel 101. Here, the distance from the field-emission electron source array to the target 103 is determined uniquely by the distance between the back panel 105 and the front panel 101 on which they are provided.

In other words, in these conventional field-emission electron source apparatuses, the distance between the field-emission electron source array placed on the back panel 105 and the target 103 formed on the front panel 101 varies considerably from an ideal design distance depending on the accuracy of a portion where the front panel 101 and the back panel 105 are joined to the wall part 104.

For example, when the front panel 101 and the back panel 105 are joined to the wall part 104 using frit glass, variations of an amount of frit glass to be supplied, shrinkage generated in the course of burning and welding at about 400° C., etc. cause variations of the distance between the field-emission electron source array placed on the back panel 105 and the target 103 formed on the front panel 101.

Also, when the front panel 101 and the back panel 105 are joined to the wall part 104 by low-temperature sealing using a soft metal such as indium, since the indium is squashed between the front panel 101 and the wall part 104 and between the wall part 104 and the back panel 105 at the time of sealing, the variations of the supply amount and the squashing amount of the indium cause variations of the distance between the field-emission electron source array placed on the back panel 105 and the target 103 formed on the front panel 101.

The variations of the distance between the field-emission electron source array and the target 103 can be in a range of about several hundred micrometers to several millimeters.

As described above, in the conventional field-emission electron source apparatuses, it is difficult to control the distance between the field-emission electron source array placed on the back panel 105 and the target 103 formed on the front panel 101 in a highly accurate manner. Further, the electrons are emitted from each of the cold cathode elements with the divergence angle of about 30°. Therefore, the variations of the distance between the field-emission electron source array and the target 103 lead to variations of a degree of expansion of an electron beam spot (namely, a spot diameter) formed on the target 103 by the electron beam. This is very disadvantageous for the field-emission electron source display apparatuses and the field-emission electron source imaging apparatuses in which there is a demand for a uniform image.

Also, in order to achieve a high-definition field-emission electron source display apparatus and a high-definition field-emission electron source imaging apparatus, the size of the cells on the field-emission electron source array has to be reduced sufficiently. In this case, the distance between the field-emission electron source array and the target 103 also has to be reduced sufficiently, and further, its error has to be controlled within about several tens of micrometers, for example. However, in the conventional field-emission electron source apparatuses, since the distance between the field-emission electron source array and the target 103 may have variations of about several hundred micrometers to several millimeters, it is difficult to achieve the high-definition field-emission electron source display apparatus and the high-definition field-emission electron source imaging apparatus.

Moreover, in the conventional field-emission electron source apparatuses, the front panel 101 is subjected to an outside pressure and warped when the vacuum container is evacuated. Since the target 103 is formed on the inner surface of the front panel 101, when the front panel 101 is warped, the distance from the field-emission electron source array differs between a central portion and a peripheral portion of the target 103. As a result, the diameter of the electron beam spot formed on the target 103 differs between the central portion and the peripheral portion of the target 103.

Consequently, a difference in quality of an image to be displayed arises between a center of a screen and a peripheral portion of the screen in the case where the field-emission electron source apparatus is used as the field-emission electron source display apparatus, and a difference in quality of an image to be captured arises between a center of a screen and a peripheral portion of the screen in the case where the field-emission electron source apparatus is used as the field-emission electron source imaging apparatus.

Unlike the apparatus shown in FIG. 26, vacuum apparatuses using a field-emission electron source array in which a shield grid electrode is provided between the field-emission electron source array and a target are illustrated in JP 9(1997)-270229 A and JP 2000-48743 A.

FIG. 27 is a sectional view showing a field-emission electron source apparatus used as a field-emission electron source imaging apparatus illustrated in JP 2000-48743 A.

A vacuum container 118 includes a light-transmitting front panel 115, a back panel 117 and a wall part 116 also serving as a spacer portion for holding a meshed shield grid electrode 120. The front panel 115, the back panel 117 and the wall part 116 are fixed firmly by a sealing material 133 made of frit glass and a sealing material 119 made of indium. The inside of the vacuum container 118 is maintained under vacuum.

An inner surface of the front panel 115 is provided with a photoelectric conversion target 114 including an anode electrode 113 transmitting incident light 111 from outside and a photoelectric conversion film 112 formed on the surface of the anode electrode 113.

An inner surface of the back panel 117 is provided with a field-emission electron source array 129 including cold cathode elements 124, a cathode conductor 125 for supplying an electric potential to the cold cathode elements 124, an insulating layer 126 formed on the cathode conductor 125 so as to surround the cold cathode elements 124 and gate electrodes 128 disposed on the insulating layer 126 so as to surround the cold cathode elements 124.

The shield grid electrode 120 is disposed between the photoelectric conversion target 114 and the field-emission electron source array 129. The shield grid electrode 120 is supplied with a voltage higher than that applied to the gate electrodes 128.

The shield grid electrode 120 includes a plurality of through holes **120*a*. The plurality of through holes 120*a* and the plurality of cold cathode elements 124 are in a one-to-one correspondence with each other, and the centers of the through holes 120*a* are located immediately above the respective tips of the cold cathode elements 124** for emitting electron beams.

From the tip of the cold cathode element 124, the electron beam is emitted with the divergence angle of about 30°. In this electron beam, only a partial electron beam that is emitted in a substantially upright direction passes through the through hole **120*a* of the shield grid electrode 120 corresponding to this cold cathode element 124 and reaches the photoelectric conversion target 114, and the rest of the electron beam that is emitted obliquely is absorbed by the shield grid electrode 120**.

JP 2000-48743 A mentions that the divergence of the electron beam reaching the photoelectric conversion target 114 can be reduced in this manner.

However, in order to allow only the partial electron beam that is emitted in the substantially upright direction in the electron beam emitted from the cold cathode element 124 to reach the photoelectric conversion target 114, the relative relationship among the size of the cold cathode elements 124, the distance between the adjacent cold cathode elements 124, the distance from the field-emission electron source array 129 to the shield grid electrode 120, the opening diameter of the through holes **120*a* of the shield grid electrode 120 and the thickness of the shield grid electrode 120** have to be designed strictly.

For example, when the size of the cold cathode elements 124 and the distance between the adjacent cold cathode elements 124 are reduced, it becomes necessary to reduce the distance between the adjacent through holes 120*a* of the shield grid electrode 120 as well. However, in this case, there is a possibility that the electron beam emitted from the tip of the cold cathode element 124 with the divergence angle of about 30° passes through not only the corresponding through hole 120*a* disposed immediately above this cold cathode element 124 but also other through holes 120*a* near this through hole 120*a* and reaches the photoelectric conversion target 114.

Further, in the case of increasing the distance from the field-emission electron source array 129 to the shield grid electrode 120, there also is a possibility that the electron beam emitted from the tip of the cold cathode element 124 with the divergence angle of about 30° passes through not only the corresponding through hole 120*a* disposed immediately above this cold cathode element 124 but also other through holes 120*a* near this through hole 120*a* and reaches the photoelectric conversion target 114.

Also, when the number of the cold cathode elements 124 is larger than the number of the through holes 120*a* of the shield grid electrode 120, the center of the through hole 120*a* is not located immediately above the tips of part of the plurality of cold cathode elements 124 formed in the field-emission electron source array 129. Thus, there is a possibility that the partial electron beam that is emitted in the substantially upright direction in the electron beam emitted from this cold cathode element 124 cannot pass through the through hole 120*a* and is absorbed by the shield grid electrode 120, and the partial electron beam that is emitted obliquely passes through the through holes 120*a* at positions other than immediately above this cold cathode element 124 and reaches the photoelectric conversion target 114.

As described above, unless the relative relationship of the dimensions of individual constituent members is designed strictly, it is not possible to reduce the divergence of the electron beam reaching the photoelectric conversion target 114. Consequently, there arises a problem that the size of an imaging pixel increases.

Further, in the case where an attempt is made to apply the field-emission electron source apparatus illustrated in FIG. 27 to a flat-type imaging apparatus for capturing an image of VGA (640 dots×480 dots, horizontally by vertically), the following problems may arise.

In the flat-type imaging apparatus for VGA, 640 dots of pixels and 480 dots of pixels are arranged horizontally and vertically, and the total number of pixels is about 310,000 dots. Assuming that 100 cold cathode elements 124 are arranged in one pixel (dot), the total number of the cold cathode elements 124 is about 31,000,000, which is huge. In the case of a 1-inch (2.54-cm)-diagonal (outer size) flat imaging apparatus, the horizontal size of the field-emission electron source array is 1.275 cm, and the vertical size of the field-emission electron source array is 0.956 cm, so that the size of a single dot is 0.02 mm (=20 μm). For arranging 100 cold cathode elements 124 like lattice points in this single dot, 10 cold cathode elements 124 have to be arranged in one direction. In order to form the through holes 120*a* in the shield grid electrode 120 so as to achieve a one-to-one correspondence with the cold cathode elements 124, the through holes 120*a* have to have an inner diameter of not greater than 2 μm.

In this case, it is considered possible to form the through holes 120*a* having an inner diameter of not greater than 2 μm by setting the shield grid electrode 120 to have a thickness of not greater than 1 μm. However, if the thickness of the shield grid electrode 120 is not greater than 1 μm, the shield grid electrode 120 is very likely to have problems of insufficient strength and warping. On the other hand, if the thickness is set to be greater than 1 μm, it is considered impossible to form the through holes 120*a* having an inner diameter of not greater than 2 μm in a sheet of metal such as nickel, copper or aluminum, which is described as the material for the shield grid electrode 120 in JP 2000-48743 A. Overall, it is considered nearly impossible to form the through holes 120*a* that are in a one-to-one correspondence with the cold cathode elements 124 in the shield grid electrode 120.

Even if the through holes 120*a* having an inner diameter of not greater than 2 μm could be formed and the problems of insufficient strength and warping could be solved, there would be a further problem that the field-emission electron source array 129 and the shield grid electrode 120 need to be aligned in a highly accurate manner.

In other words, in order to arrange the centers of the through holes 120*a* immediately above the tips of the cold cathode elements 124 without any displacement, the relative positional relationship between the field-emission electron source array 129 and the shield grid electrode 120 has to be controlled at an accuracy within 0.1 μm. However, the general assembling accuracy at present has a limit of about 1 μm. In view of this, it also is considered difficult to achieve a flat-type imaging apparatus using the field-emission electron source apparatus illustrated in FIG. 27.

Also, in the case where the single cold cathode element 124 is made to correspond to a single pixel as shown in FIG. 27, it is necessary to supply an amount of electric current necessary to operate the single pixel from the single cold cathode element 124. However, in view of the fact that current emission characteristics of the field-emission cold cathode element are on the order of nanoampares, it is considered difficult to achieve a field-emission electron source apparatus in which only a single cold cathode element 124 is arranged in a single pixel.

Conversely, when a plurality of cold cathode elements 124 are made to correspond to a single pixel and a single through hole 120*a* of the shield grid electrode 120 is made to correspond to the single pixel, the tips of the cold cathode elements 124 corresponding to this through hole 120*a* are located at positions other than that immediately below the center of the through hole 120*a*. Therefore, as described above, there is a possibility that the partial electron beam that is emitted in the substantially upright direction in the electron beam emitted from this cold cathode element 124 cannot pass through the through hole 120*a* and is absorbed by the shield grid electrode 120, and the partial electron beam that is emitted obliquely passes through the through holes 120*a* constituting the adjacent pixels and reaches the photoelectric conversion target 114. Accordingly, in this case, it also is considered difficult to achieve a field-emission electron source apparatus. In other words, with the field-emission electron source apparatus shown in FIG. 27, it is very difficult to allow the electron beam from the cold cathode element 124 to pass through only the through hole 120*a* arranged immediately above this cold cathode element 124 and reach the photoelectric conversion target 114 in an efficient manner.

Furthermore, the field-emission electron source apparatus illustrated in FIG. 27 has another problem described below.

As illustrated in FIG. 27, the insulating back panel 117 provided with the field-emission electron source array 129 and the front panel 115 provided with the photoelectric conversion target 114 opposed to this field-emission electron source array 129 are joined to each other with the wall part 116 interposed between their outer peripheral portions, such that the inside of the vacuum container 118 is maintained under high vacuum.

At this time, by providing frit glass having a low melting point serving as the sealing material 133 between the back panel 117 and the wall part 116 and burning it at about 400° C., the back panel 117 and the wall part 116 are attached to each other, so that the inside of the vacuum container is maintained airtight. Also, when the shield grid electrode 120 is positioned and fixed onto a step portion 121 of the wall part 116, frit glass having a low melting point is used. Therefore, the distance between the field-emission electron source array 129 and the shield grid electrode 120 depends on the thickness of the low-melting frit glass between the back panel 117 and the wall part 116 and that of the low-melting frit glass between the step portion 121 of the wall part 116 and the shield grid electrode 120.

Accordingly, variations are generated in the degree of parallelity and the distance between the field-emission electron source array 129 and the shield grid electrode 120.

As a result, the degree of divergence of the electron beam on the photoelectric conversion target 114 (focusing characteristics) varies for every field-emission electron source apparatus, or the degree of divergence of the electron beam varies depending on the position on the photoelectric conversion target 114 even within a single field-emission electron source apparatus. Thus, in the case where the field-emission electron source apparatus is used as a field-emission electron source imaging apparatus, a captured image varies for every apparatus, and partial variations occur in a captured image.

Moreover, the field-emission electron source apparatus illustrated in FIG. 27 has another problem described below.

The shield grid electrode 120 disposed between the field-emission electron source array 129 and the photoelectric conversion target 114 is like a thin film and produced, for example, by fixing a thin film copper mesh to a metallic holding frame under a tension or by forming a film of a metal such as Ni, Cr, Cu, Ag or Co or an alloy thereof on a surface of an insulating material such as glass or ceramics provided with a large number of through holes by vapor deposition, sputtering, chemical plating or the like.

However, the shield grid electrode 120 produced by fixing a thin film copper mesh to a metallic holding frame under a tension is likely cause variations in a tension distribution. For example, when the tension differs between a central portion and a peripheral portion of the copper mesh, the shape of the through holes 120*a* and the distance between the adjacent through holes 120*a* differ between the central portion and the peripheral portion of the copper mesh. In such cases, it becomes difficult to arrange the centers of the through holes 120*a* immediately above the respective tips of all the cold cathode elements 124 in the field-emission electron source array 129. In other words, the relative positions of the tips of the cold cathode elements 124 and the centers of the through holes 120*a* are displaced partly, thus causing the amount of the electron beam reaching the photoelectric conversion target 114 to differ between the central portion and the peripheral portion of the photoelectric conversion target 114 or to vary locally. Therefore, variations occur in a brightness distribution in the case where the field-emission electron source apparatus is used as a field-emission electron source display apparatus, and a captured image becomes nonuniform in the case where it is used as a field-emission electron source imaging apparatus.

Further, in the shield grid electrode 120 produced by forming a film of a metal or an alloy on a glass surface provided with a large number of through holes, the glass itself has adsorbed much gas. Even if the above-noted metal film is formed on the glass surface, gas is emitted easily due to the impact of an electron beam while driving the field-emission electron source apparatus.

Also, when a thinner glass sheet is prepared and provided with a large number of minute through holes 120*a*, there arises a problem that the mechanical strength of the glass deteriorates remarkably, so that the glass sheet becomes easy to crack. In particular, for allowing a large amount of the electron beam to reach the photoelectric conversion target 114, the distance between the adjacent through holes 120*a* has to be reduced, resulting in a still lower mechanical strength.

Moreover, in the shield grid electrode 120 produced by forming a film of a metal or an alloy on a ceramic surface provided with a large number of through holes, there are problems that the ceramic needs a burning process, the distance between the adjacent through holes 120*a* is difficult to reduce, the mechanical strength is insufficient similarly to the case of using glass, etc.

Although the shield grid electrode provided in the field-emission electron source apparatus has been discussed in the above description, mesh structures having a plurality of through holes represented by such a shield grid electrode also are used for various applications other than the above-described field-emission electron source apparatus. For example, by making the thickness of the mesh structure sufficiently larger than the diameter of the through holes, the mesh structure can be used as a collimator that allows atoms, molecules, light or the like to pass from one surface to the other surface, thus providing their traveling direction with directivity; or by adjusting the diameter of the through holes in the mesh structure, the mesh structure can be used as a particle filter for screening particles by particle diameter.

Similarly to the above, the mesh structures used in such applications often are produced by forming through holes in a base material such as metal, glass or ceramics. However, the use of such a base material leads to the following problems.

That is, in the case of using metal as the material for the mesh structure, holes have to be drilled deeply in the metal structure. However, it is difficult to use a current hole processing technique using a die or the like, and a small diameter of the through hole cannot be achieved by that technique.

Also, in the case of using glass as the material for the mesh structure, hole processing is difficult, and there are concern about gas emission in a vacuum and the problem of insufficient mechanical strength, similarly to the above.

Further, in the case of using ceramics as the material for the mesh structure, the following problem occurs. That is, in order to secure the mechanical strength, it is difficult to reduce the intervals between the through holes. Also, since a large number of the through holes cannot be formed, the amount of atoms, molecules or light on an exit side becomes considerably lower than that on an incident side when the mesh structure is used as a collimator. Additionally, ceramics generally develop dimensional variations due to burning and thus make it difficult to control the through hole dimensions in a highly accurate manner. Therefore, the ceramics are not suitable for filters whose through hole diameter has to be determined in a highly accurate manner with respect to the size of particles.

SUMMARY OF THE INVENTION

It is an object of the present invention to solve the above-described conventional problems.

In other words, it is an object of the present invention to provide a mesh structure that has a mechanical strength, emits less gas even in a vacuum and can be provided with through holes with an excellent dimensional accuracy.

Also, it is a further object of the present invention to provide a high-performance field-emission electron source apparatus that suppresses a decrease in the amount of an electron beam reaching a target while securing a mechanical strength of an electrode provided with a large number of through holes disposed between a field-emission electron source array and the target, and suppresses expansion of the electron beam on the target.

A mesh structure according to the present invention has a plurality of through holes that are formed one-dimensionally. Light, electrons, atoms, ions or molecules can be passed through the through holes from one surface to the other surface. The mesh structure is formed of a silicon-containing material, and the silicon-containing material contains silicon having a crystal structure.

Further, a field-emission electron source apparatus according to the present invention includes a field-emission electron source array, a target for performing a predetermined operation using an electron beam emitted from the field-emission electron source array, and a mesh structure that is disposed between the field-emission electron source array and the target and provided with a plurality of through holes through which the electron beam emitted from the field-emission electron source array passes.

Each of the plurality of through holes has an opening on a side of the field-emission electron source array and an electron beam passageway that continues from the opening.

The mesh structure is formed of a silicon-containing material doped with a N-type or P-type material.

DETAILED DESCRIPTION OF THE INVENTION

Figure 1:
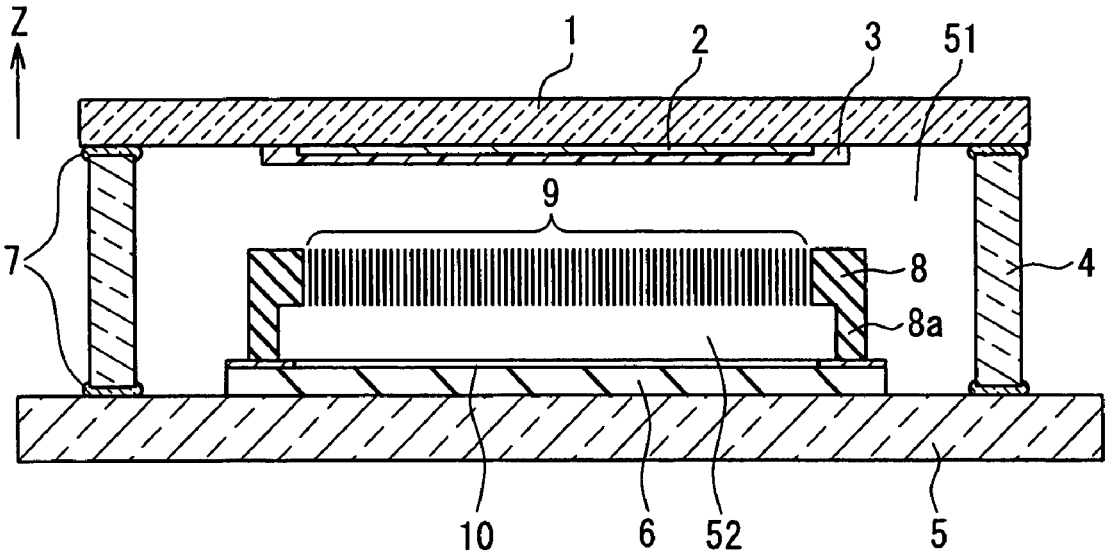
FIG. 1 is a sectional view showing a mesh structure and a field-emission electron source apparatus including the mesh structure according to Embodiment 1 of the present invention.

In accordance with the present invention, it is possible to provide a mesh structure that has mechanical strength, emits less gas even in a vacuum and can be provided with through holes with an excellent dimensional accuracy.

Also, in accordance with the present invention, it is possible to provide a high-performance field-emission electron source apparatus that suppresses a decrease in the amount of an electron beam reaching a target while securing a mechanical strength of an electrode provided with a large number of through holes disposed between a field-emission electron source array and the target, and suppresses expansion of the electron beam on the target.

A mesh structure according to a first preferable mode of the present invention has a plurality of through holes that are formed one-dimensionally. Light, electrons, atoms, ions or molecules can be passed through the through holes from one surface to the other surface. The mesh structure is formed of a silicon-containing material, and the silicon-containing material contains silicon having a crystal structure.

In the first preferable mode described above, since the mesh structure is formed of the silicon-containing material and the silicon-containing material contains silicon having a crystal structure, it becomes possible to process the through holes using a fine processing technology for semiconductors. Accordingly, the shape and diameter of the through holes in the mesh structure can be controlled in a highly accurate manner. Thus, for example, a function of filtering particles with the through holes can be achieved easily.

Also, using the fine processing technology of semiconductors, the mesh structure can be provided with through holes whose depth is larger than their diameter easily. Therefore, it is possible to produce a mesh structure having a filter function of screening particles and a mesh structure having a collimator function of providing the traveling direction of atoms, molecules, light or the like with directivity at a low cost.

Furthermore, since a high-purity silicon plate used for semiconductors can be used, it is possible to achieve a mesh structure having a collimator function of providing atoms, molecules, electrons or the like with directivity easily without any concern about gas emission in a vacuum.

In a mesh structure according to a second preferable mode of the present invention, in the above-described first preferable mode, a thickness of a partition wall for separating the plurality of through holes is smaller than an opening diameter of the through holes.

According to the second preferable mode described above, the areal ratio of openings (opening ratio) of the through holes with respect to the surface of the mesh structure can be raised. Therefore, in the case where the mesh structure is used as the collimator for providing atoms, molecules, electrons, light or the like with directivity, it is possible to provide a collimator achieving a large ratio of the amount of atoms, molecules, electrons, light or the like on the exit side with respect to the amount thereof on the incident side (passage ratio).

A field-emission electron source apparatus according to a third preferable mode of the present invention includes a field-emission electron source array, a target for performing a predetermined operation using an electron beam emitted from the field-emission electron source array, and a mesh structure that is disposed between the field-emission electron source array and the target and provided with a plurality of through holes through which the electron beam emitted from the field-emission electron source array passes. Each of the plurality of through holes has an opening on a side of the field-emission electron source array and an electron beam passageway that continues from the opening. The mesh structure is formed of a silicon-containing material doped with a N-type or P-type material.

According to the third preferable mode described above, it becomes possible to produce the mesh structure using a silicon substrate by an MEMS (micro electro mechanical system) technique, which is a semiconductor technology. This enables deep drilling with a high aspect ratio and a highly-accurate fine processing, which are required at the time of producing a mesh structure.

For example, assuming a 1-inch-diagonal (outer size) field-emission electron source imaging apparatus for capturing a VGA (640 dots×480 dots, horizontally by vertically), one cell has a size of about 20 μm per side. In the case of a field-emission electron source apparatus whose single cell is constituted by a large number of (for example, 100) cold cathode elements (emitters), the opening diameter of the through hole in the mesh structure is about 16 μm, for example, so that the production of the mesh structure requires accuracy on the order of sub-micrometers. Also, the assembly of the mesh structure and the field-emission electron source array needs to be highly accurate. Thus, the use of micro-fine processing technology of semiconductors allows the mesh structure to be formed in a highly accurate manner and the mesh structure and the field-emission electron source array to be assembled in a highly accurate manner, so that a field-emission electron source apparatus having excellent quality can be provided.

Further, for ensuring reliability such as accuracy, it is preferable that the field-emission electron source array partially or entirely is produced on a silicon substrate using the semiconductor technology. Such a system also is advantageous in terms of cost because the above-noted semiconductor technology is common now and equipment for performing it is readily available in the market.

Thus, since the mesh structure is formed using the silicon substrate, a coefficient of thermal expansion of the mesh structure and that of the substrate on which the field-emission electron source array is formed can be made substantially the same, which is advantageous in terms of thermal expansion. In other words, it is possible to prevent breakage of the field-emission electron source apparatus due to thermal expansion. Also, the temperature of burning such as baking for degassing when assembling the field-emission electron source apparatus can be raised, thereby improving the reliability of the resultant apparatus.

In a field-emission electron source apparatus according to a fourth preferable mode of the present invention, in the above-described third preferable mode, the mesh structure includes a silicon layer doped with a N-type or P-type material and an insulating layer formed of $SiO_2$.

In general, a silicon substrate used in the semiconductor technology often is a substrate made of pure silicon or an SOI (Silicon On Insulator) substrate obtained by sandwiching an $SiO_2$ layer, which is an insulating layer, between silicon substrates. Since the SOI substrate, which is used commonly worldwide, is available at a relatively low cost, the fourth preferable mode can provide a low-cost field-emission electron source apparatus.

In a field-emission electron source apparatus according to a fifth preferable mode of the present invention, in the above-described third preferable mode, at least one of a surface of the mesh structure on the side of the field-emission electron source array and a surface of the mesh structure on a side of the target is provided with an electrically conductive thin film.

Preferred materials for the electrically conductive thin film include aluminum, gold, copper, tantalum, molybdenum, titanium, etc. It is preferable to form the thin film of such an electrically conductive material by a technique such as sputtering, vacuum deposition or CVD used in a semiconductor production process in that the equipment used therefor is available at a low cost due to the development of the semiconductor technology and the film forming technology already is mature and established.

In a field-emission electron source apparatus according to a sixth preferable mode of the present invention, in the above-described third preferable mode, the mesh structure includes a base layer that constitutes a major part of the mesh structure and a thin film layer that is formed on a surface of the base layer and has a lower resistance than the base layer. Here, the "base layer constituting 'a major part' of the mesh structure" means that the thickness ratio of the base layer in a region provided with a plurality of through holes in the mesh structure (a trimming portion 9, which will be described later) is equal to or greater than 90%.

According to the sixth preferable mode described above, it is possible to lower the resistance of a surface portion of the mesh structure formed of a N-type or P-type high-resistance silicon. This provides a field-emission electron source apparatus in which potential variations do not occur easily due to a local impact of an electron beam.

In a field-emission electron source apparatus according to a seventh preferable mode of the present invention, in the above-described third preferable mode, the mesh structure includes at least two electrode layers and at least one intermediate layer disposed between the at least two electrode layers.

According to the seventh preferable mode described above, it is possible to set the electric potentials of the at least two electrode layers freely and independently of each other, for example, to make them different or equal. Since this improves the flexibility of the electric potentials and structures of the electrode layers, it easily becomes possible to adjust the function of absorbing and removing an electron beam in the mesh structure, exert a focusing effect on an electron beam or adjust this focusing effect.

By using the mesh structure with such functions, the size of the electron beam spot on the target is reduced, for example, thus providing a high-resolution field-emission electron source display apparatus and a high-resolution field-emission electron source imaging apparatus. Further, by leading the electron beam from the field-emission electron source array to the target while suppressing its divergence, a field-emission electron source apparatus with fewer production variations can be provided.

In a field-emission electron source apparatus according to an eighth preferable mode of the present invention, in the above-described seventh preferable mode, the at least one intermediate layer is an insulating layer, and the at least two electrode layers form at least two potential spaces in the electron beam passageway.

According to the eighth preferable mode described above, by applying different electric potentials to the at least two electrode layers, it becomes possible to exert a desired focusing effect on the electron beam that has entered the mesh structure or control freely the trimming effect by which the mesh structure absorbs and removes the electron beam, so that the electron beam from the field-emission electron source array can be led to the target effectively.

In a field-emission electron source apparatus according to a ninth preferable mode of the present invention, in the above-described seventh preferable mode, one of the at least two electrode layers is a first electrode layer that is disposed on the side of the field-emission electron source array with respect to the at least one intermediate layer and supplied with a first voltage, and the other is a second electrode layer that is disposed on a side of the target with respect to the at least one intermediate layer and supplied with a second voltage. The at least one intermediate layer is a high resistance layer that has a higher resistance than the first electrode layer and the second electrode layer.

According to the ninth preferable mode described above, not only can the function and effect of the seventh preferable mode be provided, but also the production of the mesh structure becomes easier.

As the mesh structure including the at least two electrode layers, the use of an SOI substrate obtained by forming a $SiO_2$ layer as the insulating layer on a silicon substrate, for example, is conceivable. However, the SOI substrate has the following problems because it includes layers formed of different materials, namely, the silicon layer and the insulating layer. For example, when an attempt is made to form through holes in the SOI substrate by etching, the etching is easy in the silicon layer but is difficult in the insulating layer. Also, local stress concentration occurs near the border between the silicon layer and the insulating layer, so that the substrate cracks during the etching.

In contrast, the mesh structure according to the ninth preferable mode can be produced easily by, for example, forming the through holes in a high-resistance silicon substrate by etching, followed by doping its both surfaces with N-type or P-type materials so that the both surface layers have a low resistance. Alternatively, the mesh structure may be produced by doping both surfaces of a high-resistance silicon substrate with N-type or P-type materials to provide them with low resistance surface layers, and then forming the through holes by etching in the silicon substrate whose intermediate layer still has a high resistance.

Alternatively, it also may be possible to form the through holes in the high-resistance substrate by etching and then form a low-resistance film of metal or the like on the both surfaces of the high-resistance substrate by electrolytic etching or the like.

As described above, the mesh structure according to the ninth preferable mode is easy to produce. In addition, since an electron beam from the field-emission electron source array can be made to impact on and be absorbed and removed by a lateral wall of an electrode layer portion, which has a low resistance, in the electron beam passageway, setting the electric potentials of the at least two electrode layers freely and independently of each other brings about an effect similar to that in the seventh preferable mode described above.

In a field-emission electron source apparatus according to a tenth preferable mode of the present invention, in the above-described seventh preferable mode, $V1>V2$ is satisfied, where V1 indicates a voltage to be applied to a first electrode layer in the at least two electrode layers that is disposed on the side of the field-emission electron source array with respect to the at least one intermediate layer, and V2 indicates a voltage to be applied to a second electrode layer in the at least two electrode layers that is disposed on a side of the target with respect to the at least one intermediate layer.

According to the tenth preferable mode described above, the electron beam emitted from the field-emission electron source array is accelerated by the relatively high voltage V1 applied to the first electrode on the side of the field-emission electron source array and enters the through hole in the mesh structure, and then is decelerated by the relatively low voltage V2 applied to the second electrode while passing through the electron beam passageway.

For example, for an electron beam emitted from a selected cell in the field-emission electron source array, a partial electron beam that has entered through holes other than a through hole located immediately above the selected cell has a velocity vector, which represents its traveling direction, with a direction different from the direction in which the electron beam passageway extends, and thus mostly impacts on and is absorbed and removed by lateral walls of the electron beam passageways. Moreover, since the partial electron beam is decelerated as it travels in the electron beam passageways from the first electrode side to the second electrode side, it is more likely to impact on the lateral walls of the electron beam passageways.

Also, for an electron beam emitted from a selected cell in the field-emission electron source array, a partial electron beam that has entered the through hole located immediately above the selected cell and has a velocity vector, which represents its traveling direction, with a divergent direction different from the direction in which the electron beam passageway extends, impacts on and is absorbed and removed by a lateral wall of the electron beam passageway. Moreover, since the partial electron beam is decelerated as it travels in the electron beam passageways from the first electrode side to the second electrode side, such an electron beam having a velocity vector with a divergent direction is more likely to impact on the lateral walls of the electron beam passageways.

With such a trimming effect of the mesh structure, only a partial electron beam that is emitted from the selected cell in a substantially vertical direction passes through the mesh structure, travels in the substantially vertical direction from the mesh structure and reaches the target.

Thus, even if the distance from the field-emission electron source array to the mesh structure and the distance from the mesh structure to the target vary more or less from designed values, the landing area of the electron beam on the target (the spot diameter) hardly varies.

In other words, in the case of using frit glass or indium for joining the back panel and the wall part and joining the wall part and the front panel, it is difficult to control the distance between the back panel and the front panel in a highly accurate manner as described above. In accordance with the tenth preferable mode of the present invention, even when the distance between the back panel and the front panel differs from the designed value due to assembly variations, the variation in the diameter of the electron beam spot on the target can be suppressed.

Also, a vacuum is produced inside a vacuum container constituted by the back panel, the wall part and the front panel, whereby the front panel is pressed by atmospheric pressure and distorted in a curved shape. As a result, the distance between the back panel and the front panel differs between a central portion and a peripheral portion. In accordance with the tenth preferable mode of the present invention, even in this case, it is possible to suppress the difference in the diameter of the electron beam spot on the target between the central portion and the peripheral portion.

Therefore, the tenth preferable mode of the present invention makes it possible to provide a field-emission electron source display apparatus capable of displaying a uniform quality image and a field-emission electron source imaging apparatus capable of capturing a uniform quality image.

Moreover, in accordance with the tenth preferable mode of the present invention, the mesh structure can be made thinner than that in the third preferable mode.

That is to say, for the electron beam that has entered the through hole in the mesh structure, the partial electron beam that has a velocity vector, which represents its traveling direction, with a direction different from the direction in which the electron beam passageway extends, is decelerated as it travels in the electron beam passageways from the first electrode side to the second electrode side, and thus it is more likely to impact on the lateral walls of the electron beam passageways compared with the case where it is not decelerated. In other words, the distance along which such an electron beam travels after it enters the electron beam passageways until it impacts on the lateral walls of the electron beam passageways becomes shorter than that in case where the electron beam is not decelerated. Therefore, a desired trimming effect can be achieved even if the mesh structure is made thinner.

When the mesh structure is made thinner, it is possible to reduce the percentage of the partial electron beam absorbed and removed by the mesh structure in the electron beam that has entered the through hole located immediately above the selected cell. This increases the amount of the electron beam reaching the target. Consequently, it is possible to increase brightness in a field-emission electron source display apparatus in which the target is provided with a phosphor, and to secure a sufficient amount of the electron beam reaching the target and thus reduce persistent images in a field-emission electron source imaging apparatus in which the target is provided with a photoelectric conversion film.

In the case of the field-emission electron source imaging apparatus, the following effect can be achieved in addition to the above.

In the field-emission electron source imaging apparatus, during operation, the electron beam reaches the target and the positive holes are read out, whereby the electric potential of the photoelectric conversion film provided in the target drops to an electric potential substantially equal to that of a cold cathode element in the field-emission electron source array. However, in accordance with the tenth preferable mode, the difference between the electric potential V2 of the target-side second electrode layer in the mesh structure and the electric potential of the target can be set to be small, so that the difference in the electric potential between a target-side electron beam exit portion in the mesh structure and the target decreases. Thus, the electron beam after leaving the mesh structure is not decelerated or accelerated extremely, and a strong electrostatic lens is not formed near the electron beam exit portion. Accordingly, the path of the electron beam after leaving the mesh structure hardly varies. Consequently, the electron beam that has passed through the electron beam passageway in the mesh structure without being absorbed or removed also travels in the vertical direction after leaving the mesh structure and reaches the target.

Thus, even when the distance between the back panel and the front panel is different from the designed value due to assembly variations, the variation in the diameter of the electron beam spot on the target can be suppressed, making it possible to provide a field-emission electron source imaging apparatus capable of capturing a uniform quality image.

In a field-emission electron source apparatus according to an eleventh preferable mode of the present invention, in the above-described seventh preferable mode, $T1 \ll T2$ is satisfied, where a first electrode layer is an electrode layer in the at least two electrode layers that is disposed on the side of the field-emission electron source array with respect to the at least one intermediate layer, a second electrode layer is an electrode layer in the at least two electrode layers that is disposed on a side of the target with respect to the at least one intermediate layer, T1 indicates a length of the first electrode layer in a length of the electron beam passageway, and T2 indicates a length of the second electrode layer in the length of the electron beam passageway.

According to the eleventh preferable mode described above, a voltage gradient formed by the voltage V1 applied to the first electrode layer and the voltage V2 applied to the second electrode layer can be made closer to the field-emission electron source array, and a region of the second electrode in the electron beam passageway can be increased. The voltage gradient is made closer to the field-emission electron source array, whereby a decelerating region in the electron beam passageway becomes closer to the side of the field-emission electron source array. Also, the region of the second electrode enlarges, whereby a range that absorbs and removes the electron beam expands. Thus, in the electron beam that has entered the through hole in the mesh structure, the partial electron beam that has a velocity vector, which represents its traveling direction, with a direction different from the direction in which the electron beam passageway extends, is decelerated at a relatively early stage and impacts on and is absorbed and removed by the lateral walls of the electron beam passageways. Therefore, it is possible to trim the electron beam efficiently.

Accordingly, the electron beam that has left the mesh structure can be made to travel along the vertical direction. Thus, even when the distance between the back panel and the front panel is different from the designed value due to assembly variations and where the front panel is pressed by an atmospheric pressure and distorted in a curved shape, the variation in the diameter of the electron beam spot on the target can be suppressed further.

Therefore, the eleventh preferable mode of the present invention makes it possible to provide a field-emission electron source display apparatus capable of displaying a more uniform quality image and a field-emission electron source imaging apparatus capable of capturing a more uniform quality image.

In a field-emission electron source apparatus according to a twelfth preferable mode of the present invention, in the above-described third preferable mode, a substrate on which the field-emission electron source array is formed is provided further. The mesh structure has a spacer portion that is formed as one piece with the mesh structure and spaces out the field-emission electron source array and the openings of the plurality of through holes from each other. The mesh structure is provided on the substrate via the spacer portion.

Figure 27:
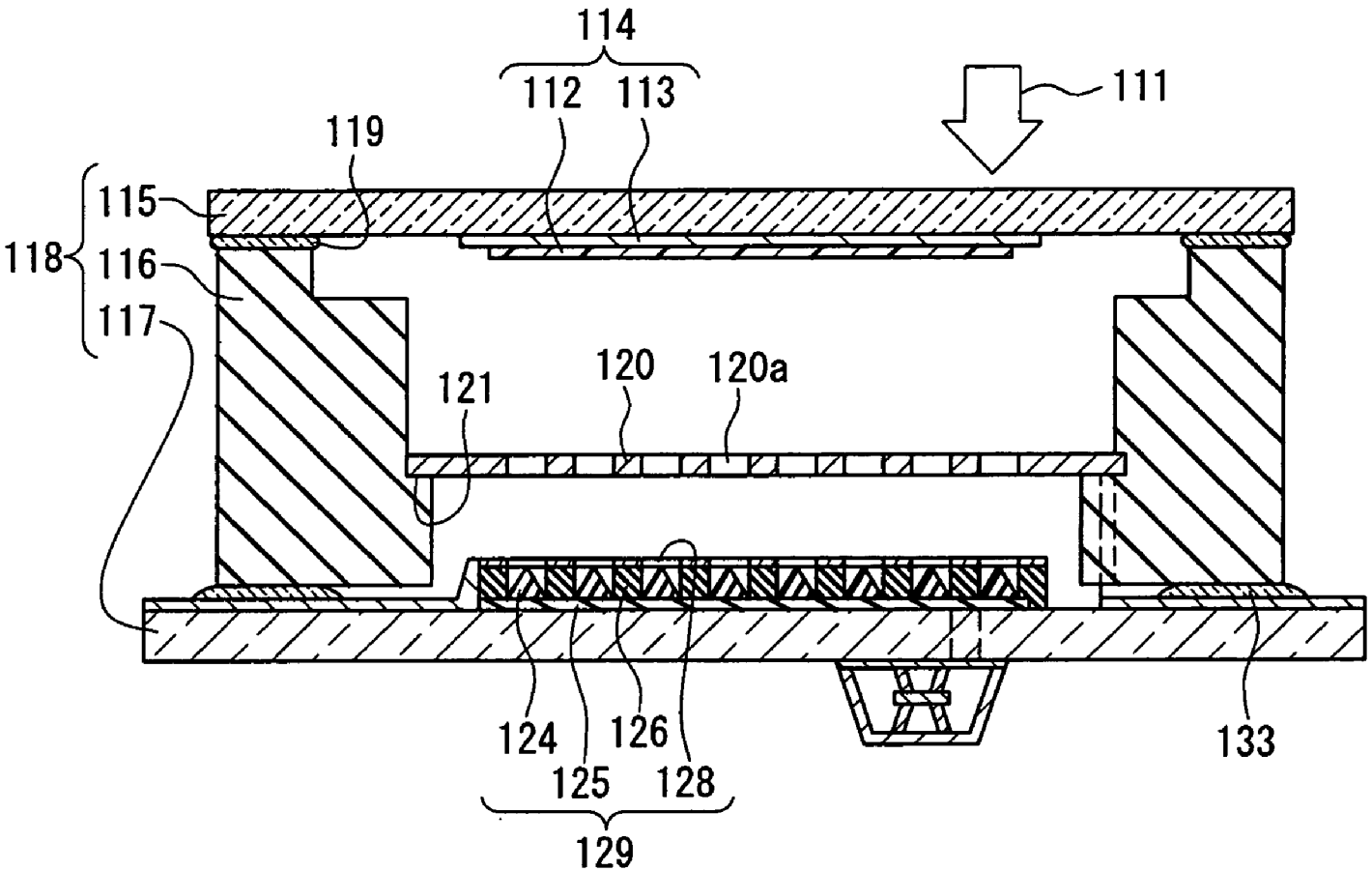
FIG. 27 PRIOR ART
FIG. 27 is a sectional view showing another conventional field-emission electron source apparatus using a field-emission electron source array.

According to the twelfth preferable mode described above, the distance between the field-emission electron source array and the opening in the mesh structure on the side of the field-emission electron source array can be made to have less variation and set in a highly accurate manner. For example, in the conventional field-emission electron source apparatus illustrated in FIG. 27, the distance between the field-emission electron source array 129 and the shield grid electrode 120 varies due to three variations, i.e., attachment accuracy between the back panel 117 on which the field-emission electron source array 129 is formed and the wall part 116 (namely, thickness variations in the low-melting frit glass 133), attachment accuracy between the step portion 121 of the wall part 116 and the shield grid electrode 120 (namely, thickness variations in the low-melting frit glass) and production accuracy of the dimension from the lower surface of the wall part 116 attached to the back panel 117 to the step portion 121 (namely, dimensional variations).

On the other hand, in the twelfth preferable mode of the present invention, since the mesh structure has a spacer portion that is formed as one piece with the mesh structure, the distance between the field-emission electron source array and the opening of the mesh structure on the side of the field-emission electron source array varies due to two variations, i.e., attachment accuracy between the field-emission electron source array and the spacer portion and production accuracy of the thickness of the spacer portion (namely, dimensional variations). In other words, the portion attached by the low-melting frit glass, which involves the poorest accuracy, is not present. Therefore, the accuracy in the distance between the field-emission electron source array and the opening of the mesh structure on the side of the field-emission electron source array improves.

Also, in accordance with the twelfth preferable mode of the present invention, the mechanical strength of the mesh structure improves.

In other words, assuming a 1-inch-diagonal (outer size) field-emission electron source imaging apparatus for capturing a VGA (640 dots×480 dots, horizontally by vertically), for example, one pixel has a size of about 0.02 mm as described above. In view of the function of the mesh structure, it is considered appropriate that the thickness of the mesh structure should be about 1 to 10 times the size of one pixel and therefore about 0.02 to 0.2 mm. The dimension of the mesh structure is slightly larger than 12 mm×10 mm as described above. Considering the fact that this mesh structure is provided with a large number of through holes, the mesh structure has a very low mechanical strength. Thus, it is very difficult to handle the mesh structure itself in a process of assembling a field-emission electron source apparatus due to its insufficient mechanical strength.

However, in the twelfth preferable mode of the present invention, the mesh structure has the frame-like spacer portion that is formed as one piece with and on the periphery of the mesh structure. Accordingly, since the spacer portion improves the mechanical strength of the mesh structure, this solves the problem of the mesh structure itself being difficult to handle in the process of assembling a field-emission electron source apparatus.

In a field-emission electron source apparatus according to a thirteenth preferable mode of the present invention, in the above-described twelfth preferable mode, the spacer portion and the substrate are joined using an electrically conductive material, and a voltage is supplied to at least part of the mesh structure from the substrate via the electrically conductive material.

According to the thirteenth preferable mode described above, it becomes possible to supply a voltage to the mesh structure from the substrate on which the field-emission electron source array is formed, thus eliminating the need for wire bonding for supplying the voltage. Thus, the cost for wire bonding can be saved, and failures such as fallen wires can be avoided in the case of wire bonding.

In a field-emission electron source apparatus according to a fourteenth preferable mode of the present invention, in the above-described seventh preferable mode, when V1 indicates a voltage to be applied to a first electrode layer in the at least two electrode layers that is disposed on the side of the field-emission electron source array with respect to the at least one intermediate layer and V2 indicates a voltage to be applied to a second electrode layer in the at least two electrode layers that is disposed on a side of the target with respect to the at least one intermediate layer, an amount of an electron beam that passes through the plurality of through holes in the mesh structure and travels toward the target is varied by changing one or both of the voltage V1 and the voltage V2 while driving the field-emission electron source apparatus.

According to the fourteenth preferable mode described above, an effective imaging operation can be carried out, especially in a field-emission electron source imaging apparatus in which the target is provided with a photoelectric conversion film.

In other words, in the field-emission electron source imaging apparatus in which the target is provided with a photoelectric conversion film, the amount of electron-hole pairs generated by an image formed by light incident on the target is determined by the intensity of the incident light. More electron-hole pairs are generated with an increase in the intensity of the incident light. In the generated electron-hole pairs, the positive holes are transported (transported while being multiplied in the case of an avalanche-multiplier-type photoelectric conversion film using selenium) to an electronic scanning surface, which is a surface of the target on the side of the field-emission electron source array, and then accumulated therein.

When the target is scanned by an electron beam emitted from the field-emission electron source array, the accumulated positive holes combine with electrons contained in the electron beam, and at the same time, an electric signal is read out. Here, if sufficient electrons do not reach the target, part of the positive holes accumulated in the electronic scanning surface of the target are not read out and remain until the next scanning.

Accordingly, the positive holes that are not read out and remain in the readout scanning of the first frame are read out by electrons that arrive at the time of the readout scanning of the second frame, so that portions with intense incident light remain as persistent images in the captured image.

In order to solve this problem, it is necessary to allow a sufficient amount of the electron beam to reach the target and remove the positive holes that are not read out and remain after the readout scanning of the first frame, thus preparing for the readout scanning of the next frame. In the following description of the present specification, this action will be referred to as "charge resetting."

However, when an electrode having a function of removing part of electrons such as the mesh structure is disposed between the field-emission electron source array and the target, there is a possibility that even the charge resetting period cannot provide a sufficient amount of electron beam to the target.

In the fourteenth preferable mode of the present invention, the amount of the electron beam that passes through the plurality of through holes in the mesh structure and travels toward the target is varied by changing one or both of the voltage V1 to be applied to the first electrode layer and the voltage V2 to be applied to the second electrode layer while driving the field-emission electron source apparatus (more specifically, during the charge resetting period). This increases the amount of the electron beam reaching the target during the charge resetting period, thereby securing a sufficient charge resetting electric current. In this way, it is possible to provide a field-emission electron source imaging apparatus with fewer persistent images.

In a field-emission electron source apparatus according to a fifteenth preferable mode of the present invention, in the above-described third preferable mode, a cross-sectional shape of the electron beam passageway along a direction perpendicular to a direction in which the electron beam passageway extends is a circle, an ellipse, a polygon with all interior angles being larger than 90° or a polygon whose adjacent sides are connected by a circular arc.

According to the fifteenth preferable mode described above, the mesh structure can be produced easily.

For example, in the case where an edge shape of the opening is a rectangle (or a square) with all interior angles being 90°, it is likely that stress concentrates in four-corner portions of the edge of the opening, resulting in a problem that the mesh structure cracks at these four-corner portions at the time of forming the through hole.

In the case where the edge shape of the opening is a circle, an ellipse, a polygon having at least five points with all interior angles being larger than 90° or a polygon whose adjacent sides are connected by a circular arc as in the fifteenth preferable mode, the stress concentration is alleviated, so that the mesh structure does not crack at the time of forming the through hole, thus allowing easy production.

The easy production of the mesh structure means that the production yield of the mesh structure improves, making it possible to provide a low-cost mesh structure. Consequently, a low-cost field-emission electron source apparatus can be provided.

Also, the improvement in the mechanical strength of the mesh structure makes it easier to handle the mesh structure itself, thus allowing easy assembly of the field-emission electron source apparatus. From this viewpoint, it also is possible to provide a low-cost field-emission electron source apparatus.

In a field-emission electron source apparatus according to a sixteenth preferable mode of the present invention, in the above-described third preferable mode, the field-emission electron source array includes a plurality of cells including a plurality of electron sources each emitting electrons. The field-emission electron source array and the mesh structure are arranged such that the plurality of openings and the plurality of cells are in one-to-one correspondence with each other in a vertical direction. An electron beam emitted from the cell enters the corresponding opening, passes through the electron beam passageway and reaches the target.

According to the sixteenth preferable mode described above, since the central axis of the cell including the plurality of electron sources and the central axis of the opening of the through hole in the mesh structure can be matched, a partial electron beam traveling along the vertical direction in the electron beam emitted from the field-emission electron source array passes through the through hole in the mesh structure in the largest amount. Thus, the amount of the electron beam reaching the target becomes maximal. Accordingly, it is possible to increase the brightness in a field-emission electron source display apparatus in which the target is provided with a phosphor, and to secure a sufficient amount of the electron beam reaching the target and thus reduce persistent images in a field-emission electron source imaging apparatus in which the target is provided with a photoelectric conversion film.

In a field-emission electron source apparatus according to a seventeenth preferable mode of the present invention, in the above-described third preferable mode, a pre-focusing electrode for pre-focusing the electron beam emitted from the field-emission electron source array further is provided between the field-emission electron source array and the mesh structure.

According to the seventeenth preferable mode described above, the electron beam emitted from the field-emission electron source array is pre-focused by the pre-focusing electrode so as to narrow its divergence and enters the through hole in the mesh structure.

Thus, the traveling direction of the individual electron beam is turned close to a direction parallel with the vertical direction and close to a direction parallel with the direction in which the electron beam passageway in the through hole extends. Consequently, the electron beam can pass through the through hole in the mesh structure more easily.

Accordingly, in the seventeenth preferable mode, since the electron beam spot on the target becomes smaller than that in the case where the electron beam is not pre-focused, it is possible to provide a field-emission electron source display apparatus with a still higher resolution and a field-emission electron source imaging apparatus with a still higher resolution.

A method for driving a field-emission electron source apparatus according a preferable mode of the present invention is a method for driving a field-emission electron source apparatus including a field-emission electron source array, a target for performing a predetermined operation using an electron beam emitted from the field-emission electron source array, and a mesh structure that is disposed between the field-emission electron source array and the target and provided with a plurality of through holes through which the electron beam emitted from the field-emission electron source array passes. Each of the plurality of through holes has an opening on a side of the field-emission electron source array and an electron beam passageway that continues from the opening. The mesh structure is formed of a silicon-containing material doped with a N-type or P-type material. The mesh structure includes at least two electrode layers and at least one intermediate layer disposed between the at least two electrode layers. When V1 indicates a voltage to be applied to a first electrode layer in the at least two electrode layers that is disposed on the side of the field-emission electron source array with respect to the at least one intermediate layer and V2 indicates a voltage to be applied to a second electrode layer in the at least two electrode layers that is disposed on a side of the target with respect to the at least one intermediate layer, an amount of an electron beam that passes through the plurality of through holes in the mesh structure and travels toward the target is varied by changing one or both of the voltage V1 and the voltage V2 while driving the field-emission electron source apparatus.

According to this preferable mode, an effective imaging operation can be carried out especially in a field-emission electron source imaging apparatus in which the target is provided with a photoelectric conversion film.

In other words, in the driving method according to the preferable mode described above, the amount of the electron beam that passes through the plurality of through holes in the mesh structure and travels toward the target is varied by changing one or both of the voltage V1 to be applied to the first electrode layer and the voltage V2 to be applied to the second electrode layer while driving the field-emission electron source apparatus (more specifically, during the charge resetting period). This increases the amount of the electron beam reaching the target during the charge resetting period, thereby securing a sufficient charge resetting electric current. In this way, it is possible to provide a field-emission electron source imaging apparatus with fewer persistent images.

The following is a specific description of the present invention by way of illustrative embodiments.

Embodiment 1

FIG. 1 is a sectional view showing a mesh structure and a field-emission electron source apparatus including the mesh structure according to Embodiment 1 of the present invention.

As shown in FIG. 1, a field-emission electron source apparatus according to Embodiment 1 of the present invention is provided with a vacuum container including a front panel 1 formed of light-transmitting glass, a back panel 5 and a wall part 4. Using a vacuum sealant 7, for example, frit glass for high-temperature burning or indium for low-temperature sealing, the front panel 1 and the wall part 4 are fixed firmly and sealed, and the back panel 5 and the wall part 4 are fixed firmly and sealed, so that the inside of the vacuum container is maintained under vacuum. For convenience of description in the following, an axis parallel with a direction normal to the front panel 1 and the back panel 5 is referred to as a Z axis.

An inner surface of the back panel 5 is provided with a semiconductor substrate 6 on which a field-emission electron source array 10 is formed. A mesh structure 8 with which a spacer portion 8*a* is formed as one piece is placed on and fixed to the semiconductor substrate 6. An inner surface of the front panel 1 opposed to the mesh structure 8 is provided with a light-transmitting anode electrode 2 and a target 3. The target 3 is a layer for receiving electrons emitted from the field-emission electron source array and performing a predetermined beneficial operation and, for example, is a phosphor layer or a photoelectric conversion film.

Inside the vacuum container formed of the front panel 1, the back panel 5 and the wall part 4, a getter pump (not shown) is provided for adsorbing and removing an excess gas so as to maintain the inside under high vacuum.

Figure 2:
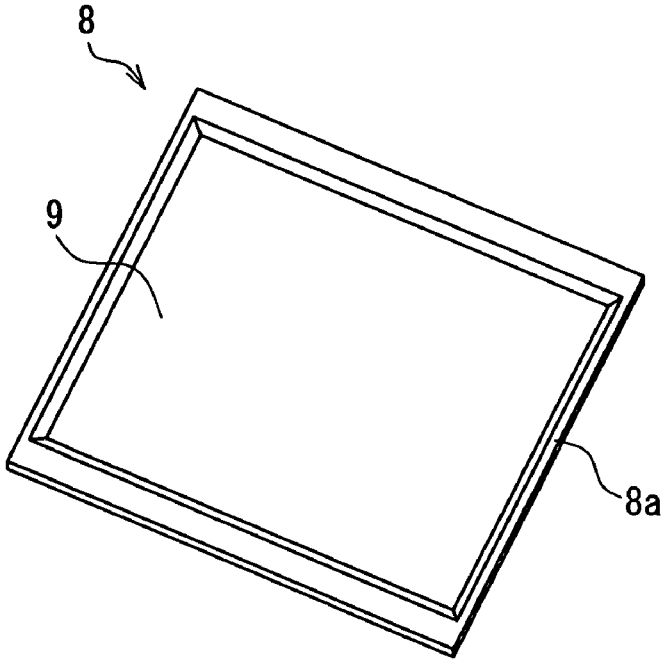
FIG. 2 is a schematic perspective view showing the mesh structure used in the field-emission electron source apparatus according to Embodiment 1 of the present invention.

FIG. 2 is a schematic perspective view showing the mesh structure 8 viewed from a surface opposed to the field-emission electron source array. The mesh structure 8 is a substantially flat electrode produced using a silicon substrate doped with a N-type or P-type material by a MEMS technique, which is the semiconductor processing technology, and includes a thin trimming portion 9 at the center and the frame-like spacer portion 8*a* that is connected to a periphery of the trimming portion 9 and thicker than the trimming portion 9. The trimming portion 9 is provided with a plurality of through holes.

The spacer portion 8*a* has a function of improving the mechanical strength of the mesh structure 8 itself and a function of spacing out the field-emission electron source array and openings of the plurality of through holes formed in the trimming portion 9 and maintaining the distance between them in a highly accurate manner.

Figure 3:
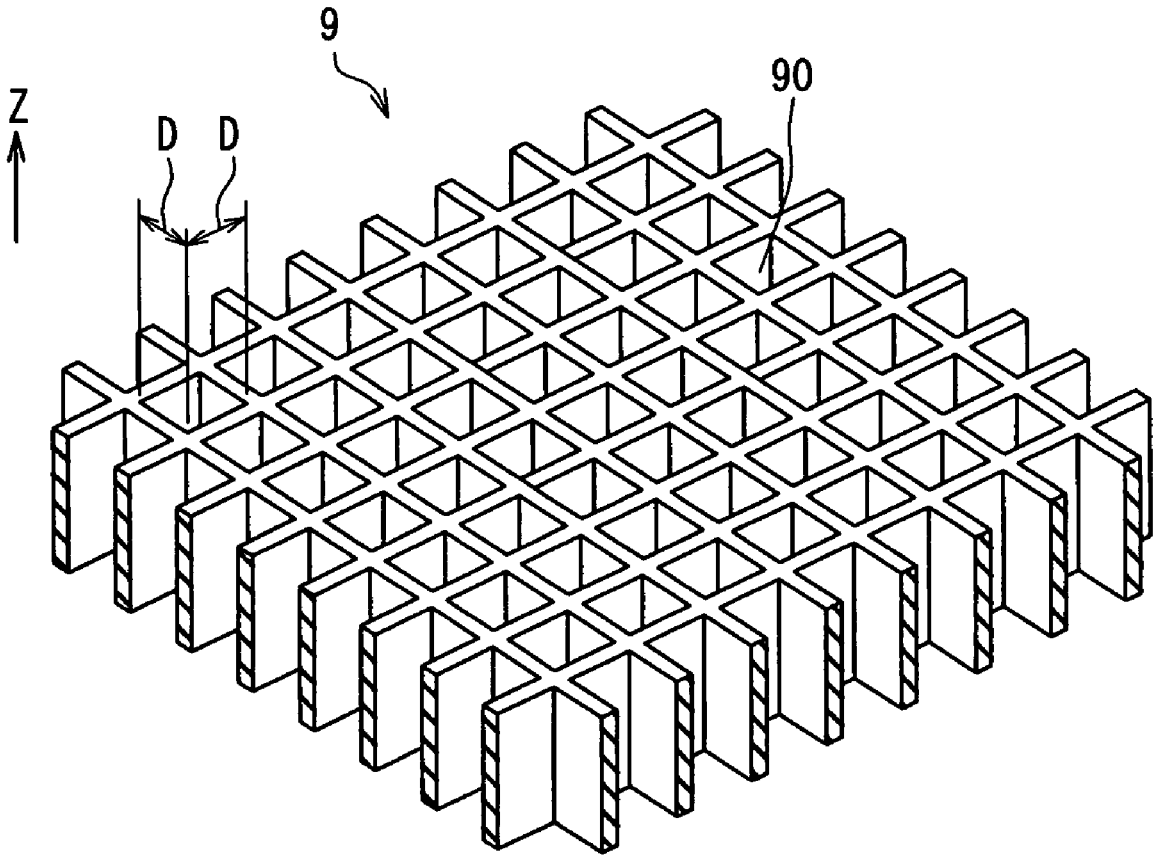
FIG. 3 is a partially enlarged perspective view showing through holes formed in a trimming portion of the mesh structure used in the field-emission electron source apparatus according to Embodiment 1 of the present invention.

FIG. 3 is a partially enlarged perspective view showing the trimming portion 9 of the mesh structure 8. The trimming portion 9 is provided with a large number of through holes 90 connecting front and back surfaces of the trimming portion 9, and through which electron beams emitted from the field-emission electron source array pass. These large number of through holes 90 are arranged like lattice points.

Figure 4A:
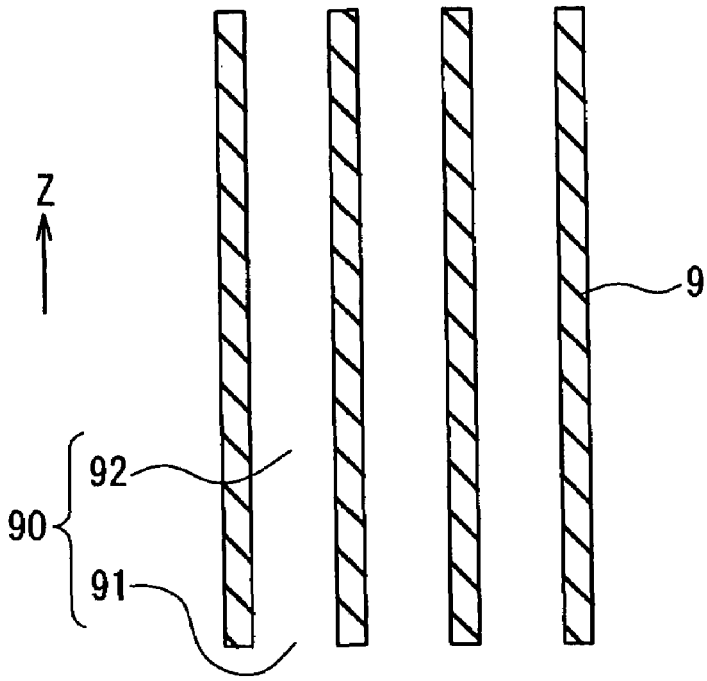
FIGS. 4A and 4B are partially enlarged sectional views taken along a thickness direction showing the trimming portion of the mesh structure used in the field-emission electron source apparatus according to Embodiment 1 of the present invention.

FIG. 4A is a partially enlarged sectional view along a Z-axis direction showing the trimming portion 9. Each of the through holes 90 has an opening 91 that is formed on the surface of the trimming portion 9 on the side of the field-emission electron source array and an electron beam passageway 92 that continues from the opening 91 along the thickness direction of the trimming portion 9. In the instant specification, the opening 91 means a portion of the through hole 90 included at the surface of the trimming portion 9 on the side of the field-emission electron source array and does not include a Z-axis direction component. Also, the electron beam passageway 92 means a portion of the through hole 90 between the front and back surfaces of the trimming portion 9.

The length of the electron beam passageway 92 is sufficiently larger than a diameter D of the opening 91. Here, the length of the electron beam passageway 92 means the length along the electron beam passageway 92. Therefore, in the case where the electron beam passageway 92 is bent, the length of the electron beam passageway 92 is larger than the thickness of the trimming portion 9 along the Z-axis direction.

The length of the electron beam passageway 92 is sufficiently larger than the diameter D of the opening 91, whereby a partial electron beam of the electron beam emitted from the field-emission electron source array, which travels in a direction that forms a large angle with the direction along which the electron beam passageway 92 extends (the Z-axis direction in the present embodiment), can be made to impact on and be absorbed and removed by a lateral wall of the electron beam passageway 92. For example, when the diameter D of the opening 91 is 16 μm and the length of the electron beam passage way 92 is 100 μm, the partial electron beam that travels in the direction that forms an angle of about 9.2° or larger with the Z-axis can be made to impact on and be absorbed and removed by the lateral wall of the electron beam passageway 92.

Figure 5:
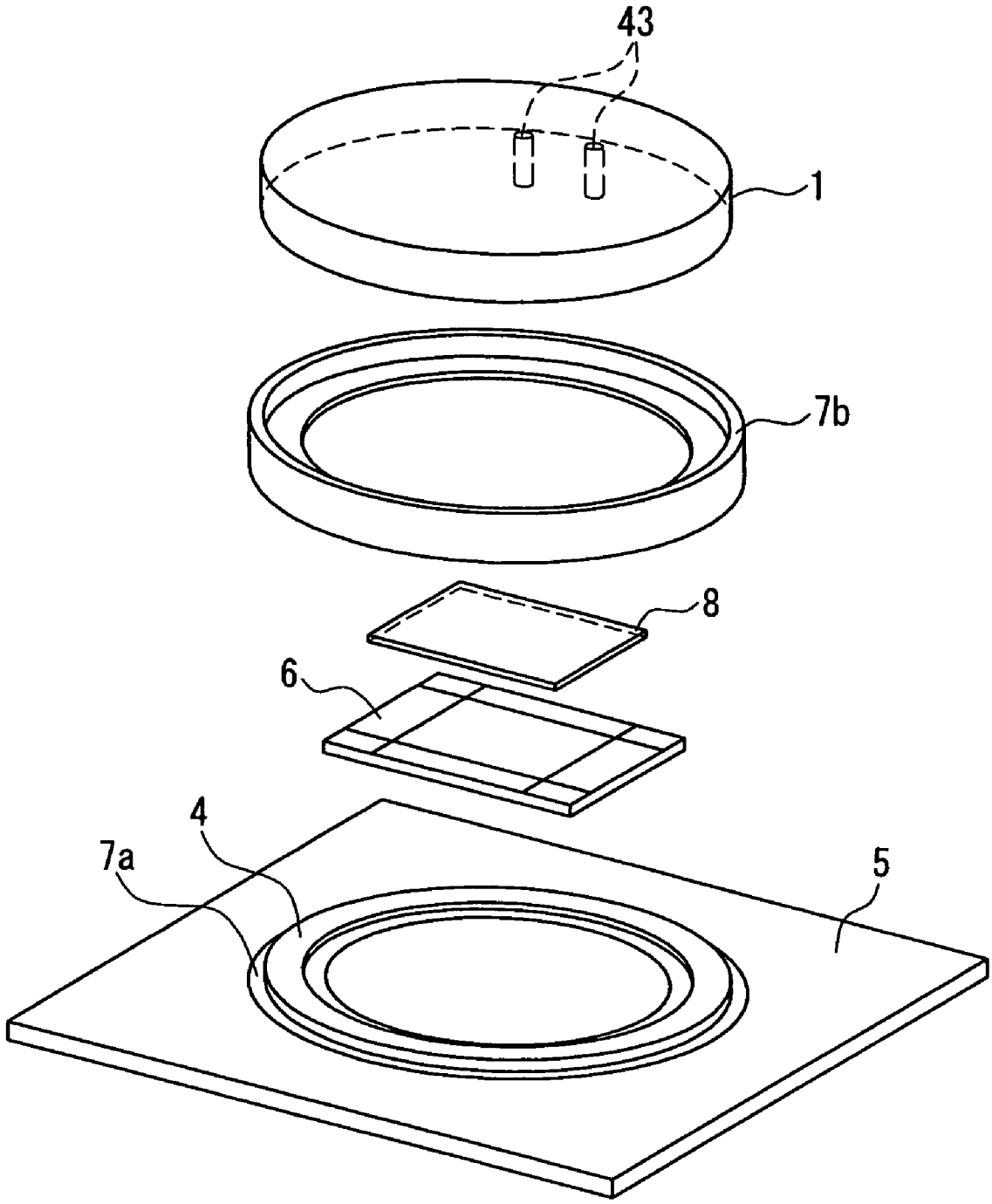
FIG. 5 is an exploded perspective view showing the field-emission electron source apparatus according to Embodiment 1 of the present invention.

FIG. 5 is an exploded perspective view showing the field-emission electron source apparatus according to Embodiment 1 of the present invention. Referring to FIG. 5, an exemplary method for assembling the field-emission electron source apparatus will be described briefly.

A frit glass 7*a* is provided on the back panel 5, and an annular wall part 4 is placed thereon, followed by burning at a temperature as high as about 400° C. Thus, the back panel 5 and the wall part 4 are joined via the frit glass 7*a*.

The spacer portion 8*a* of the mesh structure 8 and the semiconductor substrate 6 are joined by a joint technique, for example, anodic bonding or eutectic bonding. The semiconductor substrate 6 on which the mesh structure 8 is mounted is placed on and fixed to a portion on the back panel 5 surrounded by the wall part 4 by die bonding.

A voltage is supplied to the trimming portion 9 from the semiconductor substrate 6 via the portion where the spacer portion 8*a* of the mesh structure 8 and the semiconductor substrate 6 are joined and the spacer portion 8*a*. A wiring pattern on the semiconductor substrate 6 for supplying a voltage to the mesh structure 8 is connected to a wiring pattern formed on the back panel 5 by wire bonding (not shown). In this way, it is possible to supply a voltage to the mesh structure 8 from outside of the vacuum container.

On the semiconductor substrate 6, the field-emission electron source array in which a plurality of cells are arranged in a matrix is formed. Each cell includes a plurality of (for example, 100) cold cathode elements (emitters).

The plurality of cells in the field-emission electron source array on the semiconductor substrate 6 and the plurality of through holes 90 of the mesh structure 8 are in a one-to-one correspondence with each other. The semiconductor substrate 6 and the mesh structure 8 are aligned in a highly accurate manner such that an axis that passes through the center of each cell and is parallel with the Z axis passes through the substantial center of the through hole 90 of the mesh structure 8 corresponding to this cell (in the present embodiment, for example, such that a displacement amount of the center of the through hole 90 with respect to the axis that passes through the center of the cell and is parallel with the Z axis is not greater than about 3 μm).

A back panel structure constituted by the back panel 5, the wall part 4, the mesh structure 8 and the semiconductor substrate 6 assembled as above is subjected to bakeout for degassing at about 120° C. to 350° C. in a vacuum apparatus.

After the bakeout, the back panel structure is joined to and formed as one piece with the front panel 1 in a vacuum by a metal ring 7*b* to which indium has been applied, thus forming a vacuum container whose inner portion is vacuum-sealed.

Figure 6:
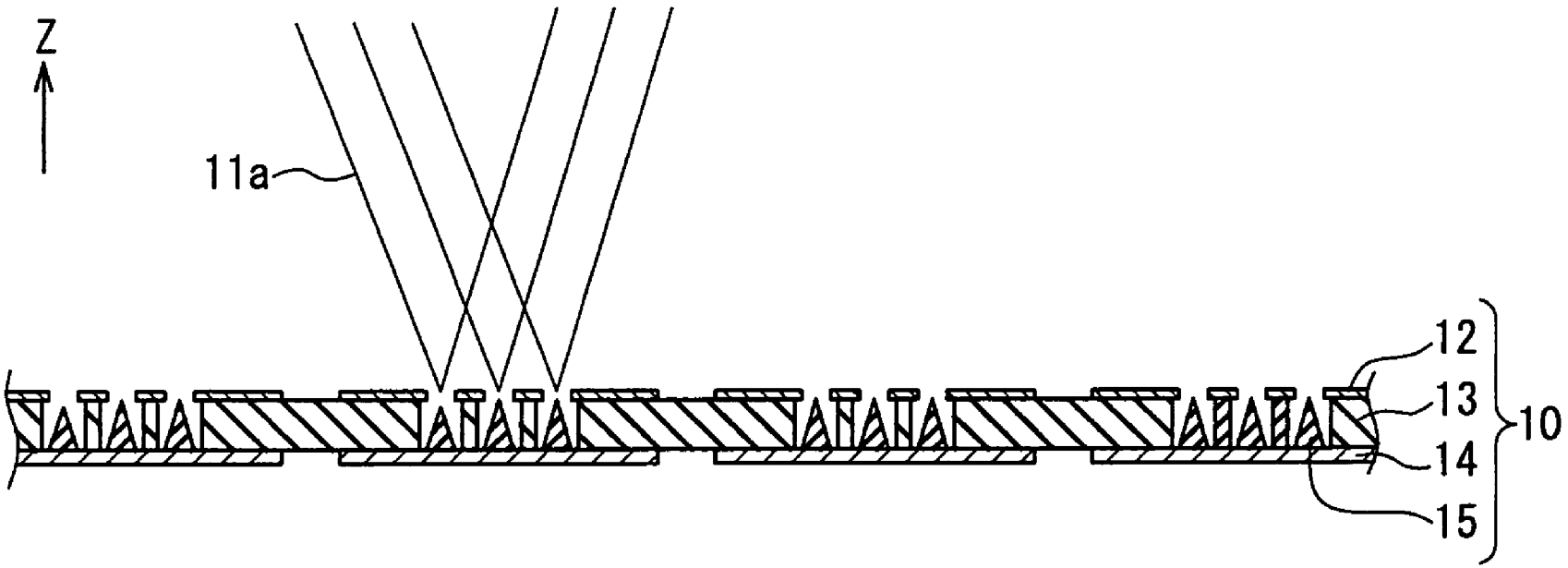
FIG. 6 is a sectional view showing an example of a field-emission electron source array in the field-emission electron source apparatus according to Embodiment 1 of the present invention.

As shown in FIG. 6, the field-emission electron source array formed on the semiconductor substrate 6 is formed by integrating a large number of emitter portions including cold cathode elements (emitters) 15 with a sharpened tip, an insulating layer 13 formed around the cold cathode element 15 and gate electrodes 12 that are disposed on the insulating layer 13 and provided with openings surrounding the cold cathode elements 15, etc.

In a flat-type imaging apparatus for capturing a VGA (640 dots×480 dots, horizontally by vertically) image, for example, the field-emission electron source array includes cells, each having a longitudinal dimension of about 20 μm and a transverse dimension of about 20 μm, arranged respectively at the pixel positions that are arranged in a matrix. A plurality of the gate electrodes 12 are formed as stripes extending in a horizontal direction (or a vertical direction), and a plurality of emitter electrodes 14 are formed as stripes extending in a direction perpendicular to a longitudinal direction of the gate electrodes 12. When viewed from a direction parallel with the Z axis, a single cell is provided at each of the intersections of the plurality of gate electrodes 12 and the plurality of emitter electrodes 14. In each cell, a plurality of the cold cathode elements 15 are arranged in such a manner as to be distributed substantially evenly within a region on the emitter electrode 14 with a longitudinal dimension of about 10 μm and a transverse dimension of about 10 μm.

The plurality of cold cathode elements 15 in a single cell are supplied with a pulsed emitter potential that drops from a reference potential of 30 V to 0 V, for example, and the gate electrodes 12 formed on the insulating layer 13 surrounding the cold cathode elements 15 are supplied with a pulsed gate potential that rises from a reference potential of 30 V to a middle potential of 60 V, for example. A potential difference formed between the cold cathode element 15 and the gate electrode 12 causes electrons to be emitted from the tip of the cold cathode element 15.

The gate electrodes 12 and the emitter electrodes 14 are connected to a wiring pattern formed on the back panel 5 so as to connect an inside and an outside of the vacuum container. The emitter potential applied to the cold cathode elements 15 and the gate potential applied to the gate electrodes 12 are supplied from the outside of the vacuum container via this wiring pattern.

The mesh structure 8 is supplied with a middle voltage of about 150 to 500 V that is a little higher than a maximum voltage applied to the gate electrodes 12. The distance from the field-emission electron source array to the surface of the plurality of through holes formed in the trimming portion 9 of the mesh structure 8 on the side of the field-emission electron source array is about 100 μm.

When the voltage to be applied to the mesh structure 8 is too high, a problem with withstand voltage characteristics between the mesh structure 8 and the field-emission electron source array may occur. Further, in the case where the field-emission electron source apparatus is used as a field-emission electron source imaging apparatus, withstand voltage characteristics between the mesh structure 8 and the target 3 also may become a problem. Conversely, when the voltage to be applied to the mesh structure 8 is too low, an effect of accelerating an electron beam emitted from the field-emission electron source array diminishes, thus increasing the divergence angle of the electron beam. Accordingly, an amount of the electron beam passing through the mesh structure 8 decreases, so that there is a possibility that the amount of electric current of the electron beam is insufficient. Accordingly, the inventors of the present invention experimentally confirmed that a preferred value of the voltage to be applied to the mesh structure 8 was in the above-noted range.

The target 3 is spaced from the mesh structure 8 by about 150 μm to several hundred micrometers. The transparent anode electrode 2 is formed between the front panel 1 and the target 3. The anode electrode 2 is supplied with a high voltage of, for example, about several hundred volts to several kilovolts, which is higher than the voltage to be applied to the mesh structure 8 via electrodes 43 penetrating through the front panel 1 (see FIG. 5).

When predetermined voltages respectively are applied to the cold cathode elements 15 and the gate electrodes 12 in the field-emission electron source array, electron beams 11*a* are emitted from the cold cathode elements 15. The electron beam 11*a* enters the opening 91 of the through hole 90 in the mesh structure 8 about 100 μm in thickness spaced from the field-emission electron source array in the Z-axis direction by about 100 μm and passes through the electron beam passageway 92 continuing from the opening 91. Then, an electron beam 11*b* that has left the mesh structure 8 reaches the target 3 that is spaced from the mesh structure by about 150 μm to several hundred micrometers.

Figure 7:
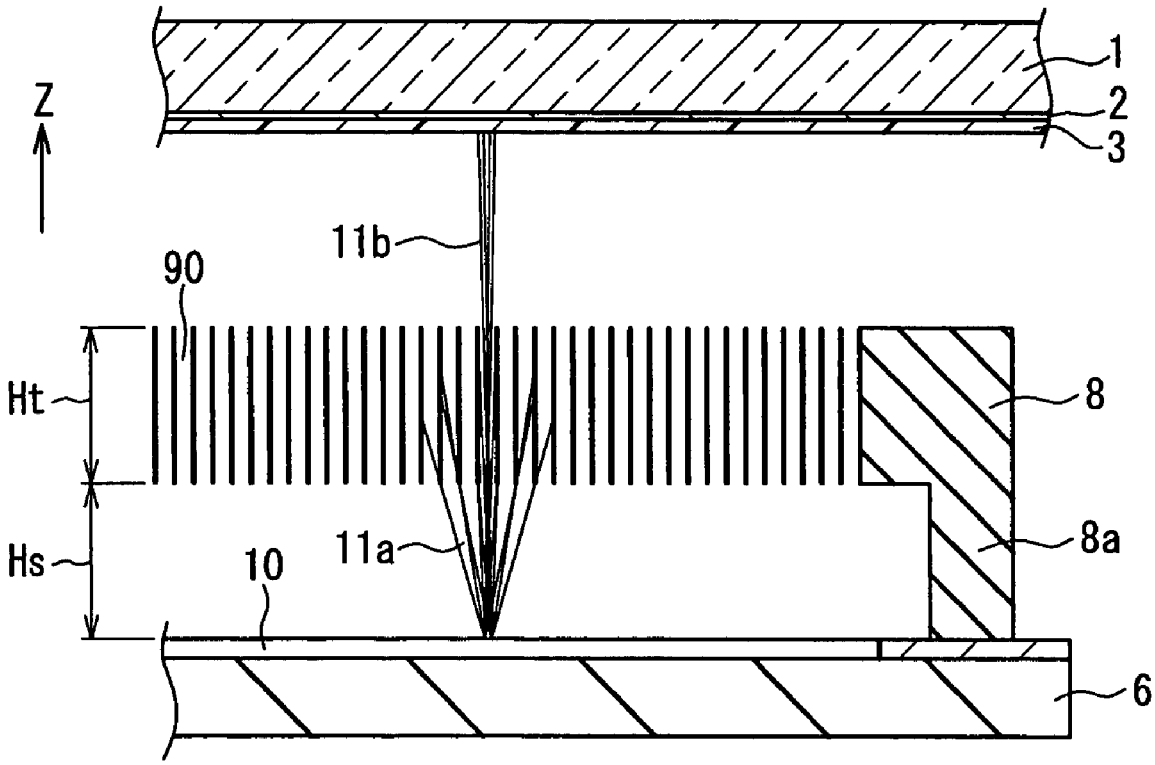
FIG. 7 is a partially enlarged sectional view showing the mesh structure and the field-emission electron source apparatus including the mesh structure according to Embodiment 1 of the present invention.

As shown in FIG. 7, the electron beam 11*a* emitted from a single cell (selected cell) in the field-emission electron source array travels toward the mesh structure 8 while having a predetermined divergence angle and enters the plurality of through holes 90 formed in the mesh structure 8.

In the electron beam 11*a* emitted from the selected cell, the partial electron beam that has traveled obliquely with respect to the Z axis and entered the through holes 90 located at positions away from a straight line that passes through this selected cell and is parallel with the Z axis, impacts on and is absorbed and removed by the lateral walls of the electron beam passageways 92 of these through holes 90.

On the other hand, in the electron beam 11*a* emitted from the selected cell, the partial electron beam that has traveled substantially in parallel with the Z axis and entered the through hole 90 located on the straight line that passes through this selected cell and is parallel with the Z axis (in the following, this through hole will be referred to as the "through hole corresponding to the selected cell") passes through the electron beam passageway 92 extending in parallel with the Z axis, leaves the mesh structure 8 and reaches the target 3. This electron beam 11*b* that has left the mesh structure 8 has a small divergence angle and a substantially aligned traveling direction, so that the cross-sectional area thereof in a direction perpendicular to the traveling direction will not expand in the course of reaching the target 3.

As described above, in the field-emission electron source apparatus according to Embodiment 1 of the present invention, the electron beam 11*b* having a smaller divergence angle compared with the case of providing no mesh structure 8 can be permitted to reach the target 3. Therefore, it is possible to reduce the spot diameter of the electron beam on the target 3. Thus, a high-definition image can be displayed in a field-emission electron source display apparatus in which the target is provided with a phosphor, and a high-definition image can be captured in a field-emission electron source imaging apparatus in which the target is provided with a photoelectric conversion film.

Also, since the electron beam 11*b* that has left the mesh structure 8 has a small divergence angle, the spot diameter of the electron beam on the target 3 hardly varies even if the distance between the back panel 5 and the front panel 1 varies due to an assembly error or even if the back panel 5 and/or the front panel 1 is warped and deformed due to an atmospheric pressure, for example. Thus, it is possible to provide a field-emission electron source display apparatus capable of displaying a uniform quality image and a field-emission electron source imaging apparatus capable of capturing a uniform quality image.

Now, the mesh structure 8 will be described in detail.

The mesh structure 8 can be produced using a silicon substrate by an MEMS (micro electro mechanical system) technique, which is a semiconductor technology. In other words, a silicon substrate whose resistance has been lowered by doping into an N type or a P type can be subjected to fine processing using a semiconductor technology, thereby forming the through holes 90 as shown in FIG. 3.

The above-described production of the mesh structure 8 using a silicon substrate by the MEMS technique, which is the semiconductor technology, has the following advantages.

First, fine processing on the order of micrometers and sub-micrometers using the semiconductor technology becomes possible. Thus, in the case of a VGA field-emission electron source apparatus including a large number of (for example, 100) cold cathode elements 15 in a single cell of a square about 20 μm per side, for example, the diameter D of the opening 91 of the mesh structure 8 is about 16 μm, for example, so that its forming accuracy needs to be on the order of sub-micrometers. By using the MEMS technique, such fine processing can be carried out.

Second, as the assembly of the mesh structure 8 and the field-emission electron source array also has to be highly accurate, using the MEMS technique makes it possible to form the mesh structure 8 in a highly accurate manner and assemble the mesh structure 8 and the field-emission electron source array in a highly accurate manner, thus achieving a field-emission electron source apparatus with an excellent quality.

Third, the silicon substrate can be used to achieve the same coefficient of thermal expansion as that of the semiconductor substrate 6 that is produced also using a silicon substrate and on which the field-emission electron source array is to be formed.

For ensuring reliability such as accuracy, it is preferable that the field-emission electron source array is produced partially or entirely using a silicon substrate by the semiconductor technology. Such a system also is advantageous in terms of cost because the above-noted semiconductor technology is common now and equipment needed therefor is readily available in the market.

It is advantageous in terms of thermal expansion to form the mesh structure 8 of the same material as the substrate on which the field-emission electron source array is to be formed. For example, the field-emission electron source apparatus becomes less likely to break due to thermal expansion, and burning such as baking for degassing can be carried out at high temperatures when assembling the field-emission electron source apparatus.

The spacer portion 8*a* is formed as one piece with the mesh structure 8, and the spacer portion 8*a* of the mesh structure 8 is placed directly on the semiconductor substrate 6 on which the field-emission electron source array is formed. In this way, the accuracy of the distance between the field-emission electron source array and the mesh structure 8 can be enhanced. This allows the spacer portion 8*a* to fulfill effectively its function of maintaining the distance between the field-emission electron source array and the openings 91 of the plurality of through holes 90 formed in the trimming portion 9 of the mesh structure 8 in a highly accurate manner.

In the case where a single cell of the field-emission electron source array has a longitudinal dimension of about 20 μm and a transverse dimension of about 20 μm as described above, for example, the spacer portion 8*a* of the mesh structure 8 has a thickness Hs of preferably about 50 to 150 μm (optimally, about 100 μm). Here, the thickness Hs of the spacer portion 8*a* means the distance between the surface of the trimming portion 9 of the mesh structure 8 on the side of the field-emission electron source array and the field-emission electron source array as shown in FIG. 7.

In this case, from the viewpoint of the dimensional margin and the mechanical strength of the trimming portion 9 in the MEMS processing, it is preferable that the distance between the openings 91 that are adjacent to each other in the longitudinal and transverse directions (namely, the thickness of a wall between the electron beam passageways 92 adjacent to each other) is in the range of 4 μm±2 μm. Thus, when the longitudinal and transverse dimensions of a single cell respectively are 20 μm, the opening 91 of the through hole 90 in the mesh structure 8 has a shape of a quadrangle whose sides are about 16 μm long. The trimming portion 9 has a thickness Ht (namely, a dimension of the electron beam passageway 92 along the Z-axis direction) of, preferably, about 1.5 to 10 times and, further preferably, about 6 to 8 times the above-noted diameter of the opening 91 (about 100 to 120 μm in the example described above).

When the thickness Ht of the trimming portion 9 is smaller than 1.5 times the diameter of the opening 91, it becomes difficult to allow the electron beam that has entered the mesh structure 8 with a large incident angle to impact on and be absorbed and removed by the lateral wall of the electron beam passageway 92. Thus, in the electron beam 11*a* emitted from the selected cell, the partial electron beam that travels obliquely with respect to the Z axis and enters the through holes 90 located away from the straight line passing through this selected cell and parallel with the Z axis also passes through the through holes 90 of the mesh structure 8 and reaches the target 3. This expands the spot diameter of the electron beam on the target 3.

When the thickness Ht of the trimming portion 9 exceeds 10 times the opening diameter of the opening 91, the amount of the electron beam that passes through the through hole 90 in the mesh structure 8 and reaches the target 3 decreases considerably, so that there may be an insufficient amount of the electron beam necessary for performing a desired operation in the target 3.

The thickness Hs of the spacer portion 8*a* and the thickness Ht of the trimming portion 9 have the above-mentioned optimal values for the following reasons.

The thickness Hs of the spacer portion 8*a* means the distance from the field-emission electron source array to the opening 91 of the through hole 90 formed in the trimming portion 9 (see FIG. 7).

When the thickness Hs of the spacer portion 8*a* is large, the mechanical strength of the mesh structure 8 itself can be raised.

However, the distance from the field-emission electron source array to the trimming portion 9 increases, thus expanding the electron beam on the surface of the trimming portion 9 on the side of the field-emission electron source array. This reduces the amount of the electron beam entering the through hole 90 corresponding to the selected cell in the field-emission electron source array, so that the amount of the electron beam that passes through this through hole and reaches the target 3 decreases. As a result, it becomes difficult to display an image having a predetermined brightness because the amount of the electron beam exciting a phosphor decreases in a field-emission electron source display apparatus in which the target is provided with the phosphor, and persistent images increase because an electric current for reading out positive holes generated in a photoelectric conversion film cannot be secured sufficiently in a field-emission electron source imaging apparatus in which the target is provided with the photoelectric conversion film.

Conversely, when the thickness Hs of the spacer portion 8*a* is small, it indeed is possible to secure the amount of the electron beam that passes through the through hole 90 corresponding to the selected cell of the mesh structure 8 and reaches the target 3.

However, the mechanical strength of the mesh structure 8 itself decreases. As a result, at the time of assembling the field-emission electron source apparatus, for example, the mesh structure 8 may break, causing a problem of decreased yield.

When the thickness Ht of the trimming portion 9 is small, the amount of the electron beam that passes through the mesh structure 8 and reaches the target 3 increases.

However, in the electron beam 11*a* emitted from the selected cell in the field-emission electron source array, the partial electron beam that travels obliquely with respect to the Z axis and enters the through holes 90 located around the through hole corresponding to this selected cell also passes through these through holes 90 and reaches the target 3. In other words, such a small thickness Ht diminishes a trimming effect of the mesh structure 8 in which the electron beam 11*a* that has entered through holes other than the through hole corresponding to the selected cell is absorbed and removed by the lateral walls of the electron beam passageways 92 of these through holes, allowing only the electron beam 11*b* leaving the through hole corresponding to the selected cell to reach the target 3. This expands the spot diameter of the electron beam on the target 3. Accordingly, it becomes difficult to display a high-definition image in a field-emission electron source display apparatus in which the target is provided with a phosphor, and it becomes difficult to capture a high-definition image in a field-emission electron source imaging apparatus in which the target is provided with a photoelectric conversion film.

Conversely, when the thickness Ht of the trimming portion 9 is large, it is possible to prevent the electron beam that has entered the through holes 90 located around the through hole corresponding to the selected cell from passing through these through holes 90 and reaching the target 3.

However, the amount of the electron beam that passes through the through hole 90 corresponding to the selected cell and reaches the target 3 decreases. As a result, it becomes difficult to display an image having a predetermined brightness because the amount of the electron beam exciting a phosphor decreases in a field-emission electron source display apparatus in which the target is provided with the phosphor, and persistent images increase because an electric current for reading out positive holes generated in a photoelectric conversion film cannot be secured sufficiently in a field-emission electron source imaging apparatus in which the target is provided with the photoelectric conversion film.

FIGS. 8A, 8B, 9A and 9B show simulation results in the field-emission electron source apparatus according to Embodiment 1 of the present invention.

Figure 8A:
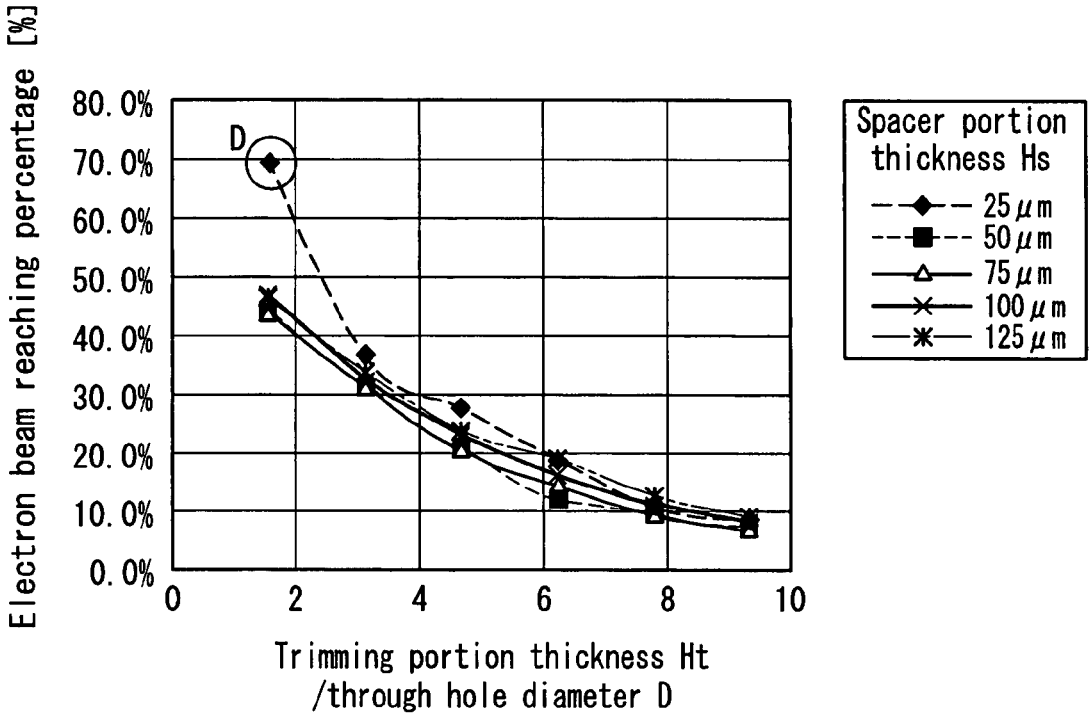
FIGS. 8A and 8B show simulation results in the field-emission electron source apparatus according to Embodiment 1 of the present invention.
Figure 8B:
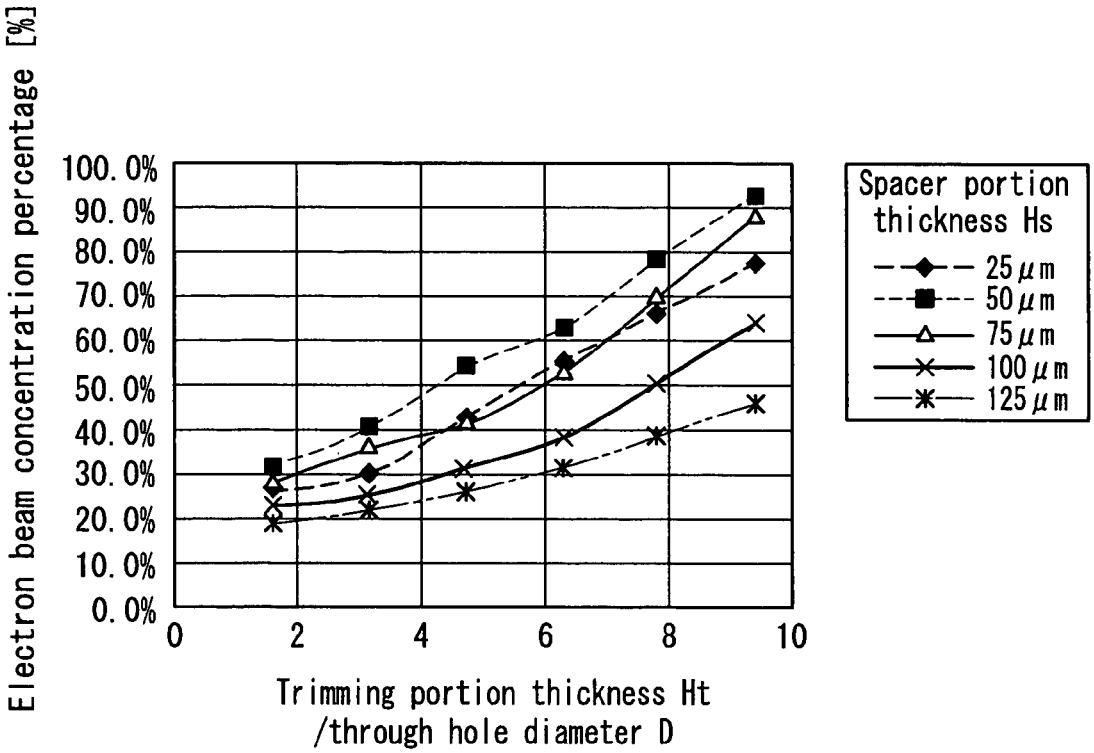
Figure 9A:
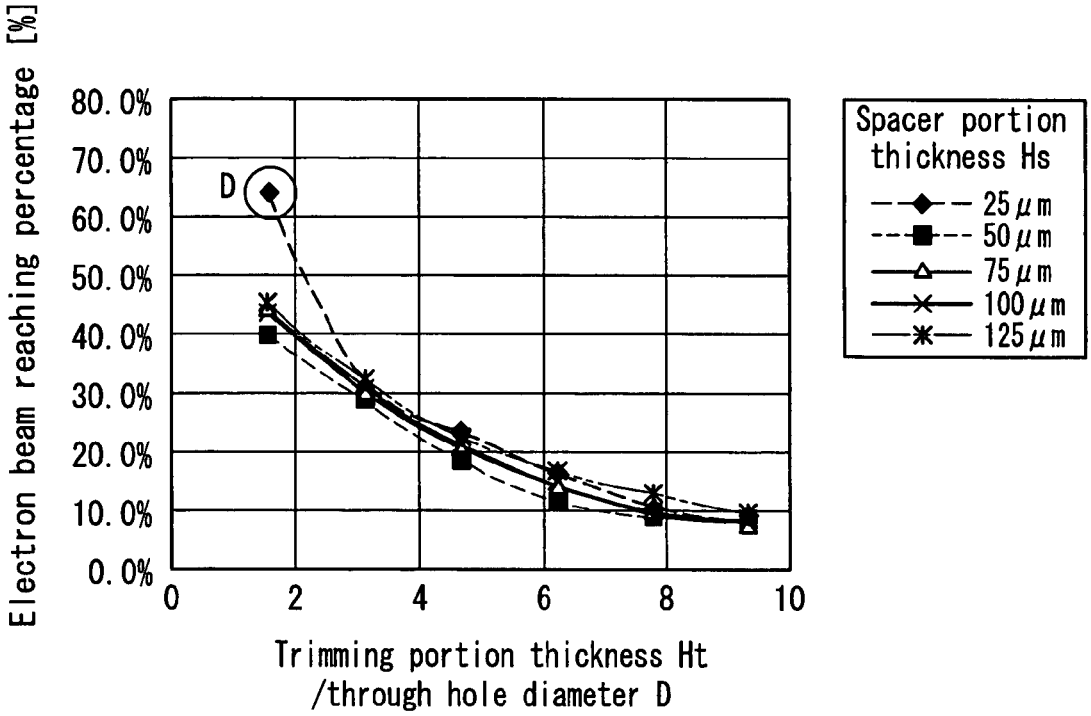
FIGS. 9A and 9B show simulation results in the field-emission electron source apparatus according to Embodiment 1 of the present invention.
Figure 9B:
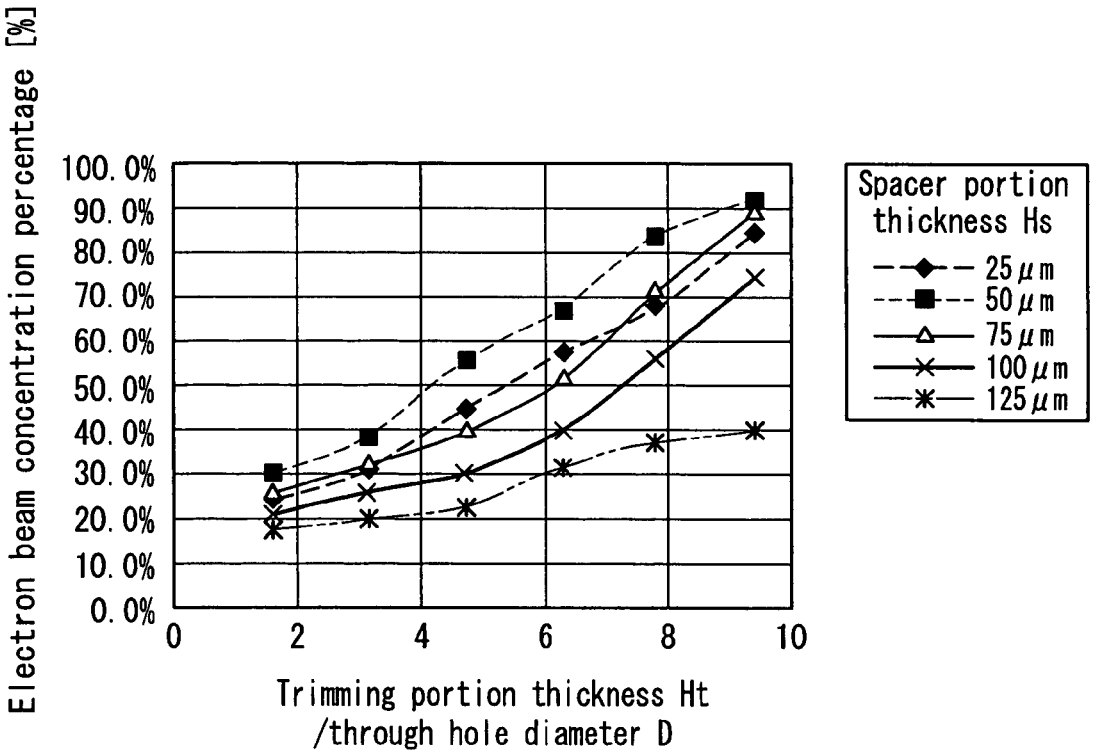

FIGS. 8A and 8B show the case of applying a voltage of 300 V to the mesh structure 8, and FIGS. 9A and 9B show the case of applying a voltage of 225 V to the mesh structure 8.

The simulation was carried out with respect to the VGA-compatible field-emission electron source apparatus in which each cell size was 20 μm long on each side, the opening 91 of the through hole 90 in the mesh structure 8 had a shape of a 16-μm-square and the distance from the mesh structure 8 to the target 3 was 150 μm.

The thickness Hs of the spacer portion 8*a* (namely, the distance from the field-emission electron source array to the opening 91 of the through hole 90 in the trimming portion 9) was changed from 25 μm to 125 μm in increments of 25 μm.

In each thickness of the spacer portion 8*a*, the thickness Ht of the trimming portion 9 was changed from 25 μm to 150 μm in increments of 25 μm.

FIGS. 8A and 9A are graphs showing the results of calculating the percentage (unit: %) of the partial electron beam passing through the mesh structure 8 and reaching the target 3 in the electron beam emitted from the selected cell. The horizontal axis indicates a value obtained by normalizing the thickness Ht of the trimming portion 9 by the diameter D (=16 μm) of the through hole 90 of the mesh structure 8, and the vertical axis indicates the percentage of the partial electron beam reaching the target 3 in the electron beam emitted from the selected cell (electron beam reaching percentage; unit: %).

FIGS. 8B and 9B are graphs showing the results of calculating the percentage (unit: %) of the partial electron beam reaching a 40-μm-square region whose center is a point at which a straight line that passes through the center of the selected cell and is parallel with the Z axis crosses the target 3 in the electron beam emitted from the selected cell. The horizontal axis indicates a value obtained by normalizing the thickness Ht of the trimming portion 9 by the diameter D (=16 μm) of the through hole 90 of the mesh structure 8, and the vertical axis indicates the percentage of the partial electron beam reaching the above-noted region in the target 3 in the electron beam emitted from the selected cell (electron beam concentration percentage; unit: %).

Although the simulation was carried out with respect to the field-emission electron source imaging apparatus in which the target 3 is provided with a photoelectric conversion film, the case of a field-emission electron source display apparatus in which the target 3 is provided with a phosphor was similar except for a voltage to be applied to the target 3. Thus, for the percentage of the electron beam passing through the mesh structure 8 and reaching the target 3, the same calculation results as in the case illustrated by FIGS. 8A and 9A are obtained in the case of the field-emission electron source display apparatus. For the percentage of electron beam reaching the predetermined region on the target 3, the voltage of the target 3 in the case of the field-emission electron source display apparatus is higher than that in the case of the field-emission electron source imaging apparatus, so that the percentage of the electron beam reaching the predetermined region on the target 3 is higher than that in the case illustrated by FIGS. 8B and 9B.

From FIGS. 8A and 9A, the percentage of the electron beam reaching the target 3 decreases with an increase in the ratio of the thickness Ht of the trimming portion 9 to the diameter D of the through hole 90 (the ratio Ht/D).

On the surface of the trimming portion 9 opposed to the field-emission electron source array, one opening 91 (the square 16 μm per side) was formed in the region (the square 20 μm per side) corresponding to one cell. Thus, the areal percentage (opening ratio) of the openings 91 in the surface of the trimming portion 9 opposed to the field-emission electron source array was (16 μm×16 μm)/(20 μm×20 μm)×100=64%.

In the region with the ratio Ht/D of at least 1.5 (the thickness Ht of the trimming portion 9 was at least 25 μm), the percentage of the electron beam reaching the target 3 was sufficiently smaller than 64%, which was the opening ratio of the trimming portion 9, except for the point D shown in FIGS. 8A and 9A (indicating the case where the thickness Hs of the spacer portion 8*a* was 25 μm and the thickness Ht of the trimming portion 9 was 25 μm). In the case where the thickness Hs of the spacer portion 8*a* was at least 50 μm, the percentage of the electron beam reaching the target 3 was sufficiently smaller than 64%, which was the opening ratio of the trimming portion 9, regardless of the thickness Hs of the spacer portion 8*a*.

In other words, 64% of the electron beam emitted from the selected cell enters the through holes 90 in the trimming portion 9, and then part of this electron beam that has entered the through holes 90 impacts on and is absorbed and removed by the lateral walls of the electron beam passageways 92 and thus cannot pass through the mesh structure 8. That is to say, when the percentage of the electron beam reaching the target 3 is smaller than 64%, which is the opening ratio of the trimming portion 9, it means that the trimming effect of the mesh structure 8 functions effectively.

At the point D mentioned above, when the thickness Hs of the spacer portion 8*a* is increased, the percentage of the electron beam reaching the target 3 becomes smaller than 64%, which is the opening ratio of the trimming portion 9. Thus, since an electron beam path is bent by an electrostatic lens formed near the opening 91 of the trimming portion 9 on the side of the surface opposed to the field-emission electron source array in the condition of the point D, the percentage of the electron beam reaching the target 3 is considered to become larger than 64%, which is the opening ratio of the trimming portion 9. Accordingly, by lowering the voltage applied to the mesh structure 8 so as to weaken the above-noted electrostatic lens in the condition of the point D, the percentage of the electron beam reaching the target 3 becomes smaller than 64%, so that the trimming effect of the mesh structure 8 is considered to be exerted.

As described above, although there are some differences depending on the voltages to be applied to individual members, the ratio Ht/D of at least about 1.5 allows the electron beam to impact on and be absorbed and removed by the lateral walls of the electron beam passageways 92 of the through holes 90 in the mesh structure 8.

Now, a preferred range of the thickness Ht of the trimming portion 9 will be discussed. The range of the thickness Ht has to be set so as to satisfy the conditions below. First, it is necessary to remove by absorption part of the electron beam by the lateral wall of the electron beam passageway 92 of the mesh structure 8, thus allowing the electron beam having a smaller divergence angle than the electron beam emitted from the selected cell to leave the mesh structure 8 for the target 3. Second, it is necessary to secure the amount of an electron beam needed for performing a desired operation in the target 3.

Assuming that the divergence angle of the electron beam emitted from the selected cell has a Gaussian distribution, the case in which a partial electron beam having a divergence angle of equal to or larger than 1σ (68.27% of the overall electron beam) is absorbed and removed by the mesh structure 8 will be discussed. For this purpose, the percentage of the partial electron beam passing through the mesh structure 8 in the electron beam emitted from the selected cell preferably is reduced to equal to or smaller than 43.7%, which is obtained by multiplying the opening ratio (64%) of the trimming portion 9 by 68.27% corresponding to 1σ, and the ratio Ht/D preferably is equal to or larger than 1.5, which becomes clear from FIGS. 8A and 9A.

Also, in order to perform a desired operation in the target 3, it is considered necessary that the percentage of the partial electron beam reaching the target 3 of the electron beam emitted from the selected cell be equal to or larger than 5%. For this purpose, the ratio Ht/D preferably is equal to or smaller than 10, which becomes clear from FIGS. 8A and 9A.

As described above, it is preferable that the thickness Ht of the trimming portion 9 is 1.5 to 10 times the opening diameter D of the through hole 90.

However, considering the fact that, for example, for achieving a sufficient resolution, at least 40% of the electron beam emitted from the selected cell needs to reach the 40-μm-square region on the target 3, the thickness Ht of the trimming portion 9 has to be at least 3 times the opening diameter D of the through hole 90 as shown in FIGS. 8B and 9B.

When it is considered necessary that at least 10% of the electron beam emitted from the selected cell should reach the target 3 because the field-emission electron source array is of a kind with a relatively poor electron beam emission capability, the thickness Ht of the trimming portion 9 has to be equal to or smaller than 8 times the opening diameter D of the through hole 90 as shown in FIGS. 8A and 9A.

As described above, the preferred range of the thickness Ht of the trimming portion 9 varies depending on the use of the field-emission electron source apparatus, the kind of the field-emission electron source array or the like.

The embodiment described above has been directed to the Spindt-type in which the field-emission electron source includes the cold cathode elements 15 with sharpened tips and the gate electrodes 12 provided with openings surrounding these tips as an example. However, the field-emission electron source of the present invention is not limited to this. For example, it also may be a field-emission electron source of an MIM (metal insulator metal) type in which an insulating layer is formed between cathode electrodes and gate electrodes and a voltage is applied to the insulating layer, thereby emitting electrons by a tunnel effect, that of an SCE (surface conduction electron source) type in which a minute gap is provided between cathode electrodes and emitter electrodes and a voltage is applied between these electrodes, thereby emitting electrons from the minute gap, and that using a carbonaceous material such as DLC (diamond like carbon) or CNT (carbon nanotube) for an electron source.

It is particularly preferable to apply the present invention to a field-emission electron source apparatus that includes an electron source performing the field emission of a divergent electron beam and requires the reduction of a spot diameter of the electron beam on the target 3 because the effect of the present invention is exerted effectively.

Figure 10:
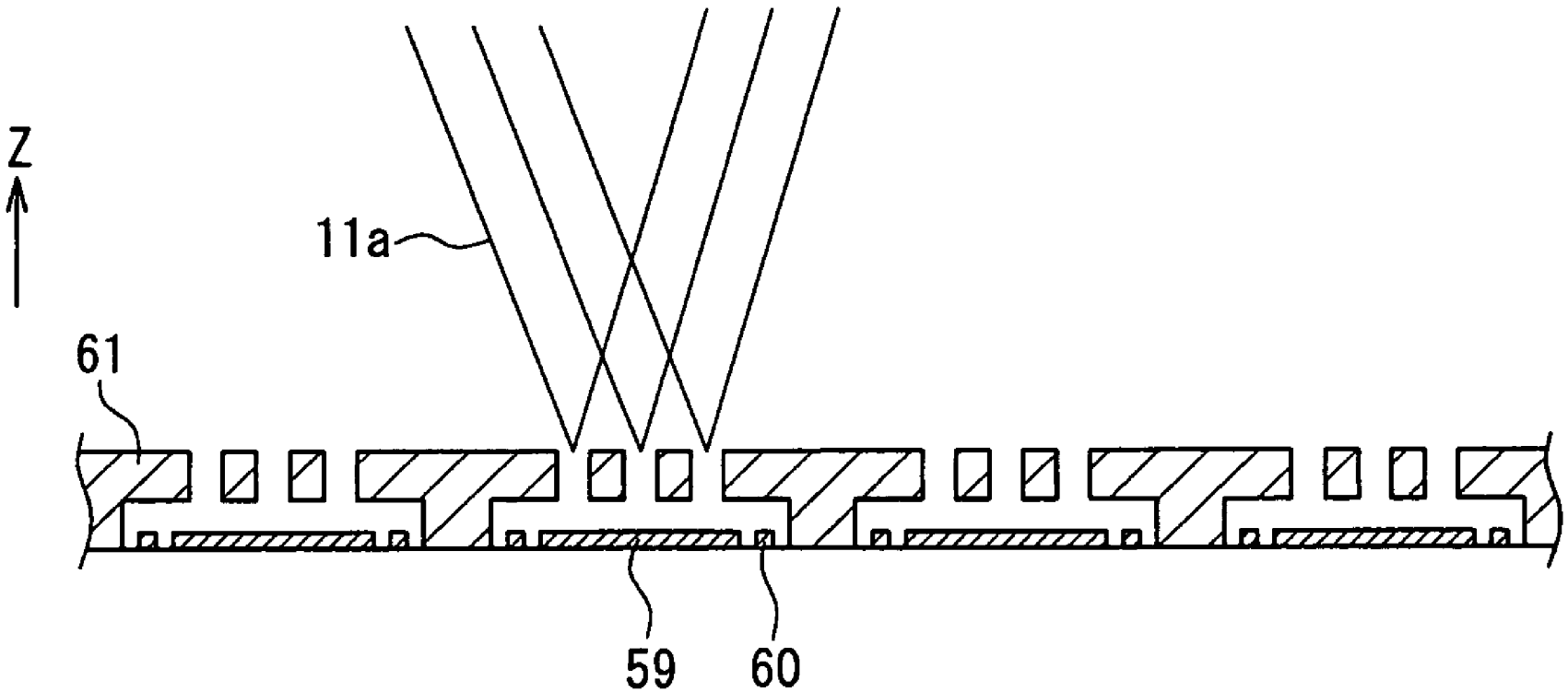
FIG. 10 is a sectional view showing another example of the field-emission electron source array in the field-emission electron source apparatus according to Embodiment 1 of the present invention.

FIG. 10 shows an example of a field-emission electron source using a carbonaceous material such as CNT (carbon nanotube) (see JP 2002-313263 A, for example).

CNT layers 59 made of a large number of carbon nanotubes (CNTs) are formed on a substrate. Focusing electrodes 60 are formed so as to surround the CNT layers 59. Gate electrodes 61 for leading out electrons from the CNT layers 59 are formed above the CNT layers 59. The gate electrodes 61 are provided with a large number of electron beam passage apertures. Cells formed of carbon nanotubes have a quadrangular shape when viewed from the top. A plurality of the cells are arranged in a matrix along longitudinal and transverse directions. The plurality of cells along the longitudinal direction are connected electrically with each other, thus forming emitter lines. Each of the gate electrodes 61 is arranged on the plurality of cells along the transverse direction, thus forming a gate line. By selecting one of a plurality of the emitter lines and one of a plurality of the gate lines, the electron beam 11*a* is emitted from a cell located at the intersection of the selected emitter line and the selected gate line.

When the gate electrodes 61 are thin, the amount of the electron beam 11*a* emitted from the cell increases, so that the divergence angle thereof increases. When the gate electrodes 61 are thick, the amount of the electron beam 11*a* emitted from the cell decreases, so that the divergence angle thereof decreases.

The present invention also is applicable to a field-emission electron source apparatus including such a field-emission electron source using CNTs. In particular, it is preferable to apply the present invention to the case where the thin gate electrodes 61 result in a large amount of the electron beam 11*a* emitted from the cell and thus exhibit a large divergence angle, because the effect of the present invention is exerted effectively. In that case, it is preferable that the through holes 90 in the mesh structure 8 in a one-to-one correspondence with the cells are arranged above the cells in the Z-axis direction and that the openings of the through holes 90 have substantially the same size as the cells.

Although the embodiment described above has been directed to the example in which the distance from the field-emission electron source array to the opening 91 of the through hole 90 in the trimming portion 9 is about 100 μm, the thickness of the trimming portion 9 is about 100 μm and the distance from the mesh structure 8 to the target 3 is about 150 μm to several hundred micrometers, the present invention is not limited to this. It is needless to say that these distances may be set freely according to the use of the field-emission electron source apparatus and the kind of the field-emission electron source.

Furthermore, although the target 3 covers the anode electrode 2 in the embodiment described above, the present invention is not limited to this. For example, the anode electrode 2 may be larger than the target 3. Also, the target 3 may include phosphors of three colors, and these phosphors of three colors may be formed alternately on the surface of the anode electrode 2. In this case, it also may be possible to provide a light absorption layer such as a black matrix between adjacent phosphors. Moreover, a color filter layer of a single color or color filter layers of three colors may be provided between the anode electrode 2 and the target 3 or between the anode electrode 2 and the front panel 1, and a phosphor layer or a photoelectric conversion film layer may be formed as the target 3 so as to correspond to the color of the color filter layer(s).

Also, although the embodiment described above has been directed to the example in which the mesh structure 8 is produced using a silicon substrate by the MEMS technique, which is the semiconductor technology, the method for producing the mesh structure 8 is not limited to this. For example, the mesh structure 8 also may be produced by etching a metal sheet or by forming the through holes 90 in an insulating material such as glass and then forming a metal film on the surface of the insulating material by application or vapor deposition such as sputtering or CVD.

Alternatively, the trimming portion 9 produced using a silicon substrate by the semiconductor technology and the spacer portion 8*a* produced independently thereof from a material such as silicon, metal or glass may be joined as one piece, thus producing the mesh structure 8.

Figure 11:
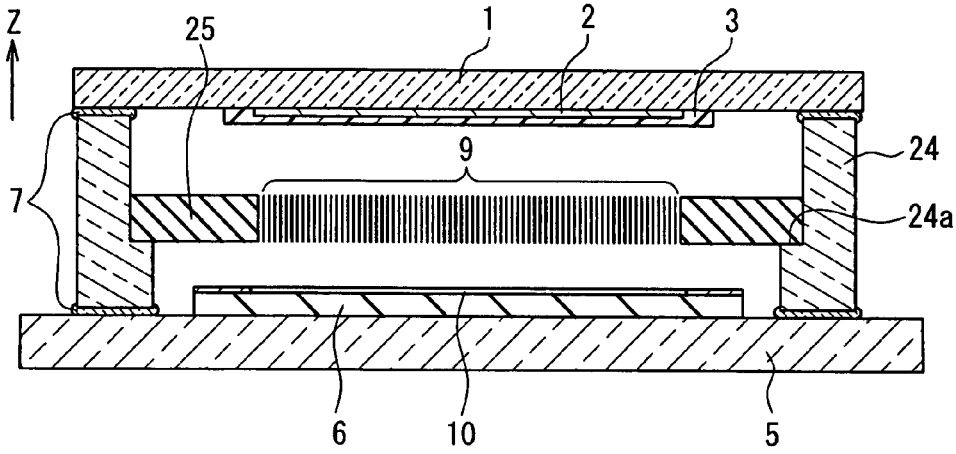
FIG. 11 is a sectional view showing another mesh structure and a field-emission electron source apparatus including the mesh structure according to Embodiment 1 of the present invention.

Further, although the embodiment described above has shown the mesh structure 8 including the spacer portion 8*a* as one piece for the purpose of reducing an assembly error of the distance from the field-emission electron source array to the trimming portion 9, the present invention is not limited to this. For example, as shown in FIG. 11, an inner peripheral surface of a wall part 24 may be provided with a step 24*a*, which is used to support a mesh structure 25 having no spacer portion. In this case, it also is possible to achieve the trimming effect in which the electron beam that has entered through holes other than the through hole corresponding to the selected cell is absorbed and removed by the lateral walls of the electron beam passageways of these through holes.

Figure 4B:
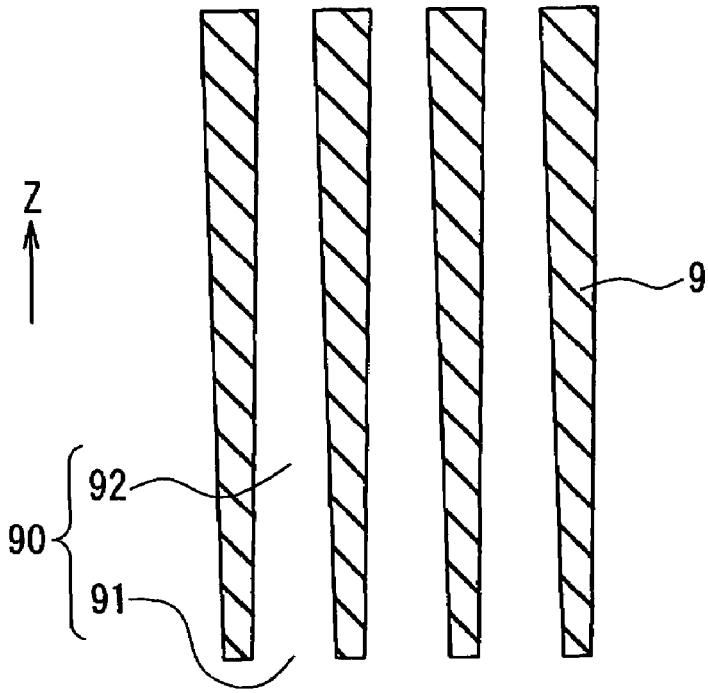

The inner diameter of the electron beam passageway 92 of the through hole 90 in the mesh structure 8 does not need to be constant in the Z-axis direction as shown in FIG. 4A described above but may vary. By varying the inner diameter of the electron beam passageway 92 in the Z-axis direction, it is possible to adjust the trimming effect of the mesh structure 8. For example, it is preferable that the inner diameter of the electron beam passageway 92 is smaller on an exit side of the electron beam than on an incident side thereof as shown in FIG. 4B, because the divergence angle of the electron beam 11*b* emitted from the through hole 90 of the mesh structure 8 can be made still smaller.

Figure 14A:
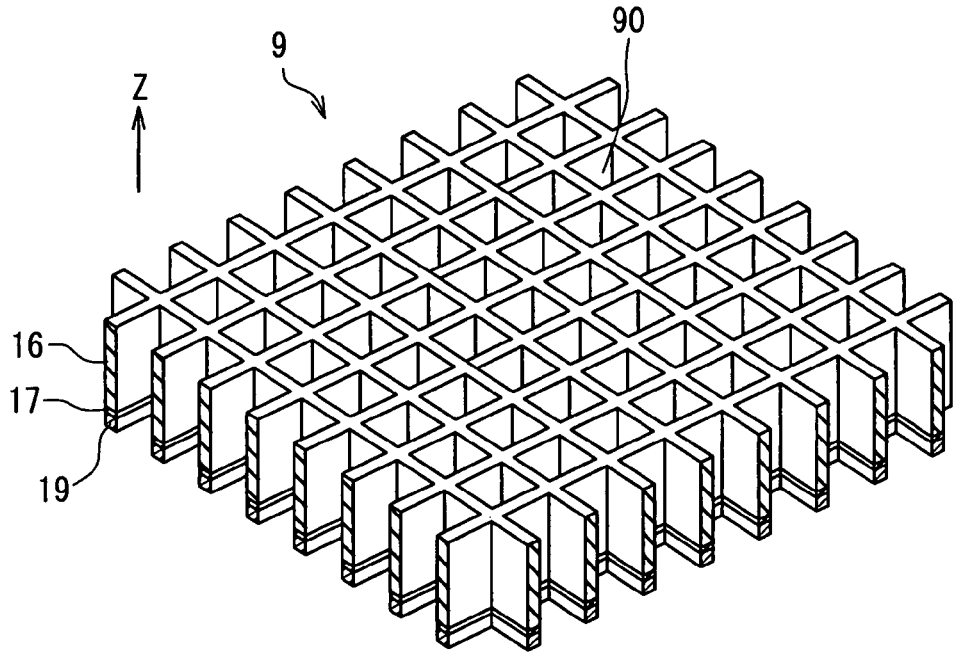
FIGS. 14A and 14B are partially enlarged perspective views showing the trimming portion of the mesh structure used in the field-emission electron source apparatus according to Embodiment 2 of the present invention.
Figure 14B:
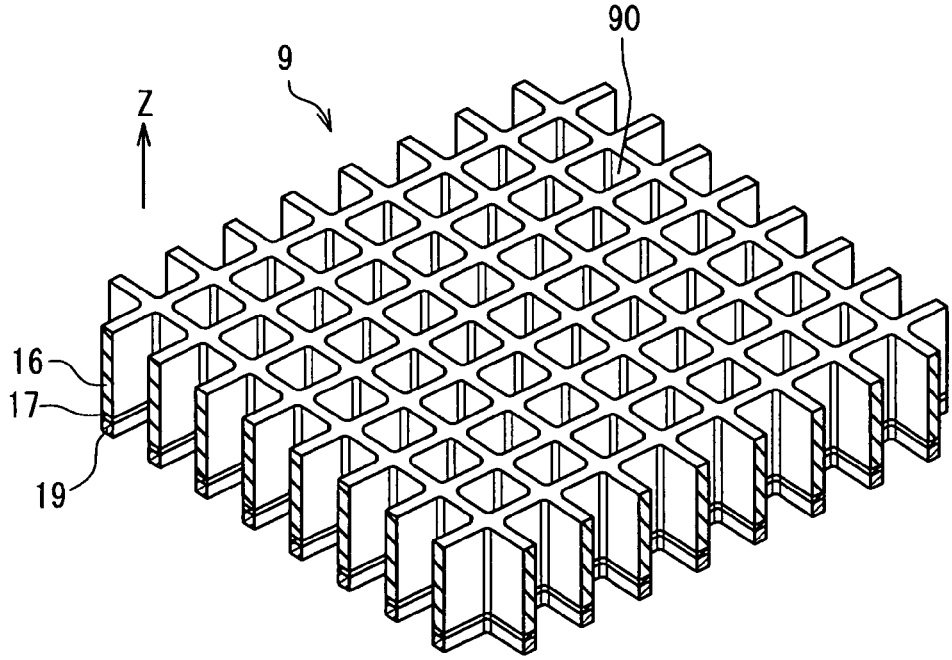

The cross-sectional shape of the electron beam passageway 92 of the through hole 90 in the mesh structure 8 along the direction perpendicular to the Z axis is not limited to the quadrangle as in the example described above. For example, it also may be circle, ellipse, polygon with all interior angles being larger than 90° or polygon whose adjacent sides are connected by a circular arc (for example, see FIG. 14B described later). These shapes make it possible to prevent a local stress concentration in the mesh structure, thus achieving the mesh structure with a high strength. For example, the cross-sectional shape of the electron beam passageway 92 may be hexagon or circle, so that the trimming portion 9 may be formed into a honeycomb structure.

Furthermore, although the front panel 1 has a circular shape when viewed from the Z-axis direction in the embodiment described above, the present invention is not limited to this. For example, the front panel 1 may have a quadrangular shape.

Also, although the mesh structure 8 is placed on the semiconductor substrate 6 on which the field-emission electron source array 10 is formed in the embodiment described above, the present invention is not limited to this. For example, it also may be possible to form a field-emission electron source array of the Spindt type or the like directly on the back panel 5 by a semiconductor processing technique and place the mesh structure 8 on the back panel 5 on which the field-emission electron source array is formed.

Moreover, in the embodiment described above, assuming the VGA-compatible field-emission electron source apparatus, the dimension of each cell in the field-emission electron source array is set to about 20 μm long on each side, and the dimensions of individual members adapted thereto are illustrated, though there is no particular limitation to this. For example, in an SVGA or SXGA-compatible field-emission electron source apparatus, the size of each cell is smaller than the above, and thus, the dimensions of other members also have to be reduced accordingly.

Also, although the embodiment described above has illustrated the example in which the cells in the field-emission electron source array and the through holes 90 in the mesh structure 8 are in one-to-one correspondence with each other, the present invention is not limited to this. For example, one through hole 90 in the mesh structure 8 may correspond to a plurality of the cells in the field-emission electron source array. For instance, one through hole 90 in the mesh structure 8 can be brought into correspondence with four cells consisting of two along the longitudinal direction and two along the transverse direction. In this case, the center of the opening 91 of the through hole 90 corresponding to the cell is displaced slightly from a straight line that passes through the center of this cell and is parallel with the Z axis. Therefore, a partial electron beam traveling slightly obliquely with respect to the Z axis in the electron beam emitted from the selected cell enters the through hole 90 and reaches the target 3. Accordingly, a driving method has to be selected carefully.

Further, the voltages to be applied to the individual members indicated in the embodiment described above merely are illustrative examples. It is needless to say that the optimal values vary depending on the use of the field-emission electron source apparatus, the sizes of the individual members and the like and have to be changed suitably.

As described above, in the field-emission electron source apparatus including the field-emission electron source array and the target performing a beneficial operation in Embodiment 1 of the present invention, the mesh structure 8 that has the electron beam passageway 92 whose length is sufficiently larger than the diameter of the opening 91 of the through hole 90 and is formed of a silicon-containing material is disposed between the field-emission electron source array and the target. In the divergent electron beam emitted from the selected cell in the field-emission electron source, the partial electron beam entering the through holes 90 other than the through hole 90 arranged on the straight line that passes through the center of the selected cell and is parallel with the Z axis impacts on and is absorbed and removed effectively by the lateral walls of the electron beam passageways 92 of the mesh structure. By the trimming effect of the mesh structure 8, only the electron beam traveling toward the target 3 while having a velocity vector in parallel with the Z-axis direction is taken out selectively from the electron beam emitted from the selected cell. Therefore, it is possible to reduce the divergence of the electron beam leaving the mesh structure 8. As a result, the spot diameter of the electron beam reaching the target 3 is reduced, thereby achieving a high-definition field-emission electron source apparatus.

Also, by producing the mesh structure 8 by a fine processing technology used in the semiconductor production, it is possible to achieve a field-emission electron source apparatus with a high accuracy and less variation. Further, since the mesh structure 8 is produced using a silicon substrate similarly to the semiconductor substrate 6, a heating temperature in the production process can be raised, allowing sufficient degassing. Therefore, it is possible to achieve a field-emission electron source apparatus that has less gas emission and a high reliability in withstand voltage characteristics.

Moreover, the fact that the mesh structure according to Embodiment 1 of the present invention can be produced using a silicon substrate by the MEMS technique, which is the semiconductor processing technology, allows a plurality of through holes to be formed in the mesh structure so as to be distributed uniformly in a highly accurate manner. Thus, without causing the problem of the shape or size of the through holes differing between the central portion and the peripheral portion when fixed to the field-emission electron source apparatus under a tension as seen in the conventional mesh structure made of metal (for example, a copper mesh), it is possible to provide a mesh structure in which the amount of the electron beam reaching the target can be made uniform regardless of the position on the target when used in the field-emission electron source apparatus.

The mesh structure formed of a material containing silicon having a crystal structure described in Embodiment 1 of the present invention also can be used for applications other than the field-emission electron source apparatus.

For example, by making the thickness of the mesh structure sufficiently larger than the diameter of the through holes, the mesh structure can be used as a collimator that allows atoms, molecules, light or the like to pass from one surface to the other surface, thus providing their traveling direction with directivity.

Alternatively, for example, by adjusting the diameter of the through holes in the mesh structure, the mesh structure can be used as a particle filter for screening particles by particle diameter.

In other words, in the mesh structure that has a plurality of through holes formed one-dimensionally and is capable of passing sensible substances such as light, electrons, atoms, ions or molecules through the through holes from one surface to the other surface, this mesh structure is formed of the material containing silicon having a crystal structure, whereby it becomes possible to process through holes using a fine processing technology for semiconductors. Accordingly, the shape and diameter of the through holes in the mesh structure can be controlled in a highly accurate manner. Thus, for example, a function of filtering particles with the through holes can be achieved easily.

Also, using the fine processing technology of semiconductors, the mesh structure can be provided with through holes whose depth is larger than their diameter easily. Therefore, it is possible to produce a mesh structure having a filter function of screening particles and a mesh structure having a collimator function of providing the traveling direction of atoms, molecules, light or the like with directivity at a low cost.

Furthermore, since a high-purity silicon plate used for semiconductors can be used, it is possible to achieve a mesh structure having a collimator function of providing atoms, molecules, electrons or the like with directivity easily without any concern about gas emission in a vacuum.

Also, the thickness of a partition wall for separating the plurality of through holes is made smaller than the opening diameter of the through holes, whereby the areal ratio of openings (opening ratio) of the through holes with respect to the surface of the mesh structure can be raised. Therefore, in the case where the mesh structure is used as the collimator for providing atoms, molecules, electrons, light or the like with directivity, it is possible to provide a collimator achieving a large ratio of the amount of atoms, molecules, electrons, light or the like on the exit side with respect to the amount thereof on the incident side (passage ratio).

In this case, in order to achieve a uniform passage ratio regardless of the position, it is preferable that the opening diameter of the plurality of through holes is uniform and that the plurality of through holes are arranged regularly.

In the present invention, it is preferable that the thickness of the partition wall for separating the plurality of through holes and the opening diameter of the through holes are defined in a cross-section including the central axis of a through hole and the central axis of another through hole closest to that through hole.

Embodiment 2

Figure 12:
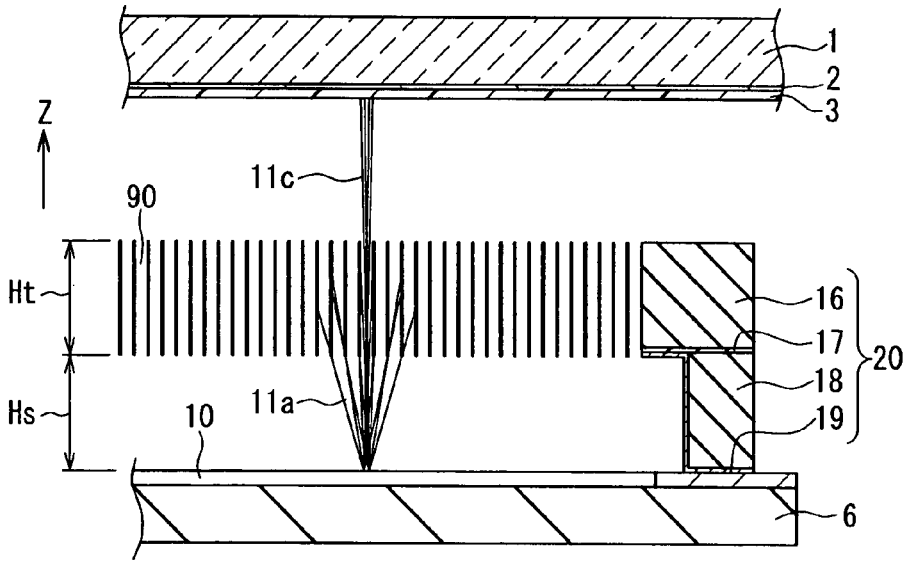
FIG. 12 is a sectional view showing a mesh structure and a field-emission electron source apparatus including the mesh structure according to Embodiment 2 of the present invention.

FIG. 12 is a sectional view showing a mesh structure and a field-emission electron source apparatus including the mesh structure according to Embodiment 2 of the present invention.

As shown in FIG. 12, the field-emission electron source apparatus according to Embodiment 2 of the present invention is different from that according to Embodiment 1 in that a mesh structure 20 has a three-layer structure unlike the mesh structure 8. In the following, the description of portions that are the same as those in Embodiment 1 will be omitted.

As shown in FIGS. 12, 13, 14A and 14B, the mesh structure 20 according to Embodiment 2 of the present invention has the three-layer structure including a first electrode layer 19 on a side of the field-emission electron source array, a second electrode layer 16 on a side of the target 3 and an insulating layer (intermediate layer) 17 therebetween. The insulating layer 17 ensures the insulation between the first electrode layer 19 and the second electrode layer 16.

This mesh structure 20 is produced using a silicon substrate by a semiconductor technology. Referring to FIGS. 15A to 15D, an exemplary method for manufacturing the mesh structure 20 will be described. As an example, exemplary numerical values of a field-emission electron source apparatus in which each of the cells in a field-emission electron source array has about 20-μm-square size and the region in a single cell where a large number of electron sources are aligned has about 10-μm-square size will be mentioned as well. However, these exemplary numerical values are merely illustrative and need to be changed suitably with varying diameter of the opening 91, distance from the field-emission electron source array to the through hole 90 in the trimming portion 9, size of the region in a single cell in the field-emission electron source array in which a large number of the electron sources are aligned, etc.

Figure 15A:
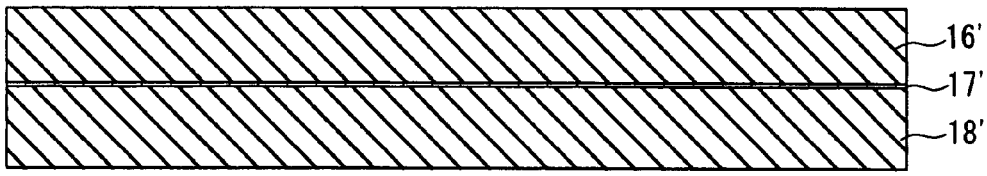
FIGS. 15A to 15D are sectional views showing processes in a method for manufacturing the mesh structure used in the field-emission electron source apparatus according to Embodiment 2 of the present invention.

First, as shown in FIG. 15A, an SOI substrate having an oxide film ($SiO_2$ film) 17', which is to be the insulating layer 17 as the intermediate layer, and silicon layers 16' and 18' with a predetermined thickness on both sides of the oxide film 17' is prepared.

In one example, the thickness of the silicon layer 16' to be the trimming portion 9 can be set to about 100 μm, and the thickness of the silicon layer 18' to be a spacer portion 18 can be set to about 90 μm. The thickness of the oxide film 17' preferably is 0.5 to 3 μm and, for securing a withstand voltage and etching the silicon layers 16' and 18' and the oxide film 17' in an excellent manner, optimally is about 2 μm.

The silicon layer 16' is to be the second electrode layer 16, and pre-doped with a N-type or P-type material so as to have a low resistance so that the function of the second electrode layer 16 is provided.

Figure 15B:
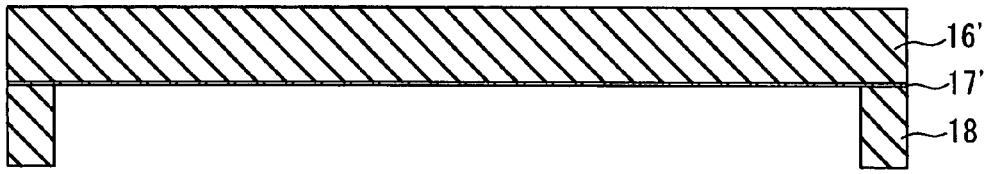

Next, as shown in FIG. 15B, only a central portion of the silicon layer 18' of the SOI substrate is removed by etching, thereby reducing the thickness of the central portion of the SOI substrate. In this way, the silicon layer 18' remains only in a peripheral portion of the SOI substrate and serves as the spacer portion 18.

Figure 15C:
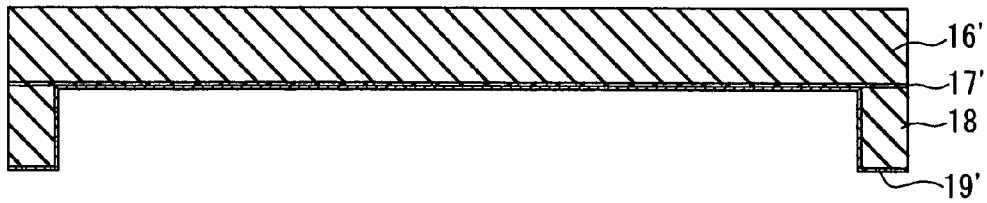

Subsequently, as shown in FIG. 15C, a metal such as aluminum, gold, copper, tantalum, molybdenum or titanium is deposited on a surface on the side of the silicon layer 18' by vacuum deposition, sputtering, CVD or the like, thereby forming a metal thin film 19' to be the first electrode layer 19.

Figure 15D:
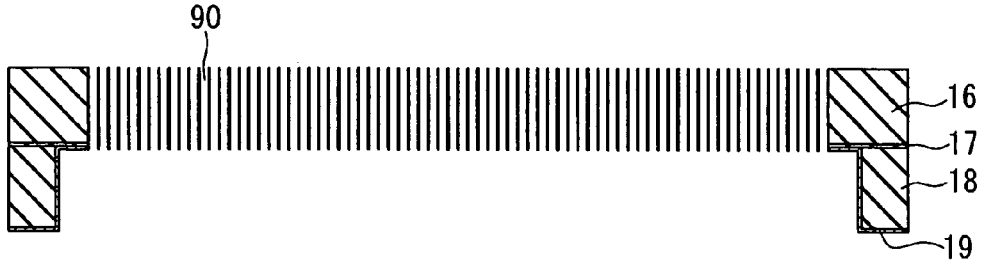

Thereafter, as shown in FIG. 15D, the through holes 90 are formed from the side of the silicon layer 16' by an etching technique. In this way, the first electrode layer 19 formed of the metal thin film 19', the insulating layer 17 formed of the oxide film 17' and the second electrode layer 16 formed of the silicon layer 16' are formed.

Figure 13:
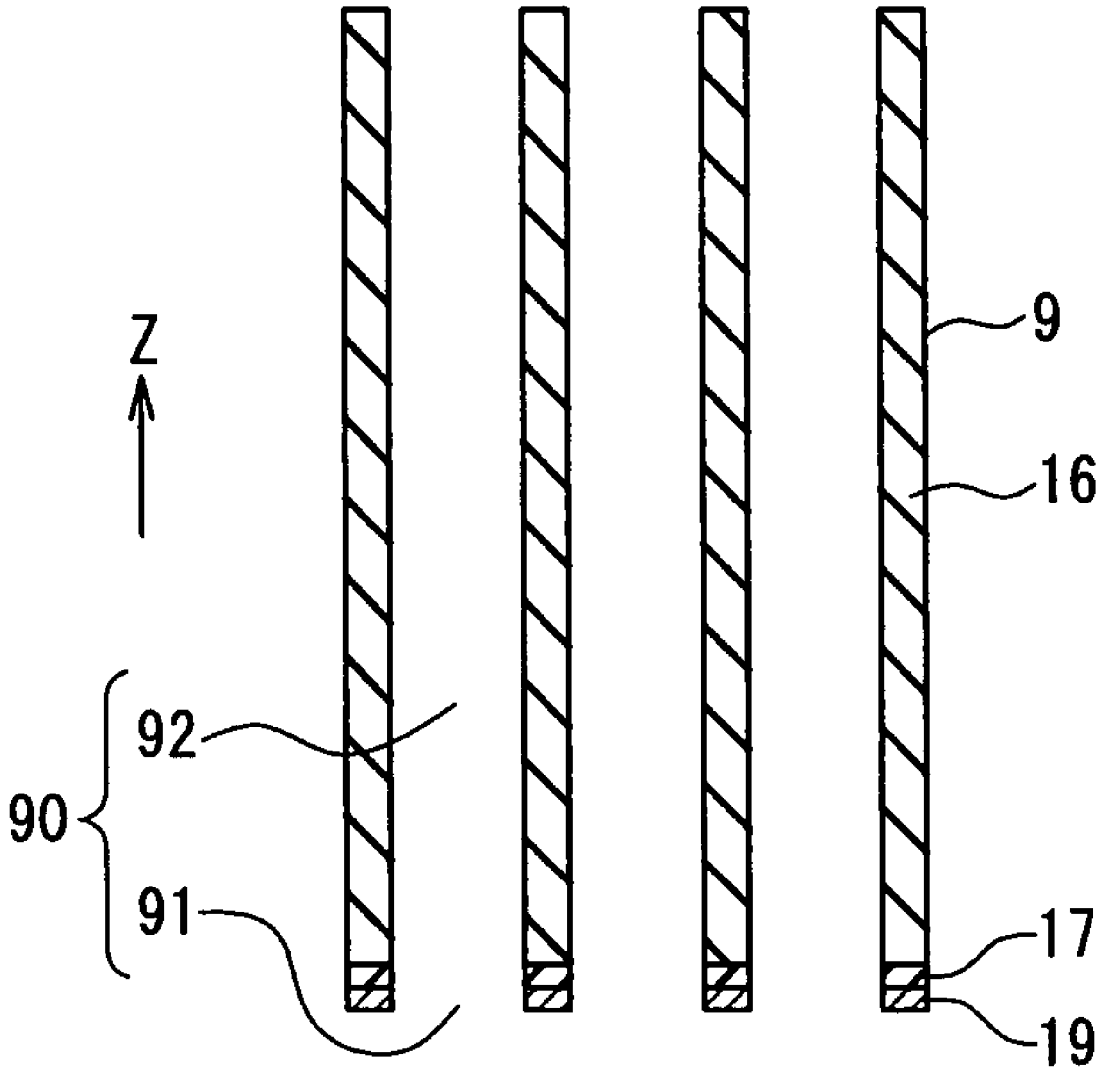
FIG. 13 is a partially enlarged sectional view taken along a thickness direction showing a trimming portion of the mesh structure used in the field-emission electron source apparatus according to Embodiment 2 of the present invention.
Figure 16A:
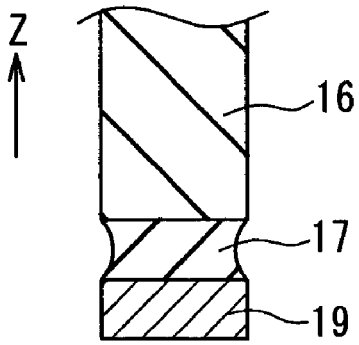
FIGS. 16A to 16C are enlarged sectional views each showing an exemplary shape near an opening on a field-emission electron source array side of a through hole of the mesh structure used in the field-emission electron source apparatus according to Embodiment 2 of the present invention.
Figure 16B:
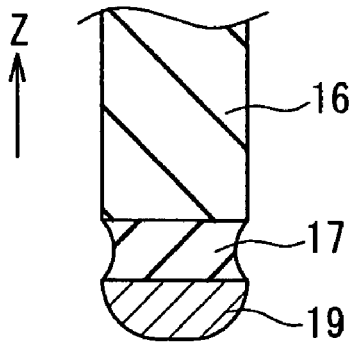
Figure 16C:
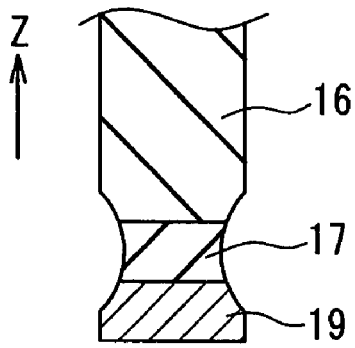

At the time of forming the through holes 90, a portion around the opening 91 of the through hole 90 on the side of the field-emission electron source array may have shapes shown in FIGS. 16A to 16C instead of the desired shape shown in FIG. 13 depending on the difference in characteristics of the individual layers to be etched. However, there is no substantial difference in function as the trimming portion 9 between these shapes.

An excessively thick metal thin film 19' formed in FIG. 15C makes it difficult to form the through holes 90 at the time of etching in FIG. 15D. An excessively thin metal thin film 19' diminishes the effect of leading an electron beam from the field-emission electron source array to the inside of the openings 91 of the through holes 90. Thus, there is an optimal value of the thickness of the metal thin film 19'. In the example described above, it is preferred that the metal thin film 19' (the first electrode layer 19) has a thickness of about 2 μm.

Since the mesh structure 20 is processed using the SOI substrate in this manner and the first electrode layer 19 is formed as described above, Embodiment 2 of the present invention has an advantage in that the mesh structure can be produced at lower cost in addition to the advantage mentioned in Embodiment 1.

The method for producing the mesh structure 20 is not limited to the above.

For example, the process of FIG. 15D for forming the through holes 90 may be carried out after that of FIG. 15A and before that of FIG. 15B. Also, using a silicon substrate instead of the SOI substrate, an oxidation treatment may be performed midway through the production processes, thereby forming an $SiO_2$ film.

The mesh structure 20 thus produced is placed on and fixed to the semiconductor substrate 6 provided with the field-emission electron source array 10 via the spacer portion 18 that is formed as one piece with the mesh structure 20. Then, the first electrode layer 19 of the mesh structure 20 is supplied with a first voltage V1, for example, a middle voltage of about 150 to 500 V via the semiconductor substrate 6, and the second electrode layer 16 is supplied with a second voltage V2, for example, a low voltage of about 50 to 200 V via a voltage supply wire that is provided separately.

In the selected cell in the field-emission electron source array, a plurality of the cold cathode elements 15 (see FIG. 6) in this selected cell are supplied with a pulsed emitter potential that drops from a reference potential of 50 V to 0 V, for example, and the gate electrodes 12 (see FIG. 6) are supplied with a pulsed gate potential that rises from a reference potential of 50 V to 100 V, for example.

The electron beam 11*a* emitted from the selected cell is accelerated by the first voltage V1, which is a middle voltage of about 150 to 500 V applied to the first electrode layer 19 in the mesh structure 20, and enters the mesh structure 20 while being modified so that its traveling direction is turned to parallel with the Z axis.

As shown in FIG. 12, the electron beam 11*a* emitted from the selected cell enters not only the through hole 90 located on the straight line that passes through the center of this selected cell and is parallel with the Z axis but also the through holes 90 located around this through hole 90.

After entering the through holes 90 in the mesh structure 20, the electron beam accelerated by the first electrode layer 19 is decelerated suddenly by the second voltage V2 of about 50 to 200 V, which is applied to the second electrode layer 16 and lower than the first voltage V1 of the first electrode layer 19.

The sudden deceleration of the electron beam decreases a velocity component of the electron beam in the Z-axis direction and relatively increases that in a direction perpendicular to the Z axis. Thus, the electron beam becomes more likely to impact on the lateral wall of the electron beam passageway 92 in the region of the second electrode layer 16.

In order to allow the electron beam to impact on the lateral wall of the electron beam passageway 92 effectively in the region of the second electrode layer 16, it is preferable to satisfy $T1 \ll T2$, where T1 indicates the length of the first electrode layer 19 in the length of the electron beam passageway 92 and T2 indicates the length of the second electrode layer 16 therein. More specifically, it is preferable to satisfy $T2/T1 \geqq 50$. In other words, it is preferable that a deceleration electric field generated by the second electrode layer 16 is arranged in a region close to the field-emission electron source array in the electron beam passageway 92. However, even if $T1 > T2$, it is possible to allow the electron beam to impact on the lateral wall of the electron beam passageway 92 in the region of the second electrode layer 16, though to a lesser extent.

In this way, in Embodiment 2 of the present invention, the electron beam that has entered obliquely with respect to the longitudinal direction of the electron beam passageway 92 (the Z-axis direction) impacts on the lateral wall and is absorbed and removed at an earlier stage after entering the electron beam passageway 92 compared with Embodiment 1.

Therefore, compared with Embodiment 1, Embodiment 2 of the present invention can enhance the trimming effect in which the electron beam 11*a* that has entered through holes other than the through hole corresponding to the selected cell is absorbed and removed by the lateral walls of the electron beam passageways 92 of these through holes, allowing only the electron beam 11*a* that has entered the through hole corresponding to the selected cell to reach the target 3.

Thus, compared with Embodiment 1, Embodiment 2 of the present invention makes it possible to display a higher-definition image in a field-emission electron source display apparatus in which the target is provided with a phosphor, and to capture a higher-definition image in a field-emission electron source imaging apparatus in which the target is provided with a photoelectric conversion film.

Also, in Embodiment 2 of the present invention, even if the distance from the field-emission electron source array to the target varies from a designed value due to assembly variations or atmospheric pressure, the variation in the size of the electron beam spot on the target 3 can be suppressed further compared with Embodiment 1. Thus, it is possible to provide a field-emission electron source display apparatus capable of displaying a still more uniform quality image and a field-emission electron source imaging apparatus capable of capturing a still more uniform quality image.

Further, in Embodiment 2 of the present invention, since the trimming effect is enhanced by varying the velocity vector of the electron beam that has entered the mesh structure 20, it is possible to reduce the thickness Ht of the trimming portion 9 of the mesh structure compared with Embodiment 1. Accordingly, compared with Embodiment 1, the amount of the electron beam passing through the through hole 90 corresponding to the selected cell and reaching the target 3 can be increased, thus making it easier to secure the amount of the electron beam needed in the target 3.

FIGS. 17A, 17B, 18A and 18B show simulation results in the field-emission electron source apparatus according to Embodiment 2 of the present invention.

Figure 17A:
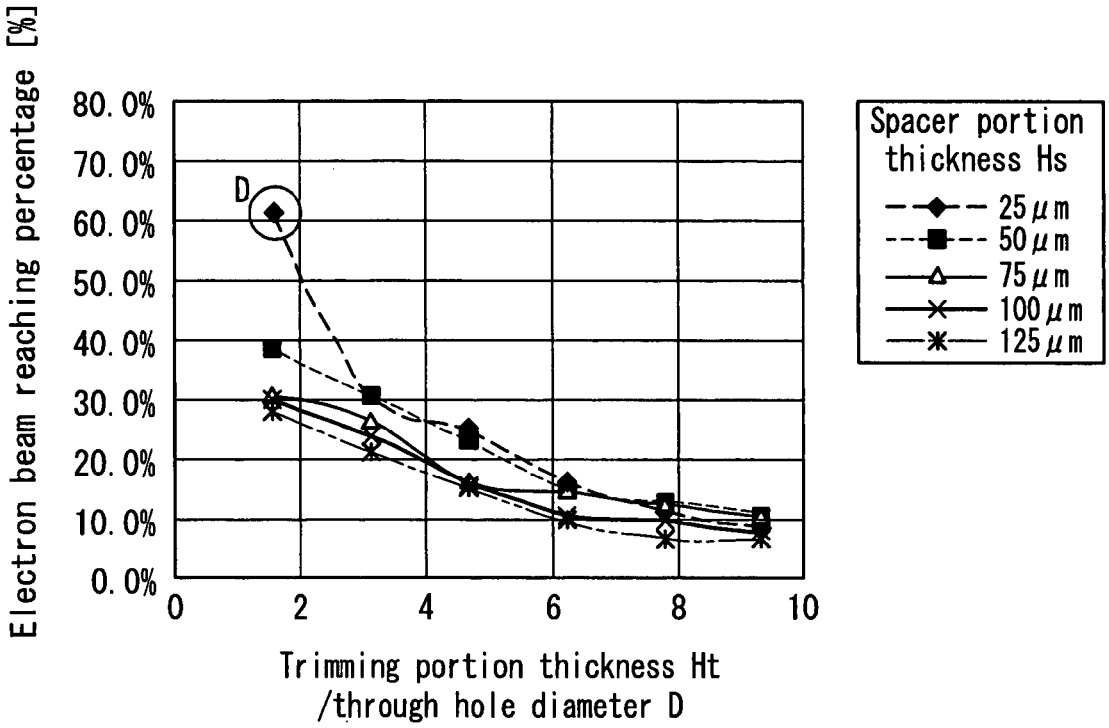
FIGS. 17A and 17B show simulation results in the field-emission electron source apparatus according to Embodiment 2 of the present invention.
Figure 17B:
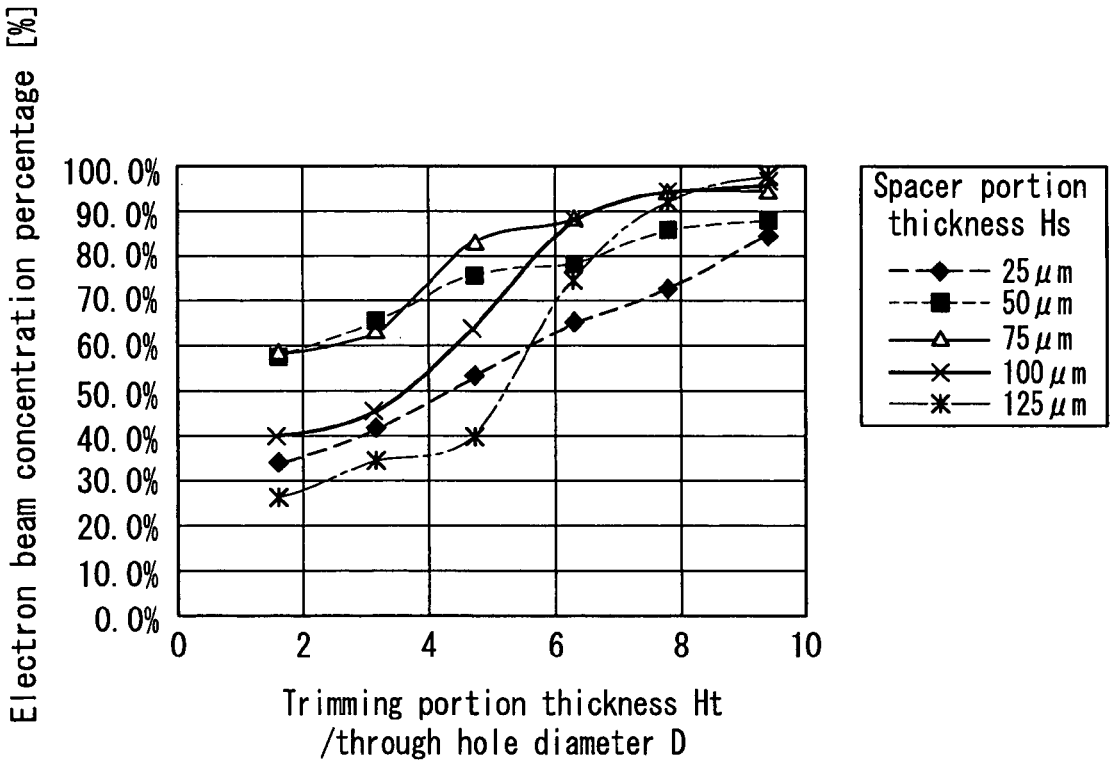
Figure 18A:
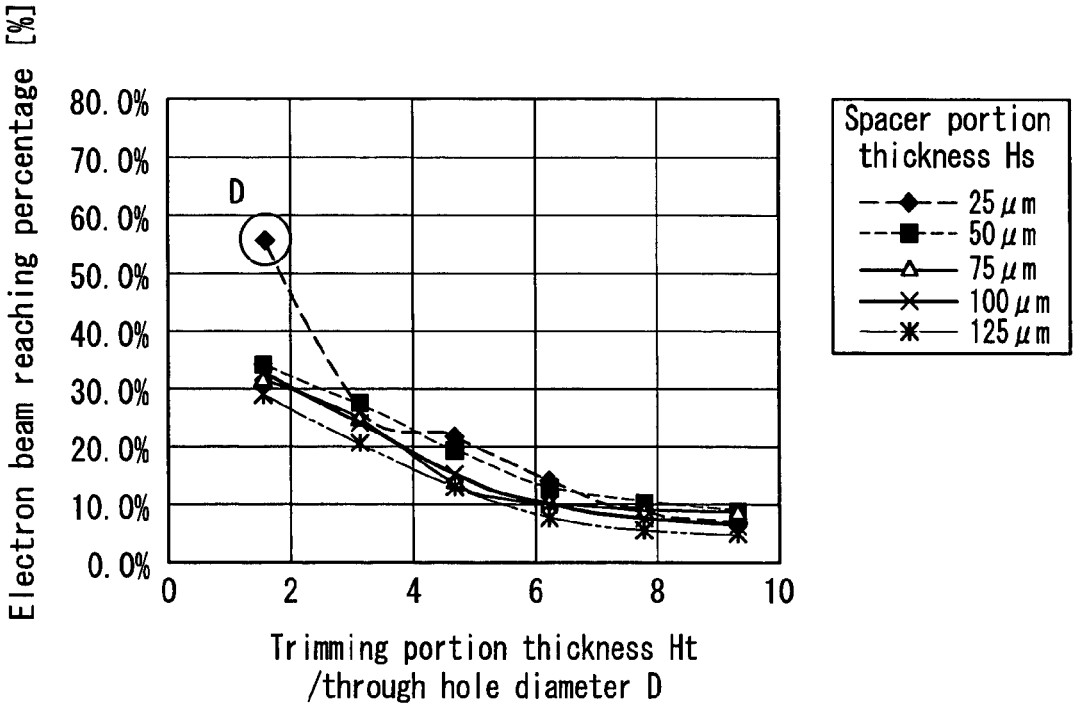
FIGS. 18A and 18B show simulation results in the field-emission electron source apparatus according to Embodiment 2 of the present invention.
Figure 18B:
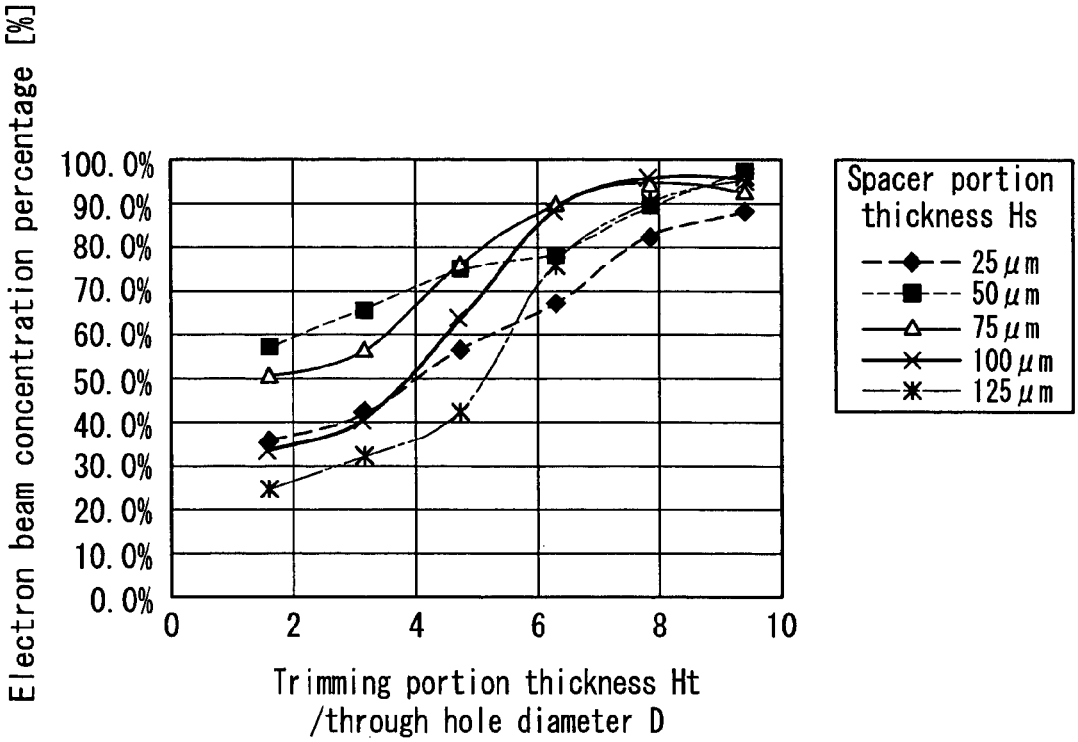

FIGS. 17A and 17B show the case of applying a voltage of 300 V to the first electrode layer 19 in the mesh structure 20 and a voltage of 100 V to the second electrode layer 16 therein, and FIGS. 18A and 18B show the case of applying a voltage of 225 V to the first electrode layer 19 in the mesh structure 20 and a voltage of 75 V to the second electrode layer 16 therein.

The simulation was carried out with respect to the VGA-compatible field-emission electron source apparatus in which each cell size was 20 μm long on each side, the opening 91 of the through hole 90 in the mesh structure 20 had a shape of a 16-μm-square and the distance from the mesh structure 20 to the target 3 was 150 μm, similarly to the above-described simulation in Embodiment 1.

The first electrode layer 19 was set to have a thickness of 2 μm, and the insulating layer 17 was set to have a thickness of 2 μm. The thickness Hs of the spacer portion 18*a* (namely, the distance from the field-emission electron source array to the opening 91 of the through hole 90 in the trimming portion 9) was changed from 25 μm to 125 μm in increments of 25 μm. In each thickness of the spacer portion 18*a*, the thickness Ht of the trimming portion 9 was changed from 25 μm to 150 μm in increments of 25 μm by changing the thickness of the second electrode layer 16.

FIGS. 17A and 18A are graphs showing the results of calculating the percentage (unit: %) of the partial electron beam of the electron beam emitted from the selected cell passing through the mesh structure 20 and reaching the target 3. The horizontal axis indicates a value obtained by normalizing the thickness Ht of the trimming portion 9 by the diameter D (=16 μm) of the through hole 90 of the mesh structure 20, and the vertical axis indicates the percentage of the partial electron beam reaching the target 3 in the electron beam emitted from the selected cell (electron beam reaching percentage; unit: %).

FIGS. 17B and 18B are graphs showing the results of calculating the percentage (unit: %) of the partial electron beam reaching a 40-μm-square region whose center corresponds to a point at which a straight line that passes through the center of the selected cell and is parallel with the Z axis crosses the target 3 in the electron beam emitted from the selected cell. The horizontal axis indicates a value obtained by normalizing the thickness Ht of the trimming portion 9 by the diameter D (=16 μm) of the through hole 90 of the mesh structure 20, and the vertical axis indicates the percentage of the partial electron beam of the electron beam emitted from the selected cell reaching the above-noted region in the target 3 (electron beam concentration percentage; unit: %).

Although the simulation was carried out with respect to the field-emission electron source imaging apparatus in which the target 3 is provided with a photoelectric conversion film, the case of a field-emission electron source display apparatus in which the target 3 is provided with a phosphor was similar to the above except for a voltage to be applied to the target 3. Thus, for the percentage of the electron beam passing through the mesh structure 20 and reaching the target 3, the same calculation results as shown in FIGS. 17A and 18A are obtained in the case of the field-emission electron source display apparatus. For the percentage of electron beam reaching the predetermined region on the target 3, the voltage of the target 3 in the case of the field-emission electron source display apparatus is higher than that in the case of the field-emission electron source imaging apparatus, so that the percentage of the electron beam reaching the predetermined region on the target 3 is higher than that in the case illustrated by FIGS. 17B and 18B.

Compared with FIGS. 8A and 9A shown in Embodiment 1, FIGS. 17A and 18A show a decreased percentage of the electron beam reaching the target 3. This means that, compared with Embodiment 1, the trimming portion 9 achieved an improved capability of absorbing and removing an electron beam in Embodiment 2 of the present invention.

Also, compared with FIGS. 8B and 9B shown in Embodiment 1, FIGS. 17B and 18B show an increased percentage of the electron beam reaching the predetermined region on the target 3. In particular, an electron beam concentration percentage increased considerably when the ratio of the thickness Ht of the trimming portion 9 to the diameter D of the through hole 90 (the ratio Ht/D) was at least 3 and further at least 4.

The results of the simulation show that, as described above, by forming the mesh structure to have a three-layer structure and setting the second voltage V2 of the second electrode layer 16 to be lower than the first voltage V1 of the first electrode layer 19 so as to decelerate the electron beam in the electron beam passageway 92, it is possible to increase the effect of allowing the electron beam to impact on and be absorbed and removed by the lateral walls of the electron beam passageways 92.

From these simulation results, the preferred range of the thickness Ht of the trimming portion 9 in Embodiment 2 will be discussed. The minimum value of the thickness Ht of the trimming portion 9 that can reduce the percentage of the electron beam passing through the mesh structure 8 in the electron beam emitted from the selected cell to equal to or smaller than 43.7% as described in Embodiment 1 is smaller than that in Embodiment 1. Also, the maximum value of the thickness Ht of the trimming portion 9 that can raise the percentage of the electron beam reaching the target 3 in the electron beam emitted from the selected cell to equal to or larger than 5% is substantially the same as that in Embodiment 1 (see FIGS. 17A and 18A).

From FIGS. 17B and 18B, it is appropriate that the ratio Ht/D is equal to or larger than 1.5 in order to allow at least 40% of the electron beam emitted from the selected cell to reach the 40-μm-square region on the target 3. For achieving a still higher resolution by allowing at least 40% of the electron beam emitted from the selected cell to reach the above-noted region on the target 3, it is appropriate that the ratio Ht/D is equal to or larger than 4. The ratio Ht/D equal to or larger than 6 allows at least 90% of the electron beam emitted from the selected cell to reach the above-noted region on the target 3.

In the above-described simulation in Embodiment 2, the first electrode layer 19 was set to have a thickness of 2 μm, and the insulating layer 17 was set to have a thickness of 2 μm. When a similar simulation was carried out while changing the thicknesses of the first electrode layer 19 and the insulating layer 17 to 3 μm, 2 μm, 1 μm, 0.5 μm, etc., qualitatively similar results were obtained.

As described above, in Embodiment 2 of the present invention, by forming the mesh structure 20 formed of the silicon-containing material to have a three-layer structure, accelerating the electron beam 11*a* emitted from the field-emission electron source array by the first voltage V1 of the first electrode layer 19 on the side of the field-emission electron source array so as to allow it to enter the through holes 90 in the mesh structure 20 and decelerating it by the second voltage V2 of the second electrode layer 16 on the side of the target 3, the path of the electron beam is bent in the electron beam passageway 92, so that the trimming effect can be achieved more effectively. Thus, it is possible to reduce the divergence of the electron beam leaving the mesh structure 20 compared with Embodiment 1. As a result, the spot diameter of the electron beam on the target 3 is reduced, thus achieving a field-emission electron source apparatus with a higher definition than Embodiment 1.

Alternatively, when it is sufficient to achieve the trimming effect substantially at the same level as Embodiment 1, the thickness Ht of the trimming portion 9 in the mesh structure 20 can be reduced. Consequently, it is possible to increase the amount of the electron beam reaching the target 3 compared with Embodiment 1. This increases the brightness in a field-emission electron source display apparatus in which the target is provided with a phosphor, and reduces persistent images in a field-emission electron source imaging apparatus in which the target is provided with a photoelectric conversion film.

Embodiment 3

Figure 19:
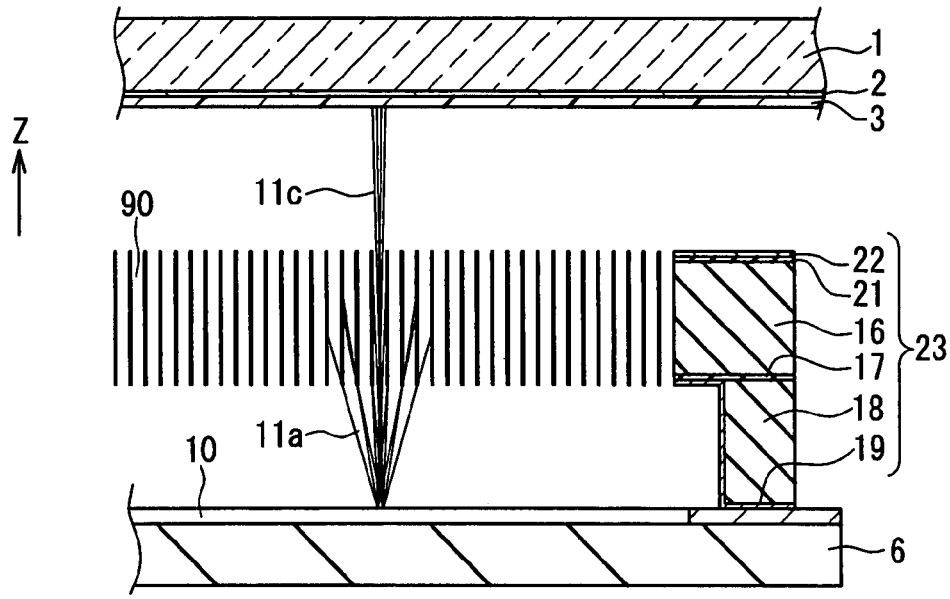
FIG. 19 is a sectional view showing a mesh structure and a field-emission electron source apparatus including the mesh structure according to Embodiment 3 of the present invention.

FIG. 19 is a sectional view showing a mesh structure and a field-emission electron source apparatus including the mesh structure according to Embodiment 3 of the present invention.

As shown in FIG. 19, the field-emission electron source apparatus according to Embodiment 3 of the present invention is different from those according to Embodiments 1 and 2 in that a mesh structure 23 has a five-layer structure unlike the mesh structure 8 in Embodiment 1 and the mesh structure 20 in Embodiment 2. In the following, the description of portions that are the same as those in Embodiments 1 and 2 will be omitted.

Figure 20:
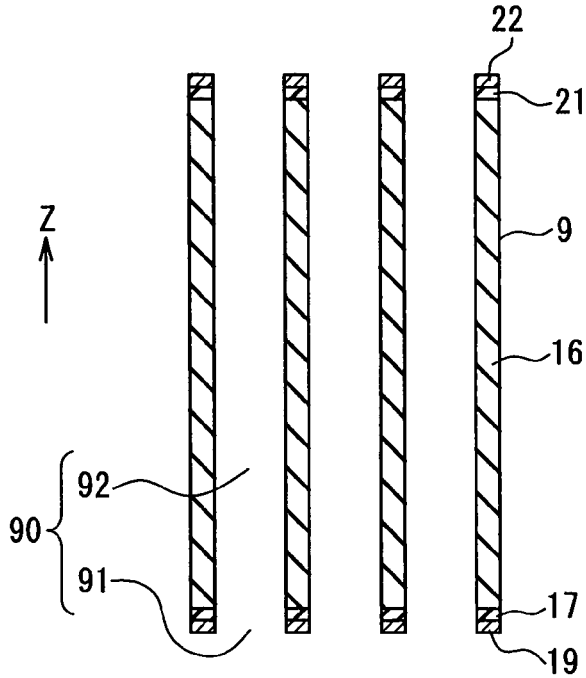
FIG. 20 is a partially enlarged sectional view taken along a thickness direction showing a trimming portion of the mesh structure used in the field-emission electron source apparatus according to Embodiment 3 of the present invention.

As shown in FIGS. 19 and 20, the mesh structure 23 formed of the silicon-containing material according to Embodiment 3 of the present invention is obtained by providing a second insulating layer 21 and a third electrode layer 22 in this order on the surface of the mesh structure 20 on the side of the target 3 in Embodiment 2. The third electrode layer 22 is supplied with a third voltage V3 that is not very different from the second voltage V2 applied to the second electrode layer 16.

In one example, the third electrode layer 22 can be set to have a thickness of about 2 μm, which is the same as the first electrode layer 19, and the second insulating layer 21 between the second electrode layer 16 and the third electrode layer 22 also can be set to have a thickness of about 2 μm.

As described in Embodiment 2, the electron beam 11*a* that has entered the through hole 90 in the mesh structure 23 passes through the first electrode layer 19 and the second electrode layer 16, thereby impacting on and being absorbed and removed by the lateral wall of the electron beam passageway 92 effectively. The partial electron beam that has not been absorbed and removed is subjected to a fine adjustment of its divergence angle by the third voltage V3 applied to the third electrode layer 22, and then leaves the through hole 90 and reaches the target 3. In this way, an excellent electron beam spot can be formed on the target 3.

According to results of simulation performed with respect to a field-emission electron source imaging apparatus in which the target 3 was provided with a photoelectric conversion film, it was confirmed that the spot diameter of the electron beam on the target 3 could be made still smaller than that in Embodiment 2 by setting V2>V3 in a state where the potential of the target 3 stabilized at the emitter potential after reading out one frame. At this time, the amount of the electron beam passing through the mesh structure 23 and reaching the target 3 decreased slightly.

In the field-emission electron source display apparatus in which the target is provided with a phosphor, since the potential of the target 3 is higher than the second voltage V2, it is possible to form a better electron beam spot on the target 3 if V2<V3 is set.

As described above, Embodiment 3 of the present invention uses the five-layer mesh structure 23 obtained by providing the third electrode layer 22 for final adjustment of the electron beam on the mesh structure 20 in Embodiment 2 on the side of the target 3. This makes it possible to reduce the divergence of the electron beam leaving the mesh structure 23 compared with Embodiment 2. Consequently, not only can the same effect as that in Embodiment 2 be obtained, but also it is possible to achieve a field-emission electron source apparatus achieving a higher definition than that in Embodiment 2 because the spot diameter of the electron beam reaching the target 3 becomes still smaller.

Embodiment 4

Figure 21:
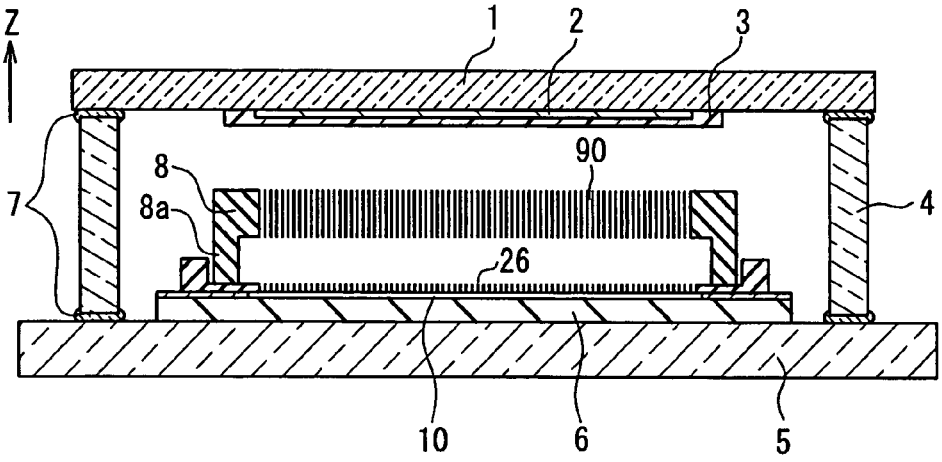
FIG. 21 is a sectional view showing a mesh structure and a field-emission electron source apparatus including the mesh structure according to Embodiment 4 of the present invention.

FIG. 21 is a sectional view showing a mesh structure and a field-emission electron source apparatus including the mesh structure according to Embodiment 4 of the present invention.

As shown in FIG. 21, the field-emission electron source apparatus according to Embodiment 4 of the present invention is different from that according to Embodiment 1 in that a focusing electrode 26 for pre-focusing is provided between the field-emission electron source array 10 and the mesh structure 8 formed of a silicon-containing material. In the following, the description of portions that are the same as those in Embodiment 1 will be omitted.

The focusing electrode 26 includes a plurality of cylinders that have openings at respective positions of the plurality of cells arranged in a matrix in the field-emission electron source array 10 and surround the respective cells. The focusing electrode 26 is supplied with a voltage lower than the voltage applied to the portion of the mesh structure 8 on the side of the field-emission electron source array 10. This forms an electric field extending from the mesh structure 8 into the cylinders of the focusing electrode 26.

The electron beam emitted from the cell of the field-emission electron source array 10 is pre-focused by the electric field formed in the cylinder of the focusing electrode 26 and then leaves for the mesh structure 8. Since the electron beam is pre-focused by the focusing electrode 26, the divergence angle of the electron beam leaving the focusing electrode 26 is smaller than that in the case of providing no focusing electrode 26. Thus, the electron beam having a velocity vector that forms a small angle with the Z-axis direction (the longitudinal direction of the electron beam passageway 92) increases, so that the amount of the electron beam passing through the mesh structure 8 increases. Therefore, the amount of the electron beam entering the through hole 90 corresponding to the selected cell increases. As a result, compared with the case of providing no focusing electrode 26, the amount of the electron beam reaching the target 3 increases, and the spot diameter of the electron beam on the target 3 decreases.

As described above, in Embodiment 4 of the present invention, the electron beam emitted from the field-emission electron source array 10 is pre-focused by the focusing electrode 26 before entering the mesh structure 8. This can increase the amount of the electron beam reaching the target 3 and reduce the spot diameter of the electron beam on the target 3 compared with Embodiment 1. Accordingly, it is possible to provide a field-emission electron source display apparatus with a high brightness and a high definition and a field-emission electron source imaging apparatus with fewer persistent images and a high definition.

Although the example described above has illustrated the focusing electrode having a single electrode, the present invention is not limited to this. For example, the focusing electrode also may have a plurality of electrodes in the Z-axis direction. By applying different voltages to the individual electrodes, it is possible to form an electric field for pre-focusing in the focusing electrode. In this case, the voltage to be applied to the electrode that is closest to the mesh structure may be lower than or equal to that applied to the portion of the mesh structure 8 on the side of the focusing electrode. The application of equal voltages has an advantage in that a common supply voltage circuit can be used.

Although the field-emission electron source apparatus illustrated in Embodiment 1 is provided with the focusing electrode in the example described above, the present invention is not limited to this. It is possible to provide the focusing electrode described in the present embodiment in any of the field-emission electron source apparatuses described above or below, thereby achieving an effect similar to that described above.

Embodiment 5

Referring to FIG. 12, a mesh structure and a field-emission electron source apparatus including the mesh structure according to Embodiment 5 of the present invention will be described.

Embodiment 5 of the present invention is different from Embodiment 2 in that one or both of the first voltage V1 to be applied to the first electrode layer 19 in the mesh structure 20 formed of a silicon-containing material and the second voltage V2 to be applied to the second electrode layer 16 therein is changed while driving the field-emission electron source apparatus. In the following, the description of portions that are the same as those in Embodiment 2 will be omitted.

Accordingly, the present embodiment allows an effective imaging operation particularly in a field-emission electron source imaging apparatus in which the target is provided with a photoelectric conversion film.

In other words, in the field-emission electron source imaging apparatus in which the target 3 is provided with a photoelectric conversion film, the amount of electron-hole pairs generated by an image formed by light incident on the target 3 is determined by the intensity of the incident light. More electron-hole pairs are generated with an increase in the intensity of the incident light. In the generated electron-hole pairs, the positive holes are transported (transported while being multiplied in the case of an avalanche-multiplier-type photoelectric conversion film using selenium) to an electronic scanning surface, which is a surface of the target 3 on the side of the field-emission electron source array 10, and then accumulated therein.

When the target 3 is scanned by an electron beam 11*c* emitted from the field-emission electron source array 10, the accumulated positive holes combine with electrons contained in the electron beam, and at the same time, an electric signal is read out. Here, if sufficient electrons do not reach the target 3, part of the positive holes accumulated in the electronic scanning surface of the target 3 are not read out and remain until the next scanning.

Accordingly, the positive holes that are not read out and remain in the readout scanning of the first frame are read out by electrons that arrive at the time of the readout scanning of the second frame, so that portions with intense incident light remain as persistent images in the captured image.

In order to solve this problem, it is necessary to allow a sufficient amount of the electron beam to reach the target 3 and remove the positive holes that are not read out and remain after the readout scanning of the first frame (charge resetting), thus preparing for the readout scanning of the next frame.

However, when an electrode having a function of removing part of electrons such as the mesh structure 20 is disposed between the field-emission electron source array 10 and the target 3, there is a possibility that a sufficient amount of the electron beam does not reach the target 3 even in the charge resetting period.

Thus, in Embodiment 5 of the present invention, the amount of the electron beam 11*c* that passes through a plurality of the through holes 90 in the mesh structure 20 and travels toward the target 3 is varied by changing one or both of the first voltage V1 to be applied to the first electrode layer 19 and the second voltage V2 to be applied to the second electrode layer 16 while driving the field-emission electron source apparatus (more specifically, during the charge resetting period). This increases the amount of the electron beam reaching the target 3 during the charge resetting period, thereby securing a sufficient charge resetting electric current. In this way, it is possible to provide a field-emission electron source imaging apparatus with fewer persistent images.

It is particularly preferable that the second voltage V2 is raised while keeping the first voltage V1 constant during the charge resetting period. This allows an electric field formed in the electron beam passageway 92 to turn the direction of the velocity vector of the electron beam close to the Z-axis direction. As a result, the amount of the electron beam passing through the through hole 90 and reaching the target 3 increases. For example, in the case where, among the electron beam emitted from the selected cell, only the partial electron beam that has entered the through hole 90 corresponding to this selected cell can pass through the mesh structure 20 during usual driving, the partial electron beam that has entered the through holes around that through hole also can pass through the mesh structure 20, and the amount of the electron beam that can pass through the through hole 90 corresponding to the selected cell increases as well.

Now, the field-emission electron source imaging apparatus illustrated in FIG. 12 in which the first electrode layer 19 is supplied with about 250 V as the first voltage V1 and the second electrode layer 16 is supplied with about 75 V as the second voltage V2 at the time of usual driving (during a readout period) is taken as an example. In this state, this field-emission electron source imaging apparatus drives the cells in the field-emission electron source array 10 sequentially so as to read out the positive holes accumulated in the target 3.

Then, during the charge resetting period after reading out the positive holes corresponding to a single image or a single line, the second voltage V2 of the mesh structure 20 is raised from about 75 V to 150 V at the same time as emitting electron beams from all the cells or the cells corresponding to the single line.

This diminishes the trimming effect of the mesh structure 20, thus allowing the partial electron beams that have entered the through holes 90 around the through holes 90 corresponding to the cells emitting the electron beams also to pass through the mesh structure 20 and reach the target 3. Thus, the amount of the electron beams reaching the target 3 becomes much larger than that during the usual driving, so that it is possible to remove the positive holes that are not read out and remain in the electronic scanning surface of the target 3 at the time of the readout operation.

In the case described above, the first voltage V1 may be lowered at the same time with raising the second voltage V2 during the charge resetting period. Although this slightly complicates the driving, the amount of the electron beams leaving the mesh structure 20 can be increased further.

Since it is possible to increase the amount of the electron beams reaching the target 3 during the charge resetting period in this manner, the amount of the electron beams necessary for removing excessive positive holes that have remained on the target 3 can be secured. Accordingly, it is possible to provide a field-emission electron source imaging apparatus without persistent images.

Also, according to Embodiment 5 of the present invention, even when the positive holes remain in the electronic scanning surface of the target 3 at the end of a usual readout period corresponding to a single image or a single line, they can be removed by a large amount of the electron beams reaching the target 3 during the charge resetting period following that readout period. Therefore, the amount of the electron beams necessary for removing (reading out) all the positive holes during the usual readout period does not have to reach the target 3. Accordingly, it becomes possible to increase the thickness Ht of the mesh structure 20, thereby reducing the spot diameter of the electron beam on the target 3, for example. Alternatively, it becomes possible to design the arrangement of the cells in the field-emission electron source array 10 and a driving circuit with increased tolerance, thereby improving reliability.

As described above, in Embodiment 5 of the present invention, in the case where the mesh structure 20 includes the first electrode layer 19 and the second electrode layer 16 that are located at different positions in the Z-axis direction, one or both of the first voltage V1 to be applied to the first electrode layer 19 and the second voltage V2 to be applied to the second electrode layer 16 is changed between the readout period and the charge resetting period. This makes the amount of the electron beam reaching the target 3 during the charge resetting period larger than that during the readout period, thus making it possible to remove the positive holes remaining at the end of the readout period.

Accordingly, it is possible to provide a field-emission electron source imaging apparatus without persistent images.

Further, the amount of the electron beam reaching the target 3 during the readout period may be smaller than the amount necessary for removing (reading out) all the positive holes. Therefore, for example, by increasing the thickness Ht of the mesh structure 20, it is possible to reduce the spot diameter of the electron beam on the target 3, thus improving resolution. Alternatively, it becomes possible to design the arrangement of the cells in the field-emission electron source array 10 and the driving circuit with increased tolerance, thereby improving reliability.

Although the example described above has illustrated the case where one or both of the first voltage V1 and the second voltage V2 is changed in the field-emission electron source apparatus in Embodiment 2, the present invention is not limited to this. For example, a similar driving may be performed in the field-emission electron source apparatus according to Embodiment 3 (see FIG. 19) or another field-emission electron source apparatus including a mesh structure with two or more electrodes, and either can achieve an effect similar to that described above.

Also, how the voltages are changed is not limited to that in the example described above. For example, the first voltage V1 may be lowered while keeping the second voltage V2 constant. Alternatively, it may be possible to lower the first voltage V1 and raise the second voltage V2.

Embodiment 6

Figure 22:
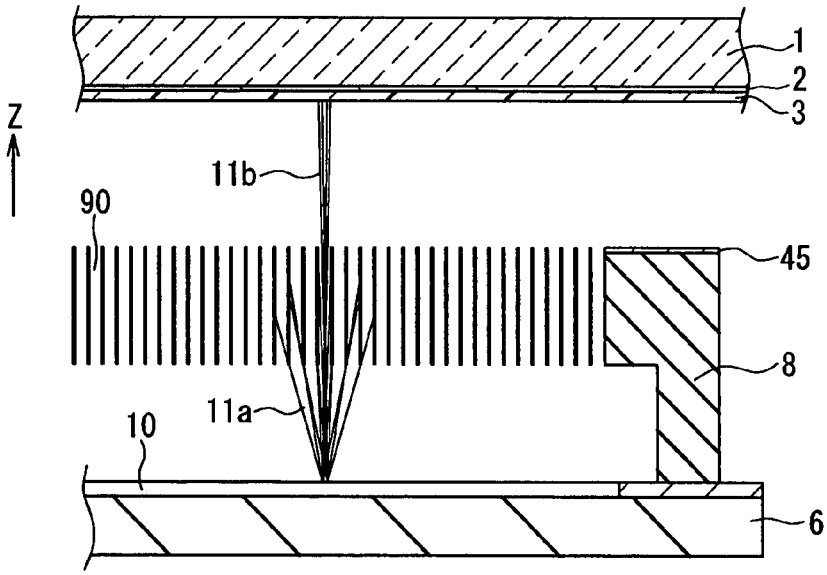
FIG. 22 is a partially enlarged sectional view showing a mesh structure and a field-emission electron source apparatus including the mesh structure according to Embodiment 6 of the present invention.
Figure 23:
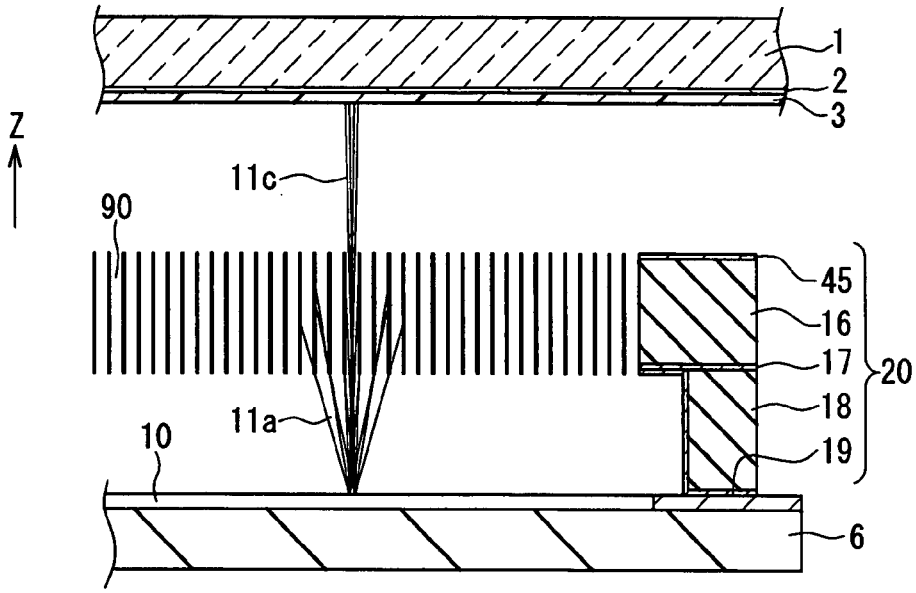
FIG. 23 is a partially enlarged sectional view showing another mesh structure and a field-emission electron source apparatus including the mesh structure according to Embodiment 6 of the present invention.

FIGS. 22 and 23 are partially enlarged sectional views showing mesh structures and field-emission electron source apparatuses including the mesh structures according to Embodiment 6 of the present invention.

The field-emission electron source apparatus shown in FIG. 22 is different from that according to Embodiment 1 shown in FIG. 1 in that the surface of the mesh structure 8 formed of a silicon-containing material on the side of the target 3 is provided with a shield electrode layer 45 formed of a low-resistance thin film.

The field-emission electron source apparatus shown in FIG. 23 is different from that according to Embodiment 2 shown in FIG. 12 in that the surface of the mesh structure 20 on the side of the target 3 is provided with a shield electrode layer 45 formed of a low-resistance thin film.

In the following, the description of portions that are the same as those in Embodiments 1 and 2 will be omitted.

The shield electrode layer 45 can be obtained by forming a metal thin film on the target-side surface of the mesh structure formed of the silicon-containing material by sputtering, vapor deposition, chemical plating or the like, for example. Alternatively, the shield electrode layer 45 can be formed by doping the silicon mesh structure with N-type or P-type materials from the target-side surface to a predetermined depth so as to raise their concentration. The shield electrode layer 45 is connected to a voltage supply source outside the vacuum container of the field-emission electron source apparatus.

By providing the shield electrode layer 45, in the electron beam 11*b*, 11*c* that has passed through the mesh structure 8, 20, a partial electron beam that has not reached the target 3 and returned is trapped by the shield electrode layer 45 properly, so that local voltage variations in the mesh structure 8, 20 can be suppressed.

In other words, although most of the electron beam 11*b*, 11*c* that has left the mesh structure 8, 20 reaches the target 3, part thereof does not reach the target 3 and returns to the mesh structure 8, 20 in some cases. This may cause the following problem.

For example, when a material with a relatively high resistance is exposed to the surface of the mesh structure 8, 20 on the side of the target 3, there are possibilities that the electron beam that has not reached the target 3 and returned to the mesh structure 8, 20 impacts on the mesh structure 8, 20, thus generating local voltage variations due to secondary electron emission or the like and that, after the electron beam that has returned is trapped by the mesh structure 8, 20, these electrons are not emitted to the outside in a short time, thus generating voltage variations. Also, there is a possibility that a pulse voltage to be applied to the gate electrodes in the field-emission electron source array 10 is superimposed on the mesh structure 8, 20.

When such phenomena occur, the trimming effect of the mesh structure 8, 20 varies locally, so that the amount of the electron beam leaving the mesh structure 8, 20 varies. As a result, the brightness becomes uneven in the field-emission electron source display apparatus, or the local voltage variations in the mesh structure are transmitted to the surface of the target 3 so as to cause noise superimposition on an output signal in the field-emission electron source imaging apparatus.

On the other hand, according to Embodiment 6 of the present invention, the surface of the mesh structure 8, 20 on the side of the target 3 is covered with the shield electrode layer 45 formed of a low-resistance thin film, and this shield electrode layer 45 is connected to the voltage supply source outside the vacuum container of the field-emission electron source apparatus. Therefore, the secondary electron emission by the electrons that leave the mesh structure 8, 20, do not reach the target 3 and return to the mesh structure 8, 20 is suppressed by the shield electrode layer 45, and the electrons trapped by the shield electrode layer 45 can be discharged to the voltage supply source within a short time. Consequently, the local voltage variations in the mesh structure 8, 20 do not occur.

Further, since the shield electrode layer 45 formed on the mesh structure 8, 20 on the side of the target 3 is connected to the voltage supply source outside the vacuum container of the field-emission electron source apparatus, a pulse voltage to be applied to the gate electrodes in the field-emission electron source array 10 is not superimposed on the mesh structure 8, 20, in particular, the shield electrode layer 45 formed on the surface on the side of the target 3.

Thus, the problem of the local variations in the trimming effect of the mesh structure 8, 20 varying the amount of the electron beam leaving the mesh structure 8, 20 does not occur. Therefore, the brightness unevenness is suppressed in the field-emission electron source display apparatus, and the problem that the local voltage variations in the mesh structure are transmitted to the target surface so as to cause noise superimposition on the output signal in the field-emission electron source imaging apparatus does not occur. Consequently, it is possible to provide a high-performance field-emission electron source apparatus.

Embodiment 7

Figure 24:
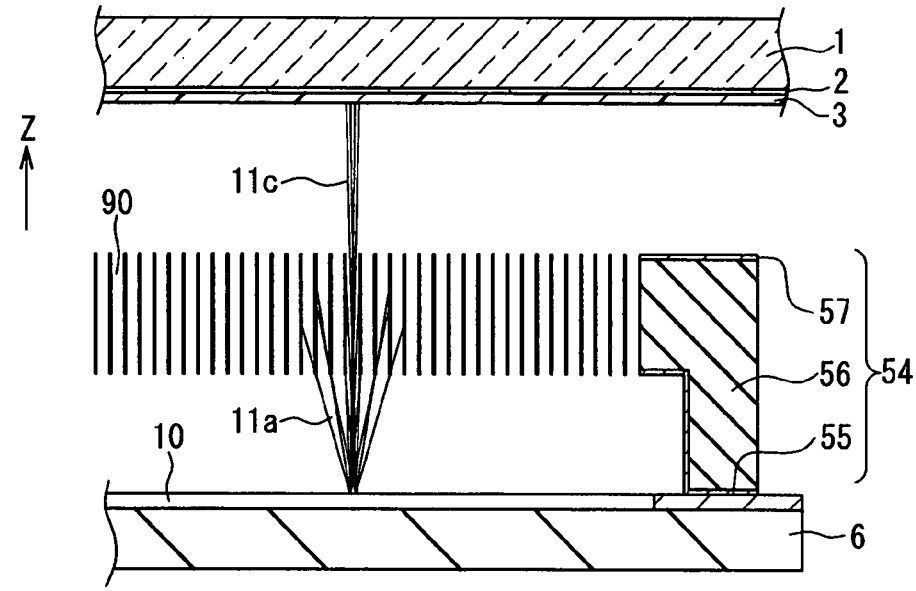
FIG. 24 is a partially enlarged sectional view showing a mesh structure and a field-emission electron source apparatus including the mesh structure according to Embodiment 7 of the present invention.

FIG. 24 is a partially enlarged sectional view showing another mesh structure and a field-emission electron source apparatus including the mesh structure according to Embodiment 7 of the present invention.

As shown in FIG. 24, this field-emission electron source apparatus according to Embodiment 7 of the present invention is different from that according to Embodiment 1 in that a mesh structure 54 formed of a silicon-containing material includes a high resistance layer 56, a low-resistance first electrode layer 55 that is formed on the high resistance layer 56 on the side of the field-emission electron source array 10 and supplied with the first voltage and a low-resistance second electrode layer 57 that is formed on the high resistance layer 56 on the side of the target 3 and supplied with the second voltage. In the following, the description of portions that are the same as those in Embodiment 1 will be omitted.

Embodiment 7 of the present invention achieves not only the same effect as Embodiment 1 but also an effect in which the production of the mesh structure becomes easier.

For example, in the case where the through holes 90 are formed by etching in the mesh structure using the SOI substrate including the $SiO_2$ insulating layer and the silicon layers on both sides of the insulating layer as described in Embodiment 2, since the layers formed of different materials are layered in the thickness direction, there arise problems that the through holes are easy to etch in the silicon layers but difficult to etch in the insulating layer and that the substrate cracks during the etching of the through holes due to local stress concentration caused by the difference in the materials, for example.

In contrast, in accordance with Embodiment 7 of the present invention, for example, the through holes 90 are formed by etching in the high-resistance silicon substrate, followed by doping the both surface layers with the N-type or P-type materials so as to achieve a low resistance, thereby making it possible to produce the mesh structure 54 easily. Alternatively, the mesh structure 54 may be produced by doping the both surface layers of the high-resistance silicon substrate with the N-type or P-type materials so as to achieve a low resistance and then forming the through holes 90 by etching.

Alternatively, it also may be possible to form the through holes 90 by etching in the high-resistance substrate and then form a low-resistance film of metal or the like on the both surfaces of the high-resistance substrate by electrolytic etching or the like.

Since the mesh structure 54 has the structure described above, it can be produced easily.

Also, similarly to Embodiment 1, it is possible to achieve the trimming effect in which the partial electron beam that has entered through holes 90 other than the through hole 90 corresponding to the selected cell in the divergent electron beam emitted from the selected cell in the field-emission electron source impacts on and is absorbed and removed effectively by the lateral walls of the electron beam passageways 92 in the mesh structure.

It also may be possible to satisfy V1>V2, where V1 indicates the first voltage to be applied to the first electrode layer 55 and V2 indicates the second voltage to be applied to the second electrode layer 57. This achieves an effect similar to that in Embodiment 2.

In other words, setting V1>V2 forms a voltage gradient in the high resistance layer 56, and this voltage gradient decelerates the electron beam that has entered the through holes 90 in the mesh structure 54. This reduces the velocity component of the electron beam in the Z-axis direction and, relative thereto, increases the velocity component thereof in a direction perpendicular to the Z axis. Thus, the electron beam is more likely to impact on the lateral walls of the electron beam passageways 92 in the region of the second electrode layer 16. Accordingly, it is possible to improve the trimming effect in which the electron beam 11*a* that has entered through holes other than the through hole corresponding to the selected cell is absorbed and removed by the lateral walls of the electron beam passageways 92 of these through holes, allowing only the electron beam 11*a* that has entered the through hole corresponding to the selected cell to reach the target 3.

Thus, Embodiment 7 of the present invention can achieve the following effect similarly to Embodiment 2. That is, even if the distance from the field-emission electron source array to the target varies from a designed value due to assembly variations or atmospheric pressure, the variation in the size of the electron beam spot on the target 3 can be suppressed further. Thus, it is possible to provide a field-emission electron source display apparatus capable of displaying a uniform quality image and a field-emission electron source imaging apparatus capable of capturing a uniform quality image.

One or both of voltages V1 and V2 may be changed while driving the field-emission electron source apparatus, where V1 indicates the first voltage to be applied to the first electrode layer 55 and V2 indicates the second voltage to be applied to the second electrode layer 57. This achieves an effect similar to that in Embodiment 5.

In other words, in a field-emission electron source imaging apparatus in which the target 3 is provided with a photoelectric conversion film, one or both of the first voltage V1 and the second voltage V2 is changed between the readout period and the charge resetting period, thereby producing different trimming effects of the mesh structure 54 between the readout period and the charge resetting period. This makes the amount of the electron beam reaching the target 3 during the charge resetting period larger than that during the readout period, thus making it possible to remove the positive holes remaining at the end of the readout period. Accordingly, similarly to Embodiment 5, Embodiment 7 of the present invention can provide a field-emission electron source imaging apparatus without persistent images.

Embodiment 8

Figure 25:
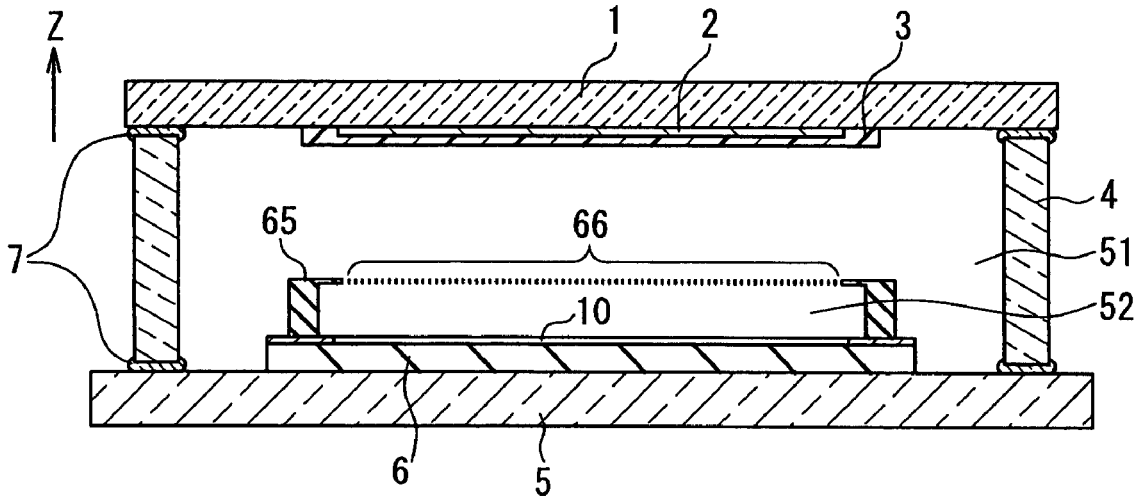
FIG. 25 is a sectional view showing a mesh structure and a field-emission electron source apparatus including the mesh structure according to Embodiment 8 of the present invention.
Figure 26:
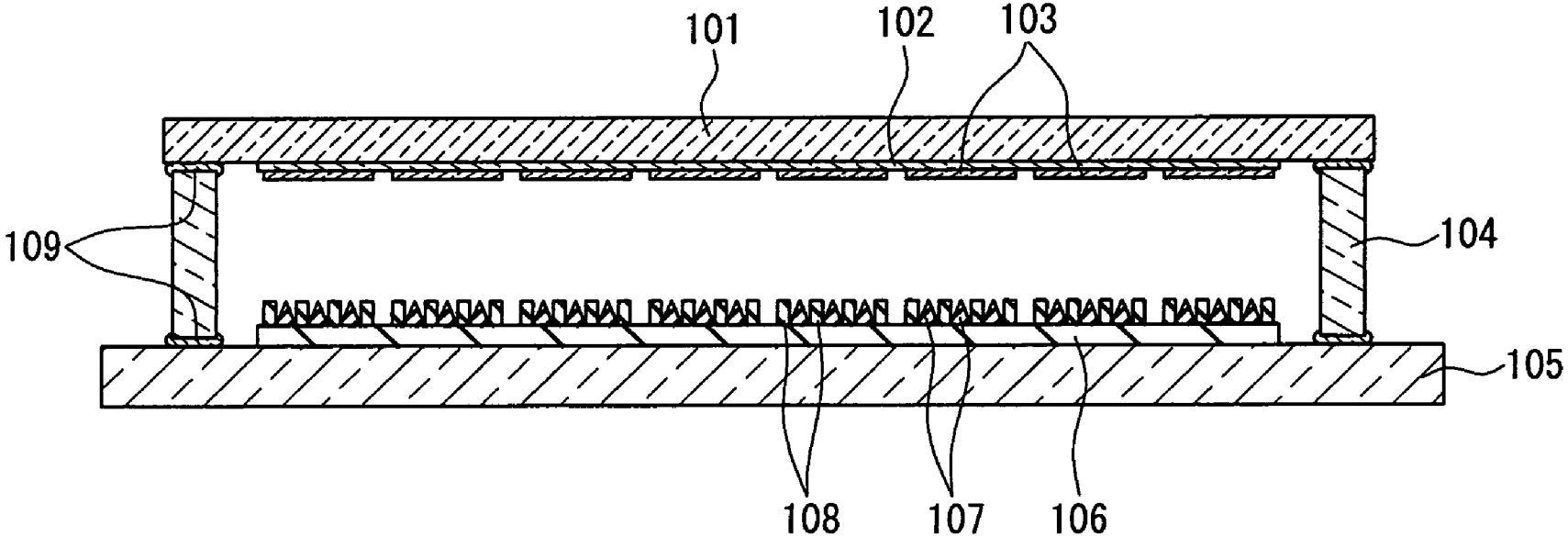
FIG. 26 PRIOR ART
FIG. 26 is a sectional view showing a conventional field-emission electron source apparatus using a field-emission electron source array.

FIG. 25 is a sectional view showing a mesh structure and a field-emission electron source apparatus including the mesh structure according to Embodiment 8 of the present invention.

As shown in FIG. 25, the field-emission electron source apparatus according to Embodiment 8 of the present invention is different from that according to Embodiment 1 shown in FIG. 1 in that a mesh structure 65 has a thin trimming portion 66. In the following, the description of portions that are the same as those in Embodiment 1 will be omitted.

In Embodiment 8 of the present invention illustrated in FIG. 25, the mesh structure 65 formed of a silicon-containing material has a thin trimming portion 66. This makes it possible to produce the mesh structure 65 by processing the silicon-containing material by a MEMS technique, which is the semiconductor processing technology, so that a plurality of through holes can be formed in the mesh structure so as to be distributed uniformly in a highly accurate manner. Thus, by avoiding the problem that the shape or size of the through holes differs between the central portion and the peripheral portion when fixed to the field-emission electron source apparatus under a tension as seen in the conventional mesh structure made of metal (for example, a copper mesh), it is possible to provide a mesh structure in which the amount of the electron beam reaching the target can be made uniform regardless of the position on the target when used in the field-emission electron source apparatus.

Furthermore, in the case where the semiconductor substrate 6 on which the field-emission electron source array 10 is formed is formed of the silicon-containing material, the semiconductor substrate 6 and the mesh structure 65 are made of the same material, so that a heating temperature in the production process can be raised, allowing sufficient degassing. Therefore, it is possible to achieve a field-emission electron source apparatus that has less gas emission and a high reliability in withstand voltage characteristics.

The mesh structure and the field-emission electron source apparatus according to the present invention are applicable to any fields with no particular limitations and can be utilized in, for example, a field-emission electron source display apparatus and a field-emission electron source imaging apparatus.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A field-emission electron source apparatus comprising:

a field-emission electron source array;

a target for performing a predetermined operation using an electron beam emitted from the field-emission electron source array; and a mesh structure that is disposed between the field-emission electron source array and the target and provided with a plurality of through holes through which the electron beam emitted from the field-emission electron source array passes;

wherein each of the plurality of through holes has an opening on a side of the field-emission electron source array and an electron beam passageway that continues from the opening, the mesh structure is formed of a silicon-containing material doped with a N-type or P-type material; and the mesh structure comprises at least two electrode layers and at least one intermediate layer disposed between the at least two electrode layers.

2. The field-emission electron source apparatus according to claim 1, wherein the mesh structure comprises a silicon layer doped with the N-type or P-type material and an insulating layer formed of $SiO_2$.

3. The field-emission electron source apparatus according to claim 1, wherein at least one of a surface of the mesh structure on the side of the field-emission electron source array and a surface of the mesh structure on a side of the target is provided with an electrically conductive thin film.

4. The field-emission electron source apparatus according to claim 1, wherein the mesh structure comprises a base layer that constitutes a major part of the mesh structure and a thin film layer that is formed on a surface of the base layer and has a lower resistance than the base layer.

5. The field-emission electron source apparatus according to claim 1, wherein the at least one intermediate layer is an insulating layer, and the at least two electrode layers form at least two potential spaces in the electron beam passageway.

6. The field-emission electron source apparatus according to claim 1, wherein one of the at least two electrode layers is a first electrode layer that is disposed on the side of the field-emission electron source array with respect to the at least one intermediate layer and supplied with a first voltage, and the other is a second electrode layer that is disposed on a side of the target with respect to the at least one intermediate layer and supplied with a second voltage, and the at least one intermediate layer is a high resistance layer that has a higher resistance than the first electrode layer and the second electrode layer.

7. The field-emission electron source apparatus according to claim 1, satisfying $V1>V2$, where V1 indicates a voltage to be applied to a first electrode layer in the at least two electrode layers that is disposed on the side of the field-emission electron source array with respect to the at least one intermediate layer, and V2 indicates a voltage to be applied to a second electrode layer in the at least two electrode layers that is disposed on a side of the target with respect to the at least one intermediate layer.

8. The field-emission electron source apparatus according to claim 1, satisfying $T1<<T2$, where a first electrode layer is an electrode layer in the at least two electrode layers that is disposed on the side of the field-emission electron source array with respect to the at least one intermediate layer, a second electrode layer is an electrode layer in the at least two electrode layers that is disposed on a side of the target with respect to the at least one intermediate layer, T1 indicates a length of the first electrode layer in a length of the electron beam passageway, and T2 indicates a length of the second electrode layer in the length of the electron beam passageway.

9. The field-emission electron source apparatus according to claim 1, wherein when V1 indicates a voltage to be applied to a first electrode layer in the at least two electrode layers that is disposed on the side of the field-emission electron source array with respect to the at least one intermediate layer and V2 indicates a voltage to be applied to a second electrode layer in the at least two electrode layers that is disposed on a side of the target with respect to the at least one intermediate layer, an amount of an electron beam that passes through the plurality of through holes in the mesh structure and travels toward the target is varied by changing one or both of the voltage V1 and the voltage V2 while driving the field-emission electron source apparatus.

10. The field-emission electron source apparatus according to claim 1, wherein a cross-sectional shape of the electron beam passageway along a direction perpendicular to a direction in which the electron beam passageway extends is a circle, an ellipse, a polygon with all interior angles being larger than 90° or a polygon whose adjacent sides are connected by a circular arc.

11. The field-emission electron source apparatus according to claim 1, wherein the field-emission electron source array comprises a plurality of cells comprising a plurality of electron sources each emitting electrons, the field-emission electron source array and the mesh structure are arranged such that the plurality of openings and the plurality of cells are in one-to-one correspondence with each other in a vertical direction, and an electron beam emitted from the cell enters the corresponding opening, passes through the electron beam passageway and reaches the target.

12. The field-emission electron source apparatus according to claim 1, further comprising a pre-focusing electrode for pre-focusing the electron beam emitted from the field-emission electron source array, the pre-focusing electrode being provided between the field-emission electron source array and the mesh structure.

13. A field-emission electron source apparatus comprising:

a field-emission electron source array;

a target for performing a predetermined operation using an electron beam emitted from the field-emission electron source array; and a mesh structure that is disposed between the field-emission electron source array and the target and provided with a plurality of through holes through which the electron beam emitted from the field-emission electron source array passes;

wherein each of the plurality of through holes has an opening on a side of the field-emission electron source array and an electron beam passageway that continues from the opening, and the mesh structure is formed of a silicon-containing material doped with a N-type or P-type material;

wherein the mesh structure comprises at least two electrode layers and at least one intermediate layer disposed between the at least two electrode layers, further comprising a substrate on which the field-emission electron source array is formed, wherein the mesh structure has a spacer portion that is formed as one piece with the mesh structure and spaces out the field-emission electron source array and the openings of the plurality of through holes from each other, and the mesh structure is provided on the substrate via the spacer portion.

14. The field-emission electron source apparatus according to claim 13, wherein the spacer portion and the substrate are joined using an electrically conductive material, and a voltage is supplied to at least part of the mesh structure from the substrate via the electrically conductive material.

15. A method for driving a field-emission electron source apparatus comprising a field-emission electron source array, a target for performing a predetermined operation using an electron beam emitted from the field-emission electron source array, and a mesh structure that is disposed between the field-emission electron source array and the target and provided with a plurality of through holes through which the electron beam emitted from the field-emission electron source array passes, wherein each of the plurality of through holes has an opening on a side of the field-emission electron source array and an electron beam passageway that continues from the opening, the mesh structure is formed of a silicon-containing material doped with a N-type or P-type material, the mesh structure comprises at least two electrode layers and at least one intermediate layer disposed between the at least two electrode layers, and when a first voltage (V1) indicates a voltage to be applied to a first electrode layer in the at least two electrode layers that is disposed on the side of the field-emission electron source array with respect to the at least one intermediate layer and a second voltage (V2) indicates a voltage to be applied to a second electrode layer in the at least two electrode layers that is disposed on a side of the target with respect to the at least one intermediate layer, an amount of an electron beam that passes through the plurality of through holes in the mesh structure and travels toward the target is varied by changing one or both of the first and second voltages while driving the field-emission electron source apparatus.

* * * * *